US009367983B2

(12) United States Patent
Repp et al.

(10) Patent No.: US 9,367,983 B2
(45) Date of Patent: Jun. 14, 2016

(54) SYSTEMS AND METHODS FOR DISPENSING SOFT GOODS

(71) Applicant: June Tailor, Inc., Richfield, WI (US)

(72) Inventors: Jilene A. Repp, Hartland, WI (US); Francis A. Yogerst, West Bend, WI (US)

(73) Assignee: JUNE TAILOR, INC., Richfield, WI (US)

( * ) Notice: Subject to any disclaimer, the term of this patent is extended or adjusted under 35 U.S.C. 154(b) by 102 days.

(21) Appl. No.: 14/270,535

(22) Filed: May 6, 2014

(65) Prior Publication Data

US 2014/0244032 A1 Aug. 28, 2014

Related U.S. Application Data

(63) Continuation-in-part of application No. 14/029,575, filed on Sep. 17, 2013, now Pat. No. 8,755,933.

(60) Provisional application No. 61/702,633, filed on Sep. 18, 2012.

(51) Int. Cl.

| | |
|---|---|
| ***G07F 11/66*** | (2006.01) |
| ***G07F 7/08*** | (2006.01) |
| ***G07F 9/02*** | (2006.01) |

(52) U.S. Cl.

CPC *G07F 11/66* (2013.01); *G07F 7/08* (2013.01); *G07F 9/02* (2013.01)

(58) Field of Classification Search

CPC ..... G07F 11/66; B65H 16/08; B65H 16/106
USPC ..... 700/242, 238, 240, 237, 236; 242/563, 242/563.2

See application file for complete search history.

(56) References Cited

U.S. PATENT DOCUMENTS

| | | | | |
|---|---|---|---|---|
| 4,004,748 | A * | 1/1977 | Schwarz | B65H 16/028 242/563.2 |
| 4,084,467 | A * | 4/1978 | Schwarz | B65H 16/028 242/563.2 |
| 5,487,010 | A | 1/1996 | Drake et al. | |
| 5,997,236 | A | 12/1999 | Picioccio et al. | |
| 6,328,245 | B1 * | 12/2001 | Kastfelt | B65H 16/106 242/420.3 |

(Continued)

FOREIGN PATENT DOCUMENTS

KR 102003007029 8/2003

OTHER PUBLICATIONS

Canadian Office Action for Canadian Patent Application No. 2,884,751, dated Apr. 1, 2015, 4 pages.

(Continued)

*Primary Examiner* — Timothy Waggoner
(74) *Attorney, Agent, or Firm* — Foley & Lardner LLP

(57) ABSTRACT

A soft good dispensing device includes a loading zone configured to receive a soft good supply in multiple different orientations, a scale configured to measure a weight of the soft good supply in the loading zone, a controller configured to estimate an amount of a soft good remaining on the soft good supply using the measured weight, a user interface configured to display the estimated amount of the soft good remaining and to receive a user selection of a desired quantity of the soft good, and a dispensing mechanism configured to automatically dispense the desired quantity of the soft good from the soft good supply.

18 Claims, 39 Drawing Sheets

(56) References Cited

U.S. PATENT DOCUMENTS

| | | | | |
|---|---|---|---|---|
| 6,343,491 | B1 | 2/2002 | Jung | |
| 6,473,666 | B1 | 10/2002 | Samura | |
| 8,755,933 | B2 * | 6/2014 | Repp | G07F 11/66 242/563 |
| 2004/0060264 | A1 | 4/2004 | Miller | |
| 2004/0128025 | A1 | 7/2004 | Deal | |
| 2006/0217836 | A1 | 9/2006 | Poliner | |
| 2014/0081451 | A1 | 3/2014 | Repp et al. | |

OTHER PUBLICATIONS

International Search Report and Written Opinion for International Application No. PCT/US2015/025670, dated Jul. 16, 2015, 8 pages.
International Preliminary Report on Patentability for PCT Application No. PCT/US2013/060073, dated Mar. 24, 2015, 10 pages.
International Search Report and Written Opinion for International Application No. PCT/US2013/060073, dated Dec. 20, 2013, 14 pages.

* cited by examiner

270

330

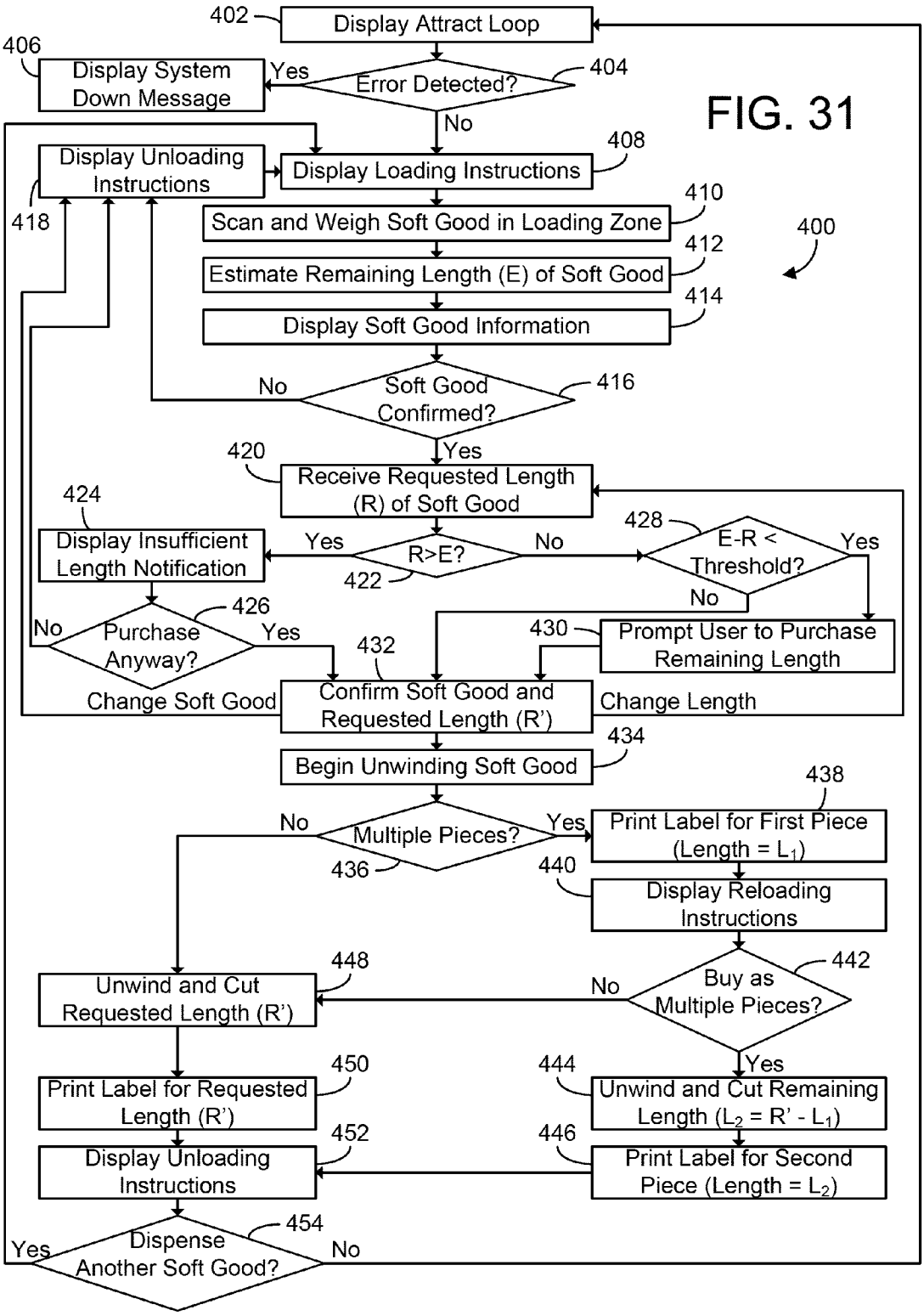
FIG. 31
400
402
Display Attract Loop
404
Error Detected?
Yes
406
Display System Down Message
No
408
Display Loading Instructions
418
Display Unloading Instructions
410
Scan and Weigh Soft Good in Loading Zone
412
Estimate Remaining Length (E) of Soft Good
414
Display Soft Good Information
416
Soft Good Confirmed?
No
Yes
420
Receive Requested Length (R) of Soft Good
422
R>E?
Yes
No
424
Display Insufficient Length Notification
428
E-R < Threshold?
Yes
No
426
Purchase Anyway?
No
Yes
430
Prompt User to Purchase Remaining Length
432
Confirm Soft Good and Requested Length (R')
Change Soft Good
Change Length
434
Begin Unwinding Soft Good
436
Multiple Pieces?
No
Yes
438
Print Label for First Piece (Length = $L_1$)
440
Display Reloading Instructions
442
Buy as Multiple Pieces?
No
Yes
448
Unwind and Cut Requested Length (R')
450
Print Label for Requested Length (R')
444
Unwind and Cut Remaining Length ($L_2$ = R' - $L_1$)
446
Print Label for Second Piece (Length = $L_2$)
452
Display Unloading Instructions
454
Dispense Another Soft Good?
Yes
No

500

SYSTEMS AND METHODS FOR DISPENSING SOFT GOODS

CROSS-REFERENCE TO RELATED PATENT APPLICATIONS

This application is a continuation in part of U.S. patent application Ser. No. 14/029,575 filed Sep. 17, 2013, which claims the benefit of and priority to U.S. Provisional Patent Application No. 61/702,633 filed Sep. 18, 2012. U.S. patent application Ser. No. 14/029,575 and U.S. Provisional Patent Application No. 61/702,633 are incorporated by reference herein in their entireties.

FIELD

The present disclosure relates generally to systems and methods for dispensing (e.g., measuring, cutting, separating, etc.) soft goods such as fabric, lace, foam, canvas, felt, and other consumer materials that are dispensed in smaller quantities from a relatively larger supply. The present disclosure relates more particularly to a user-operable device for automatically dispensing a particular quantity of a soft good (e.g., a "fabric cutting kiosk") and a method for operating the same.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Many retail stores sell fabric or other soft goods (e.g., lace, foam, canvas, felt, etc.) which are typically merchandised in large quantities. For example, soft goods may be maintained by the retail stores in the form of a bolt, roll, spool, or other configuration for efficiently storing and displaying many different soft goods in a limited retail space. Conventional systems for dispensing soft goods typically require a customer (e.g., at a retail store or other similar outlet) to bring the bolt or reel of the soft good to a service counter where store personnel assist the customer. The store personnel typically measure-out the customer's desired quantity of the soft good and then manually cut the desired quantity from the bolt or roll using scissors or other cutting instruments.

Conventional systems for dispensing soft goods suffer from several disadvantages. Customers are often forced to wait in a line or other queuing system (e.g., "take-a-number," etc.) until store personnel are available to assist the customer in manually measuring and cutting the soft good from the bolt or roll. Store personnel generally provide customers with more than the requested amount of material due to inaccuracies in the manual cutting process. Additionally, conventional systems for dispensing soft goods typically require large, space-consuming measuring tables that occupy a significant portion of the retail space. It would be desirable to provide an improved system and method for dispensing soft goods that overcomes the disadvantages of conventional systems.

SUMMARY

One implementation of the present disclosure is a method for dispensing a soft good. The method includes receiving a soft good supply at a loading zone of a soft good dispensing device, reading a machine-readable image affixed to the soft good supply using a scanner of the soft good dispensing device, and determining an identity of the soft good supply in the loading zone using data from the scanner. The method further includes measuring a weight of the soft good supply using a scale of the soft good dispensing device and estimating an amount of the soft good remaining on the soft good supply using the measured weight. The method further includes displaying a graphical user interface via a user interface of the soft good dispensing device. The graphical user interface includes an indication of the identity of the soft good supply and the estimated amount of the soft good remaining. The method further includes receiving a desired quantity of the soft good at a controller of the soft good dispensing device and operating, by the controller, a dispensing mechanism of the soft good dispensing device to automatically dispense the desired quantity of the soft good from the soft good supply.

In some embodiments, the soft good includes at least one of fabric, lace, trim, ribbon, cording, elastic, foam, batting, stitching cloth, interfacing, plastic, vinyl, fur, felt, fleece, and fusible web.

In some embodiments, the method includes determining whether the desired quantity of the soft good exceeds the estimated amount of the soft good remaining on the soft good supply displaying a message via the user interface indicating that an insufficient amount of the soft good is available in response to a determination that the desired quantity of the soft good exceeds the estimated amount of the soft good remaining on the soft good supply.

In some embodiments, the method includes, in response to a determination that the estimated amount of the soft good remaining on the soft good supply exceeds the desired quantity of the soft good, calculating a difference between the estimated amount of the soft good remaining on the soft good supply and the desired quantity of the soft good, comparing the calculated difference with a threshold value, and displaying a prompt via the user interface for a user to indicate whether to increase the desired quantity in response to a determination that the calculated difference is less than the threshold value.

In some embodiments, the method includes displaying instructions via the user interface for at least one of loading the soft good supply into the loading zone, unloading the soft good supply from the loading zone, and reloading the soft good supply in the loading zone.

In some embodiments, the method includes moving a clamp roller of the soft good dispensing device between an unclamped position in which the soft good supply is loaded into the loading zone and a clamped position in which a free end of the soft good is clamped between the clamp roller and another roller of the soft good dispensing device.

In some embodiments, the method includes moving the clamp roller from the unclamped position into the clamped position in response to a determination, by the controller, that a loading zone door of the soft good dispensing device is closed. The controller may operate an actuator configured to move the clamp roller between the clamped position and the unclamped position.

In some embodiments, operating the dispensing mechanism of the soft good dispensing device includes operating a motor of the dispensing mechanism to control a rotational position of one or more rollers rotatably coupled to the motor, unwinding the soft good from the soft good supply by rotating the rollers until the desired quantity of the soft good is unwound from the soft good supply, and operating a cutting mechanism to separate the desired quantity of the soft good from the soft good supply.

In some embodiments, the method includes moving a lift element of the soft good dispensing device between a lowered position in which the soft good supply is loaded into the loading zone and a raised position in which an unwound portion of the soft good is directed at least partially upward from the soft good supply, over the lift element, and at least partially downward from the lift element toward the dispensing mechanism.

In some embodiments, the method includes operating a lift element of the soft good dispensing device. The lift element may be configured to direct an unwound portion of the soft good toward the dispensing mechanism from a uniform position for multiple different loading orientations of the soft good supply.

In some embodiments, the method includes determining whether the desired quantity of the soft good exists in more than one piece on the soft good supply and displaying a prompt via the user interface for a user to indicate whether to purchase the desired quantity of the soft good in a single piece or in multiple pieces.

In some embodiments, the method includes using an optical sensor of the soft good dispensing device to detect whether operation of the dispensing mechanism results in an unwinding of the soft good from the soft good supply and determining that the desired quantity of the soft good exists in more than one piece in response to a detection, by the optical sensor, that the unwinding of the soft good has stopped prior to unwinding the desired quantity of the soft good.

Another implementation of the present disclosure is a soft good dispensing device including a loading zone configured to receive a soft good supply in multiple different orientations, a scale configured to measure a weight of the soft good supply in the loading zone, a controller configured to estimate an amount of a soft good remaining on the soft good supply using the measured weight, a user interface configured to display the estimated amount of the soft good remaining and to receive a user selection of a desired quantity of the soft good, and a dispensing mechanism configured to automatically dispense the desired quantity of the soft good from the soft good supply.

In some embodiments, the soft good includes at least one of fabric, lace, trim, ribbon, cording, elastic, foam, batting, stitching cloth, interfacing, plastic, vinyl, fur, felt, fleece, and fusible web.

In some embodiments, the soft good dispensing device includes a scanner configured to read a machine-readable image affixed to the soft good supply in the loading zone. The controller may be configured to determine an identity of the soft good supply in the loading zone using data from the scanner. The user interface may be configured to display an indication of the identity of the soft good supply.

In some embodiments, the controller is configured to use the identity of the soft good to determine one or more attributes of the identified soft good. In some embodiments, the controller is configured to use the one or more attributes of the identified soft good in conjunction with the measured weight to estimate the amount of the soft good remaining on the soft good supply.

In some embodiments, the dispensing mechanism includes a motor in communication with and operable by the controller, one or more rollers rotatably coupled to the motor and configured to unwind the desired quantity of the soft good from the soft good supply, and a cutting mechanism in communication with and operable by the controller, the cutting mechanism configured to separate the desired quantity of the soft good from the soft good supply.

In some embodiments, the soft good dispensing device includes a lift element is configured to direct an unwound portion of the soft good toward the dispensing mechanism from a uniform position for multiple different orientations of the soft good supply in the loading zone.

In some embodiments, the soft good dispensing device includes a clamp movable between an unclamped position and a clamped position. The controller may be configured to cause the clamp to move into the unclamped position in response to a determination by the controller that the desired quantity of the soft good has been unwound from the soft good supply. The clamp may be configured to hold an unwound portion of the soft good in a stable position while a cutting mechanism separates the desired quantity of the soft good from the soft good supply.

In some embodiments, the soft good dispensing device includes an optical sensor configured to detect whether operation of the dispensing mechanism results in an unwinding of the soft good from the soft good supply. The controller may be configured to determine whether the desired quantity of the soft good exists in more than one piece in response to a detection, by the optical sensor, that the unwinding of the soft good has stopped prior to unwinding the desired quantity of the soft good.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

FIG. 31 is a flowchart of a process for dispensing a soft good that may be performed by the soft good dispensing device of FIG. 1, according to an exemplary embodiment.

DETAILED DESCRIPTION

Referring generally to the FIGURES, systems and methods for dispensing soft goods are shown, according to various exemplary embodiments. Soft goods encompass a wide variety of consumer materials including, for example, fabric, lace, trim, ribbon, cording, elastic, foam, batting, stitching cloth (e.g., needlework canvas, aids cloth for cross-stitching, etc.), interfacing, flexible polymers (e.g., plastics), fur, felt, fleece, fusible web, textiles, woven, and non-woven materials. Dispensing a soft good may include one or more actions related to obtaining a relatively smaller quantity of the soft good from a relatively larger quantity or supply. For example, dispensing a soft good may include unwinding or unwrapping the soft good from a bolt, spool, or roll; measuring or weighing a desired quantity of the soft good; and/or separating the desired quantity of the soft good from the supply or source (e.g., cutting, tearing, shearing, etc.) such that the desired quantity can be transported and/or purchased separate from the supply. The systems and methods described herein may be used to automatically or semi-automatically dispense a desired quantity of a soft good or other suitable material.

Before discussing further details of the soft good dispensing system and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

Figure 1:
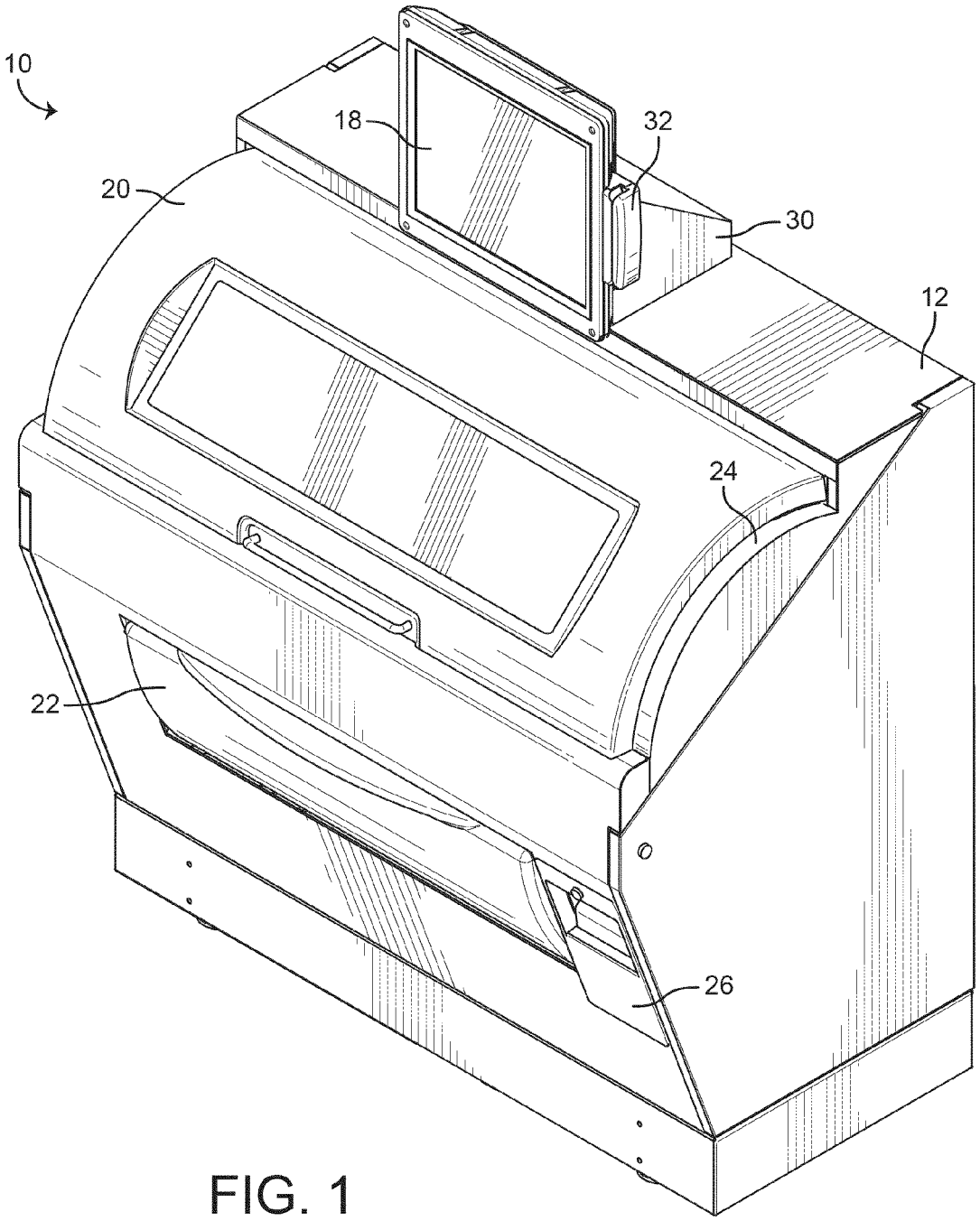
FIG. 1 is a perspective view of a soft good dispensing device including a user interface, shown with a loading zone door and a dispensing zone door in a closed position, according to an exemplary embodiment.
Figure 2:
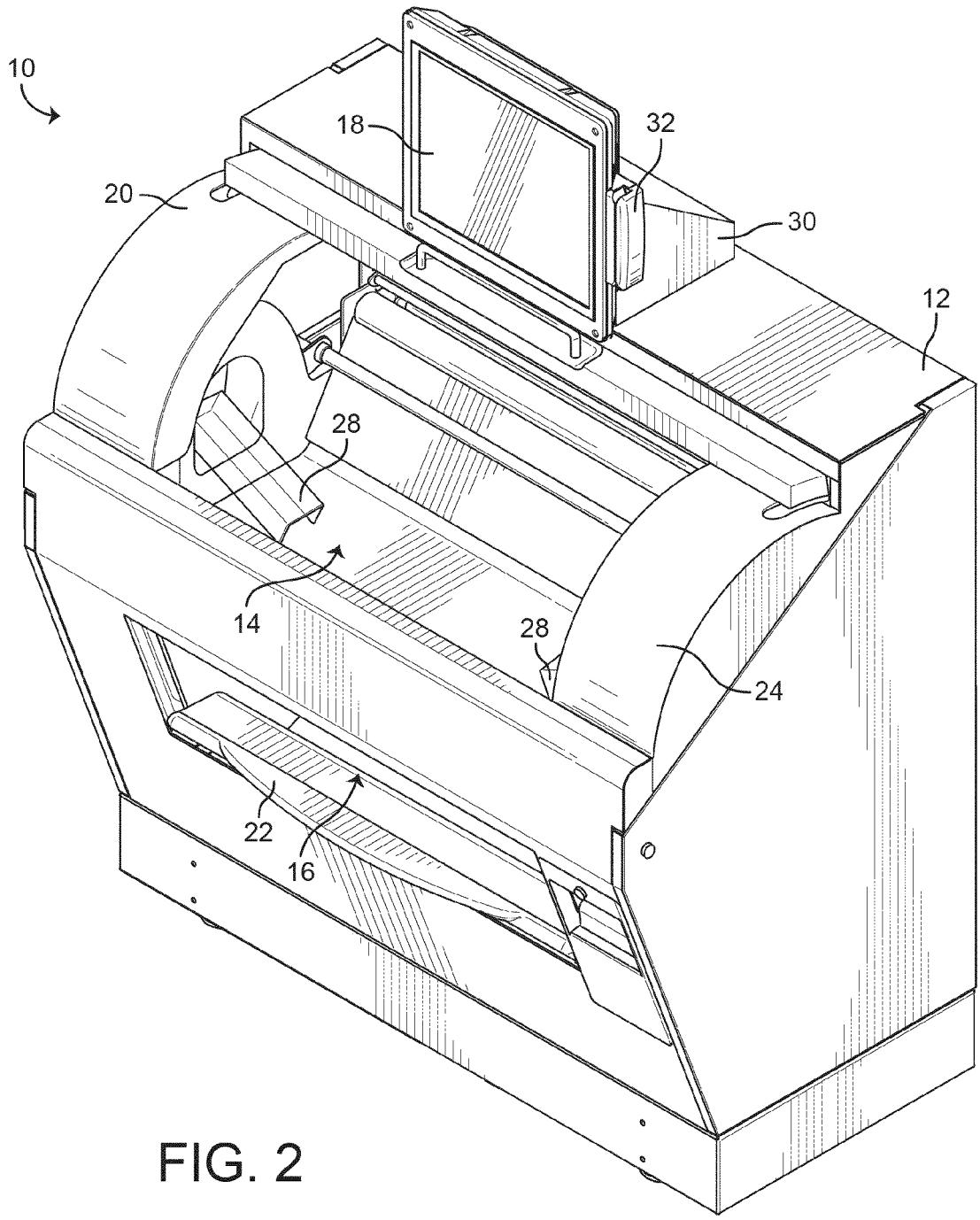
FIG. 2 is a perspective view of a soft good dispensing device of FIG. 1 shown with the loading zone door and the dispensing zone door in a closed position, according to an exemplary embodiment.

Referring now to FIGS. 1-2, a soft good dispensing device 10 is shown, according to an exemplary embodiment. Dispensing device 10 is configured to receive a supply of a soft good (e.g., in the form of a bolt, roll, spool, reel, feed, etc.) and to dispense a desired quantity of the soft good to a user. Dispensing device 10 may be implemented, for example, in a retail store, supply distribution center, warehouse, textile manufacturing facility, or other location at which soft goods are sold, handled, distributed, or separated into smaller quantities.

In some embodiments, dispensing device 10 is a fabric cutting kiosk. In various embodiments, dispensing device 10 may be physically separate from other structures or devices in its immediate surroundings (e.g., a kiosk, as shown in FIG. 1) or recessed into a wall or pillar, incorporated into a counter or shelving system, or otherwise physically integrated with its immediate environment. Dispensing device 10 may be in the form of a kiosk or may have any other physical form. Dispensing device 10 may be configured to dispense a wide variety of fabrics and other types of soft goods.

Still referring to FIGS. 1-2, dispensing device 10 is shown to include a housing 12. Housing 12 may be a shell or casing within which various electronic and/or mechanical components of dispensing device 10 are contained. Housing 12 may form a protective barrier around the internal components of dispensing device 10 and may provide a rigid or substantially rigid structure for mounting or positioning the internal components. Housing 12 may contain mechanical or electromechanical components configured to automatically measure, cut, and dispense a desired quantity of a soft good (described in greater detail below). In some embodiments, housing 12 includes one or more internal panels or walls dividing the volume within housing 12 into multiple compartments (e.g., isolated compartments, interconnected compartments, etc.).

Housing 12 may facilitate connecting (e.g., mounting, attaching, etc.) various external and/or user-facing components of dispensing device 10. For example, housing 12 is shown with a user interface 18 mounted on an upper surface of housing 12 and a printer 26 mounted on a front surface of housing 12. In some embodiments, housing 12 includes access panels (e.g., doors, removable panels, etc.) for accessing the internal components of dispensing device 10. Housing 12 may include one or more ports for receiving electrical and/or data connections from external sources.

Still referring to FIGS. 1-2, dispensing device 10 is shown to include a loading zone 14. Loading zone 14 may be configured to receive a supply of a soft good. For example, a user (e.g., a customer at a retail store, store personnel, etc.) can place a bolt, roll, spool, or other relatively large quantity of a soft good into loading zone 14. In other embodiments, loading zone 14 may receive a feed of a soft good from a supply external to dispensing device 10. Loading zone 14 may be configured to receive soft goods having various widths. Advantageously, loading zone 14 may be configured to receive a soft good supply in multiple different orientations orientation. For example, a bolt of fabric can be loaded into loading zone 14 with the free end of the fabric on the top or bottom of the bolt. In some embodiments, loading zone 14 includes scanners 28 located on one or more sides of loading zone 14 (e.g., the left side and/or the right side) for reading a bar code or other machine-readable image affixed to a side of the soft good supply.

In some embodiments, loading zone 14 facilitates rotation of the soft good supply contained therein. For example, loading zone 14 may include a sloped or curved support surface configured to cause rotation of the soft good supply. As the soft good supply rotates within loading zone 14, the soft good may unwind or unwrap from the soft good supply. In some embodiments, loading zone 14 is configured to maintain the soft good supply in a dispensing position. For example, loading zone 14 may secure the soft good supply in a rotatable position such that the soft good can unwind or unwrap therefrom while preventing the soft good supply from slipping, sliding, or otherwise moving or rotating in an undesirable direction. In some embodiments, loading zone 14 is configured to allow the soft good supply to rotate about one axis of rotation (e.g., a horizontal axis extending between scanners 28) while preventing rotation about other axes and/or while preventing substantial horizontal or vertical translation.

Loading zone 14 can be accessed via a loading zone door 20. Loading zone door 20 may be configured to move between a closed position (shown in FIG. 1) and an open position (shown in FIG. 2). In some embodiments, loading zone door 20 is a roll top door or sliding panel configured to slide along curved surface 24 between the open position and the closed position. In other embodiments, loading zone door 20 may be hingedly connected to housing 12. In the open position, loading zone door 20 permits access to loading zone 14 for loading or unloading a soft good supply. In the closed position, loading zone door 20 prevents access to loading zone 14 (e.g., while dispensing a soft good or other operation of dispensing device 10).

Still referring to FIGS. 1-2, dispensing device 10 is shown to include a dispensing zone 16. Dispensing zone 16 may be a compartment within housing 12 into which a desired quantity of the soft good is deposited for user access (e.g., when dispensing is completed). Dispensing device 10 may automatically measure, cut, and provide the desired quantity of the soft good to dispensing zone 16. Upon completion of the dispensing process, a user can retrieve the desired quantity of the soft good from dispensing zone 16.

Dispensing zone 16 can be accessed via a dispensing zone door 22. Dispensing zone door 22 may be configured to move between a closed position (shown in FIG. 1) and an open position (shown in FIG. 2). In some embodiments, dispensing zone door 22 is sliding panel configured to slide into housing 12 to provide access to dispensing zone 16. In other embodiments, dispensing zone door 22 may be hingedly connected to housing 12. In the open position, dispensing zone door 22 permits access to dispensing zone 16 for retrieving the desired quantity of the soft good. In the closed position, dispensing zone door 22 prevents access to dispensing zone 16 (e.g., while dispensing a soft good or other operation of dispensing device 10).

In some embodiments, dispensing device 10 is configured to dispense a soft good only when loading zone door 20 and/or dispensing zone door 22 are closed, thereby ensuring user safety throughout the dispensing process. Dispensing device 10 may include one or more sensors (e.g., optical sensors, magnetic sensors, etc.) configured to detect the position of loading zone door 20 and/or dispensing zone door 22. For example, the sensors may detect whether doors 20 and 22 are in the open position, the closed position, and/or an intermediate position between the open and closed positions.

Still referring to FIGS. 1-2, dispensing device 10 is shown to include a user interface 18. User interface 18 may include an electronic display and/or other user interface devices (e.g., a keyboard, a button panel, etc.) for presenting information to a user and receiving inputs from a user during operation of dispensing device 10. The display may be an LCD display, TFT display, LED display, CRT display, or any other suitable technology for an electronic display. In some embodiments, user interface 18 includes a touch-sensitive display that can generate signals when certain areas of the display are touched by a user. In some embodiments, user interface 18 is attached to dispensing device 10 (e.g., embedded into housing 12, attached via a coupling bracket 30, etc.). In other embodiments, user interface 18 may be placed in a variety of other locations as may be convenient in various implementations (e.g., on a control panel separate from dispensing device 10, etc.).

User interface 18 may display a price, description, quantity, total amount, product details, or other data related to a particular soft good selected for dispensing by a user. In some implementations, the data displayed via user interface 18 include information related to the user. The user information may be based upon the purchasing history of the user or other useful information related to the user (e.g. suggested quantities, complementary products, etc.). For example, user interface 18 may provide a coupon to the user based on the frequency of the user's purchasing. In some embodiments, dispensing device 10 is configured to receive user-specific information by accessing a database.

User interface 18 may be configured to receive user input. For example, a user may input item information such as a desired quantity of the soft good to be dispensed (e.g., a desired length or area). In some embodiments, user interface 18 may prompt a user to enter an item identifier (e.g., UPC, product number, etc.). In other embodiments, scanners 28 automatically scan a barcode or other machine-readable image affixed to the soft good supply such that manually entering product information is unnecessary.

In some implementations, a user may indicate the preferred method of payment (e.g., cash, credit card, debit card, gift card, etc.) via user interface 18. For example, the user may touch an icon on a touch-sensitive display or press a corresponding button to indicate the preferred method of payment. User interface 18 may be configured to prompt the user for a signature and receive a signature from the user (e.g., if a purchase is made via a credit card or other form of payment that requires a signature). User interface 18 may include a card reader 32 for reading a credit card or other type of card (e.g., a store membership card, an employee ID card, an RFID card, etc.).

User interface 18 may present visual data (e.g., video data, image data, etc.) as well as other types of data (e.g., sound data) to the user. User interface 18 may communicate with a controller, described in greater detail below. Exemplary user interfaces that can be presented via user interface 18 are described in greater detail with reference to FIGS. 13-30 and 32-39.

Figure 3:
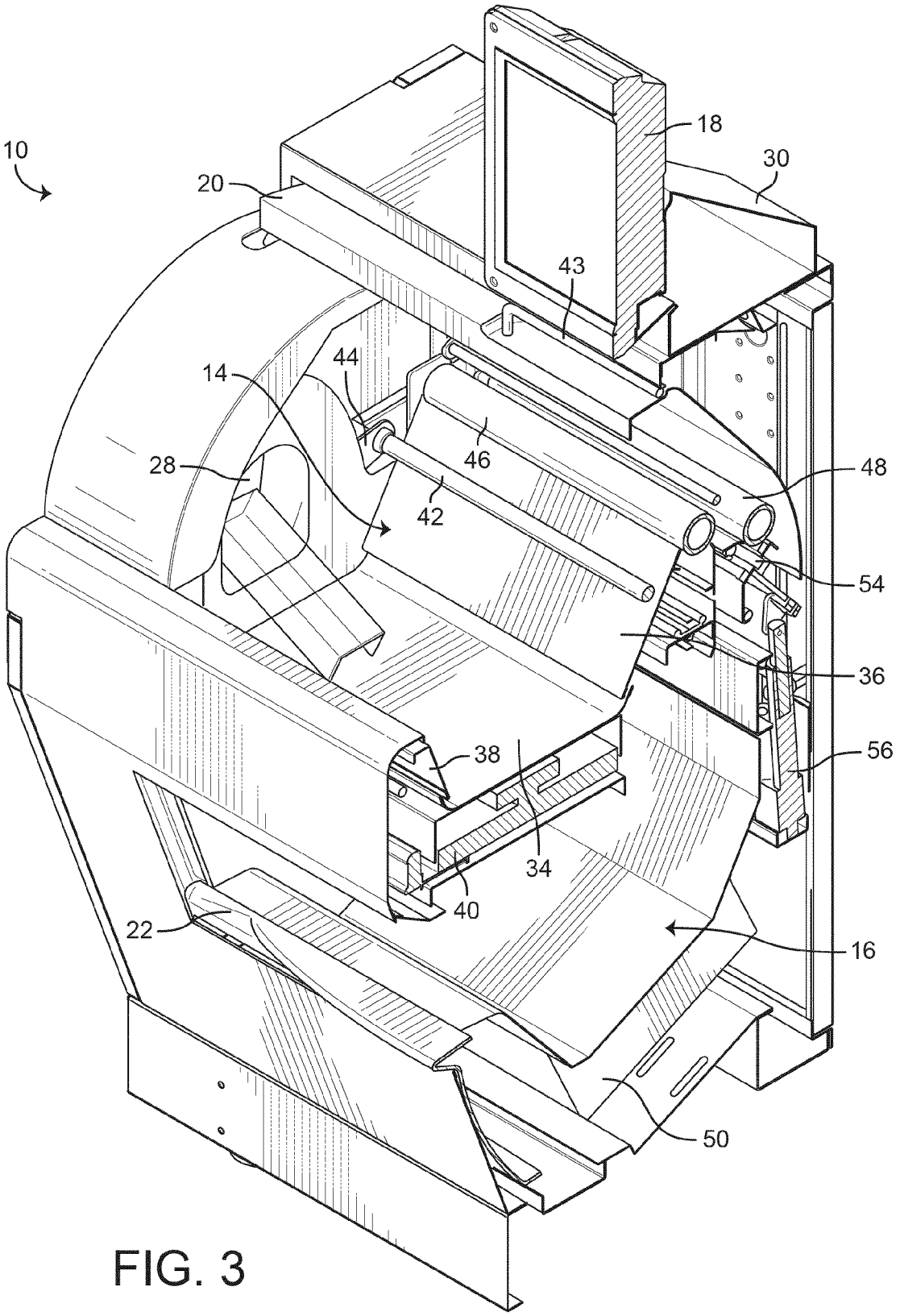
FIG. 3 is a cross-sectional perspective view of the soft good dispensing device of FIG. 1 with the loading zone door and the dispensing zone door in the open position, according to an exemplary embodiment.
Figure 4:
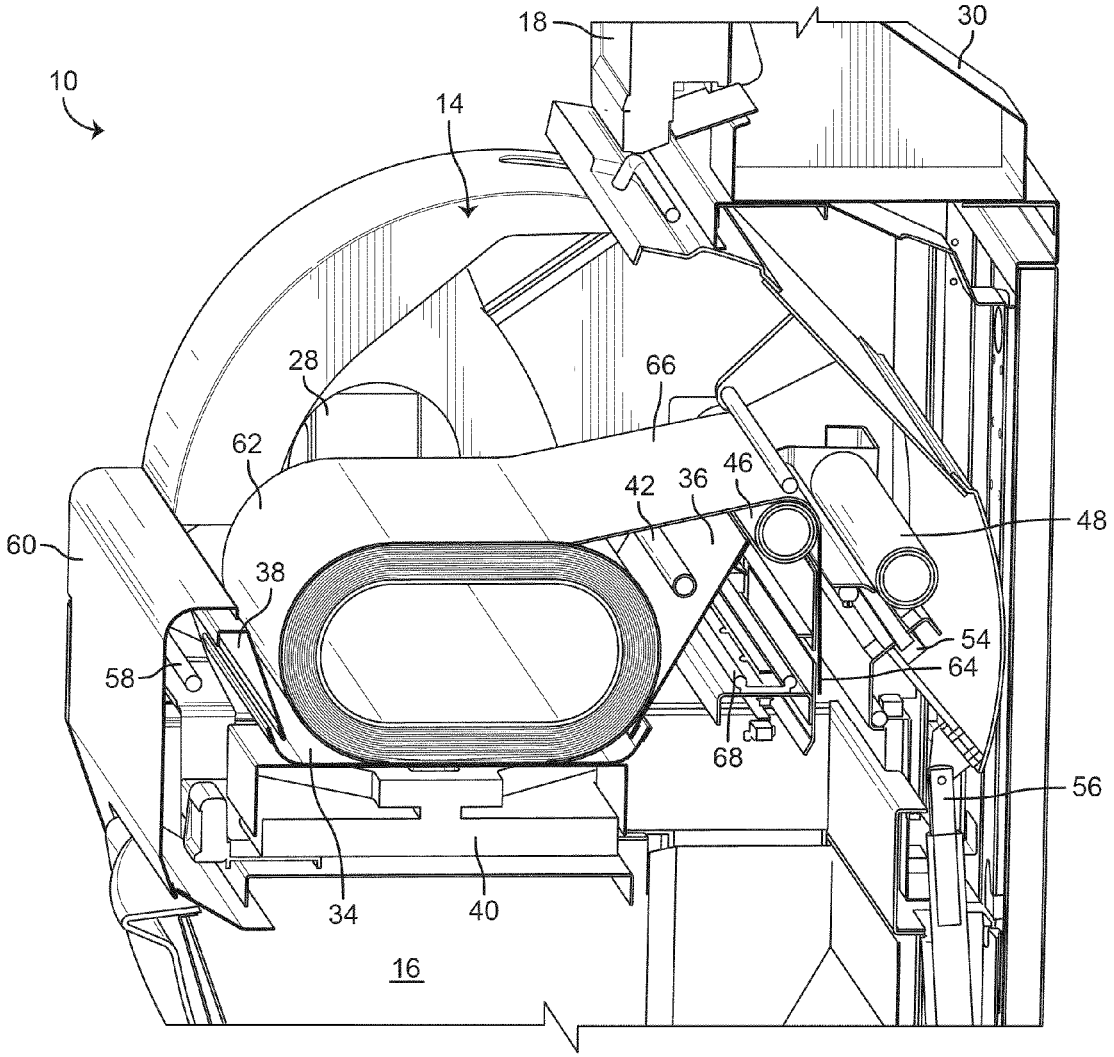
FIG. 4 is a cross-sectional perspective view of the soft good dispensing device of FIG. 1 with the loading zone door and the dispensing zone door in the open position and a soft good supply placed in the loading zone, according to an exemplary embodiment.
Figure 5:
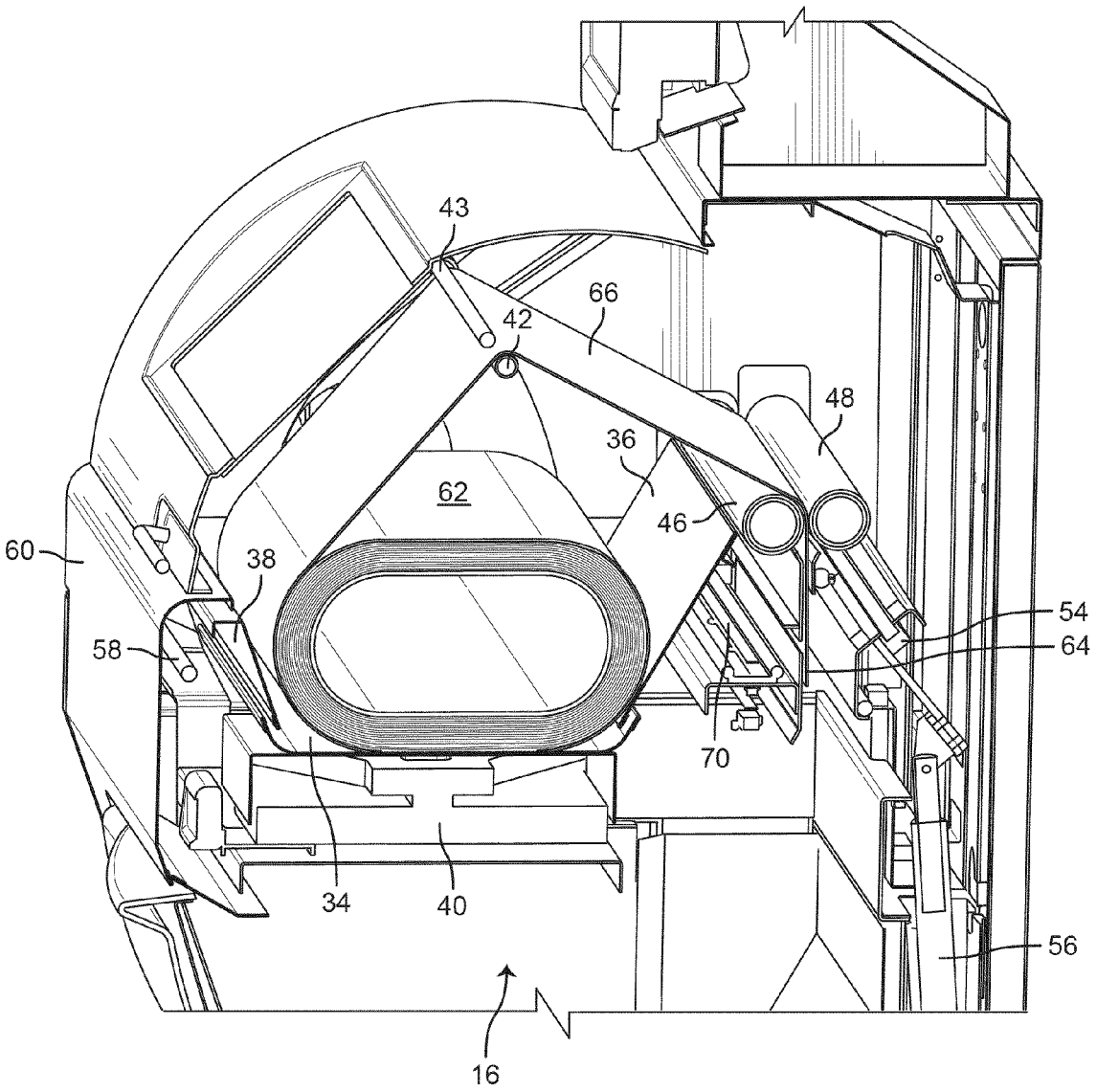
FIG. 5 is a cross-sectional perspective view of the soft good dispensing device of FIG. 1 with the loading zone door and the dispensing zone door in the closed position and the soft good supply placed in the loading zone, according to an exemplary embodiment.

Referring now to FIGS. 3-5, a cross-section of soft good dispensing device 10 is shown, according to an exemplary embodiment. Referring particularly to FIG. 3, loading zone 14 is shown to include a bottom surface 34, a rear surface 36, and a front surface 38. Rear surface 36 and front surface 38 may be sloped or angled relative to bottom surface 34 to maintain the soft good supply within loading zone 14. Rear surface 36 and front surface 38 may be fixed to housing 12 and maintained in a fixed position. In some embodiments, bottom surface 34 is physically separate from rear surface 36 and/or front surface 38 (e.g., separate components) such that bottom surface 34 can move independent from rear surface 36 and front surface 38. In other embodiments, bottom surface 34 may be attached to rear surface 36 and/or front surface 38 and surfaces 34-38 may be movable relative to housing 12 (e.g., rear surface 36 and front surface 38 may not be fixed to housing 12).

Still referring to FIG. 3, dispensing device 10 is shown to include a scale 40 for measuring the weight of a soft good in loading zone 14. In some embodiments, scale 40 is positioned below bottom surface 34. When a soft good supply is loaded into loading zone 14, the weight of the soft good supply may cause a downward movement or deflection of bottom surface 34. Scale 40 may be configured to measure the movement or deflection of bottom surface 34 to determine the weight of the soft good supply. In some embodiments, scale 40 is integrated with bottom surface 34. For example, bottom surface 34 of loading zone 14 may be a top surface of scale 40.

The weight of the soft good supply in loading zone 14 may be used to determine a total quantity of material on the soft good supply (e.g., total linear distance of material, total area of material, total volume of material, etc.) prior to beginning the cutting process. Dispensing device 10 may be configured to convert the measured weight of the soft good supply into a total quantity of material using a conversion formula, chart, lookup table, or other conversion process. For example, dispensing device 10 may subtract the weight of an empty bolt from the measured weight to determine a total weight of the soft good in loading zone 14. Dispensing device 10 may divide the total weight of the soft good by various metrics (e.g., material density, weight per unit area, weight per unit length, etc.) to determine the total quantity of material available in the soft good supply. The various metrics may be material properties specific to the particular soft good in loading zone 14. Material-specific properties may be retrieved from a data storage device based on the identity of the material loaded into loading zone 14. The identity of the material in loading zone 14 can be determined automatically (e.g., by scanners 28 reading a barcode on the soft good supply) or manually (e.g., by inputting product information via user interface 18).

Referring particularly to FIGS. 4-5, dispensing device 10 is shown with a bolt 62 in loading zone 14. Bolt 62 may be a bolt, spool, roll, reel, or other relatively large quantity of a soft good 66. Bolt 62 can be loaded into loading zone 14 in multiple different orientations. For example, bolt 62 can be oriented such that soft good 66 winds in a clockwise direction or in a counterclockwise direction around bolt 62 (from the side perspective shown in FIGS. 4-5). The free end 64 of soft good 66 may wrap around the top or bottom of bolt 62. Scanners 28 may be positioned at either or both sides of loading zone 14 to automatically read a bar code or other machine-readable image affixed to a side of bolt 62.

In some embodiments, dispensing device 10 includes a roller 43 attached to an interior surface of loading zone door 20. When loading zone door 20 is in the open position shown in FIG. 4, roller 43 may be located in close proximity (e.g., directly above) roller 46. Upon placing bolt 62 into loading zone 14, free end 64 may be fed through a space between roller 43 and roller 46 (as shown in FIG. 4). In some embodiments, user interface 18 provides instructions for feeding free end 64 between rollers 43 and 46.

Still referring to FIGS. 4-5, dispensing device 10 is shown to include a lift bar 42 and a lift arm 44. Lift bar 42 may be attached to lift arm 44 at one end of lift bar 42 (e.g., the left end of lift bar 42 when viewed from the front of dispensing device 10) and to another lift arm (not shown) at the other end of lift bar 42 (e.g., the right end of lift bar 42). Lift bar 42 and lift arm 44 may be configured to pivot about an axle 58 defining a horizontal axis of rotation near a front surface 60 of dispensing device 10. Pivoting lift bar 42 and lift arm 44 about axle 58 may cause lift bar 42 to move between a lowered position (shown in FIG. 4) and a raised position (shown in FIG. 5).

Lift bar 42 causes an unwound portion of soft good 66 to be directed upward from bolt 62, over lift bar 42, and then toward rollers 46 and 48. Advantageously, the initial upward deflection of soft good 66 facilitates unwinding soft good 66 from bolt 62 regardless of the orientation of bolt 62 in loading zone 14. When lift bar 42 is raised, the unwound portion of soft good 66 approaches rollers 46 and 48 from a uniform position (i.e., the raised position of lift bar 42), regardless of the orientation of bolt 62.

Still referring to FIGS. 4-5, dispensing device 10 is shown to include rollers 46 and 48. Rollers 46 and 48 are configured to receive an unwound portion of soft good 66 from lift bar 42. In some embodiments, roller 46 is a fixed position roller and roller 48 is a variable position roller. For example, roller 48 may be configured to move between an unclamped position (shown in FIG. 4) and a clamped position (shown in FIG. 5). In various embodiments, roller 48 may be moved between the unclamped position and the clamped position by an actuator or may be mechanically coupled to the position of loading zone door 20. The actuator may cause roller 48 to move into the clamped position in response to loading zone door 20 being moved into the closed position. For example, a controller 50 (shown in FIG. 3) may receive an input from a door position sensor indicating that loading zone door 20 is closed and may cause roller 48 to move into the clamped position in response to the input.

In the clamped position shown in FIG. 5, rollers 46 and 48 rotate in opposite directions such that the rotation of rollers 46 and 48 causes free end 64 to be pulled through a space between rollers 46 and 48. The rotation of rollers 46 and 48 may be driven by a motor (e.g., motor 52 shown in FIG. 6). In some embodiments, controller 50 operates motor 52 to control the rotation of rollers 46 and 48. Controller 50 may rotate rollers 46 and 48 which causes soft good 66 to be controllably unwound from bolt 62 until the desired quantity of soft good 66 has been unwound. Upon unwinding the desired quantity of soft good 66, controller 50 causes a cutting mechanism 70 to travel along path 68 and to separate the desired quantity of soft good 66 from bolt 62 (described in greater detail with reference to FIGS. 10-11). The desired quantity of soft good 66 drops into dispensing zone 16 for user retrieval via dispensing zone door 22.

Still referring to FIGS. 4-5, dispensing device 10 is shown to include a clamp 54. Clamp 54 may be configured to move between an unclamped position (shown in FIG. 4) and a clamped position (shown in FIG. 5). In some embodiments, clamp 54 is moved between the clamped position and the unclamped position by an actuator 56, which is controlled by controller 50. Controller 50 may cause actuator 56 to move clamp 54 into the clamped position in response to a determination that the desired quantity of soft good 66 has been unwound from bolt 62. Clamp 54 may hold the unwound portion of soft good 66 in a fixed position to allow cutting mechanism 70 to separate the desired quantity of soft good 66 from bolt 62. Clamp 54 may move into the unclamped position once cutting mechanism 70 has completed its cut to allow the desired quantity of soft good 66 to drop into dispensing zone 16.

Figure 6:
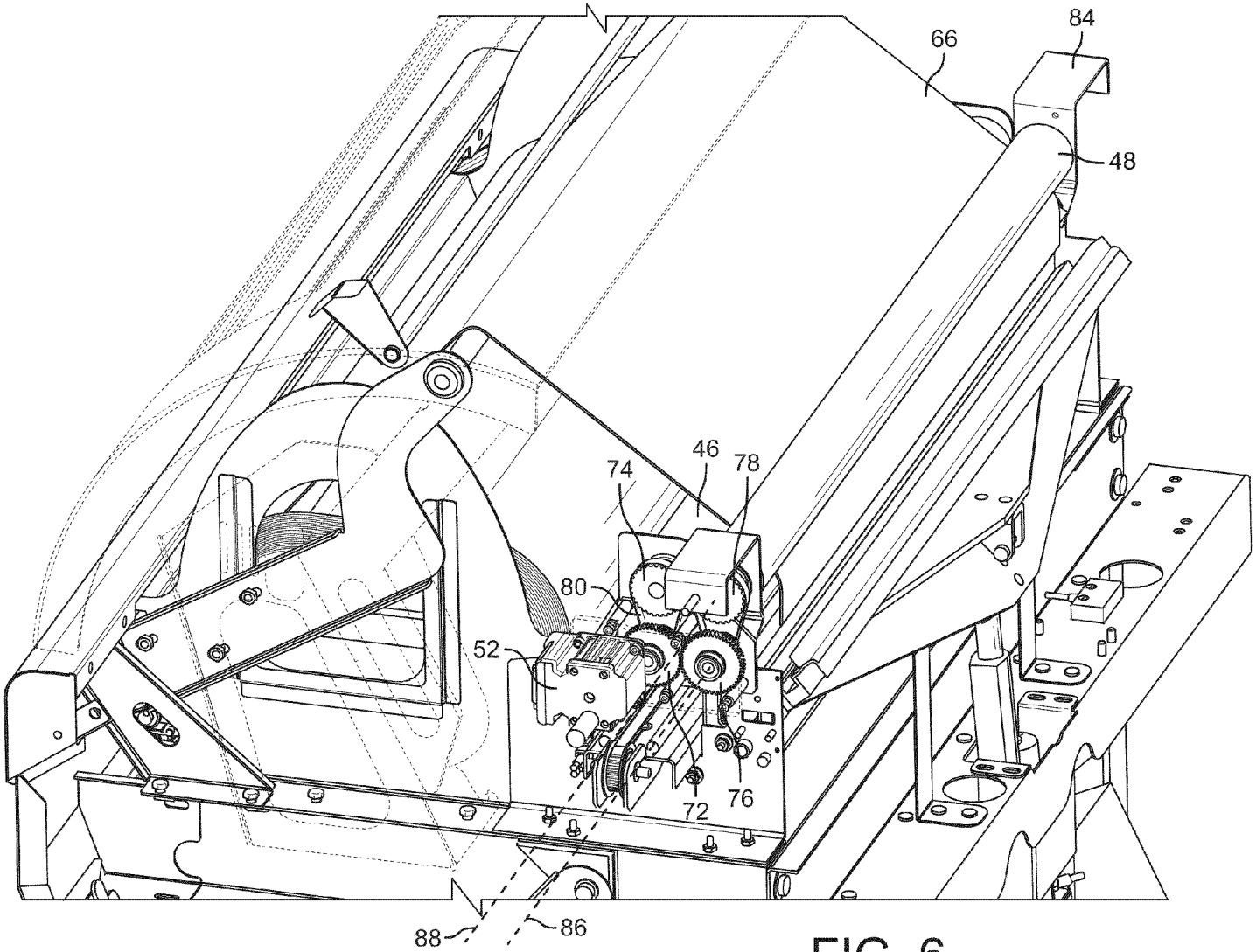
FIG. 6 is a rear perspective view of the soft good dispensing device of FIG. 1 with a portion of an external housing removed to illustrate a dispensing mechanism for dispensing a desired quantity of the soft good, according to an exemplary embodiment.

Referring now to FIG. 6, a rear perspective view of soft good dispensing device 10 is shown, according to an exemplary embodiment. In FIG. 6, dispensing device 10 is shown with housing 12 removed such that the various internal components of dispensing device 10 can be seen more easily. Dispensing device 10 is shown to include a motor 52. In some embodiments, motor 52 is a smart motor driven by a servo with PLC control. Motor 52 may communicate with controller 50 and may be controlled by a control signal received from controller 50. In some embodiments, motor 52 reports operating information to controller 50. For example, motor 52 may report rotation data (e.g., degrees of rotation) to controller 50. Controller 50 may use the rotation data from motor 52 to determine an amount of soft good 66 that has been fed through rollers 46-48 (e.g., based on the circumference of rollers 46 and 48, the gear ratio of gears 72-78, etc.).

Motor 52 may be rotatably coupled to rollers 46 and 48 via gears 72-78. In some embodiments, gears 72-76 rotate about fixed axles and gear 78 rotates about a variable position axle. For example, gears 72-76 may rotate about axles which are fixedly attached to housing 12. Gear 78 may rotate about an axis 88 which passes through roller 48 and which moves between the clamped position and the unclamped position along with roller 48. In some embodiments, the combined assembly of roller 48, gear 78, and brackets 84 is configured to pivot about an axis 86 coincident with an axis of rotation of gear 76 as roller 48 moves between the clamped position and the unclamped position.

Still referring to FIG. 6, gear 72 may mesh with gear teeth on a rotary portion of motor 52. Gear 72 may be rotatably coupled to gear 74 via a pulley 80 (as shown in FIG. 6) or via gear teeth. Gear 74 may be rotatably fixed to roller 46 such that a rotation of gear 74 causes a corresponding rotation of roller 46. Gear 72 is shown meshing with gear teeth on gear 76, which may be rotatably coupled to gear 78 via a pulley 82 or via gear teeth. Gear 78 may be rotatably fixed to roller 48 such that a rotation of gear 78 causes a corresponding rotation of roller 48. Gears 72-78 and pulleys 80-82 may be arranged to cause rollers 46 and 48 to rotate in opposite directions. The rotation of rollers 46 and 48 causes soft good 66 to be pulled downward between rollers 46 and 48.

Figure 7:
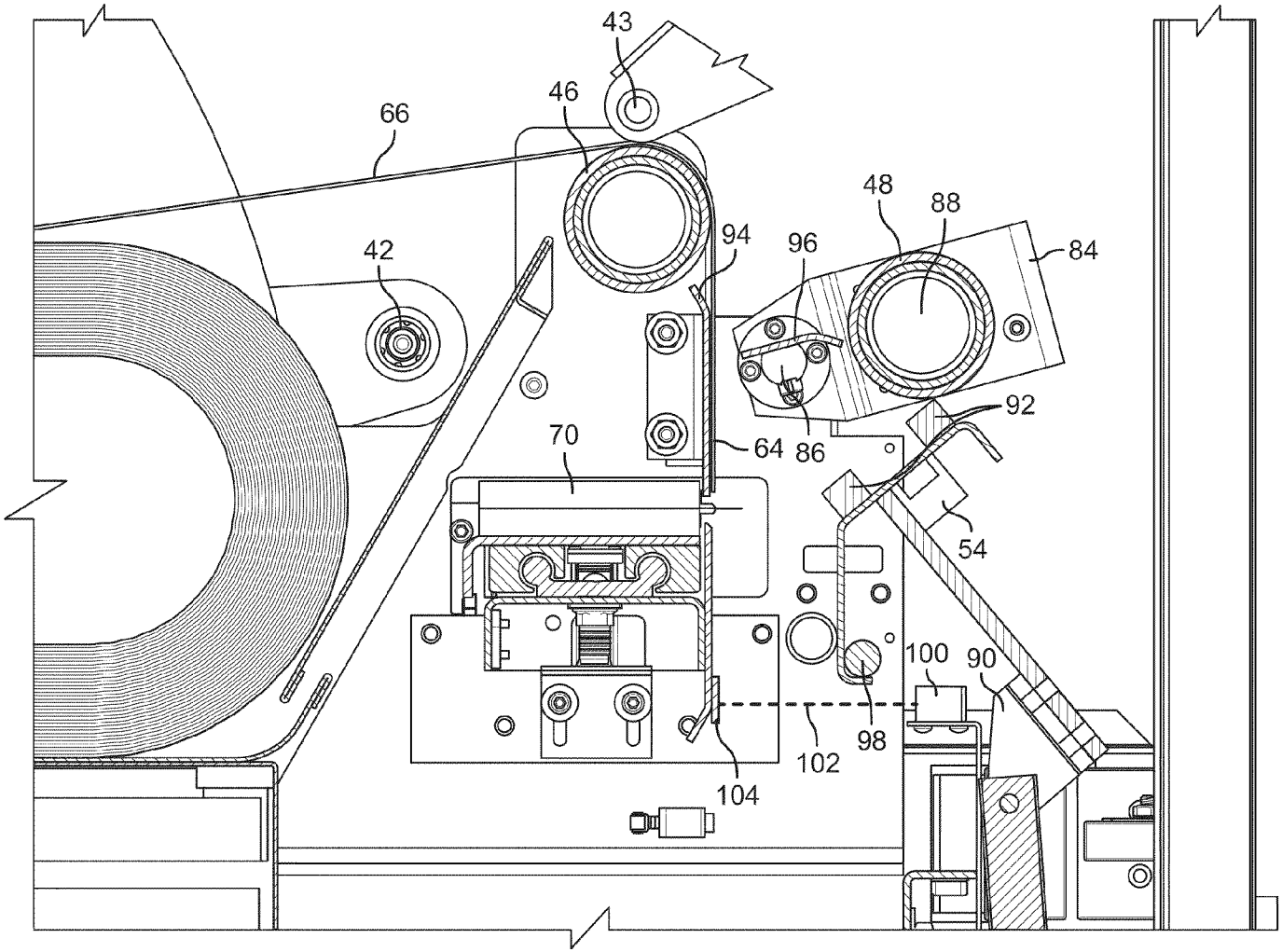
FIG. 7 is a cross-sectional elevation view of the soft good dispensing device of FIG. 1 with the dispensing zone door in the open position and with a clamp roller of the dispensing mechanism and a clamp both in unclamped positions, according to an exemplary embodiment.
Figure 8:
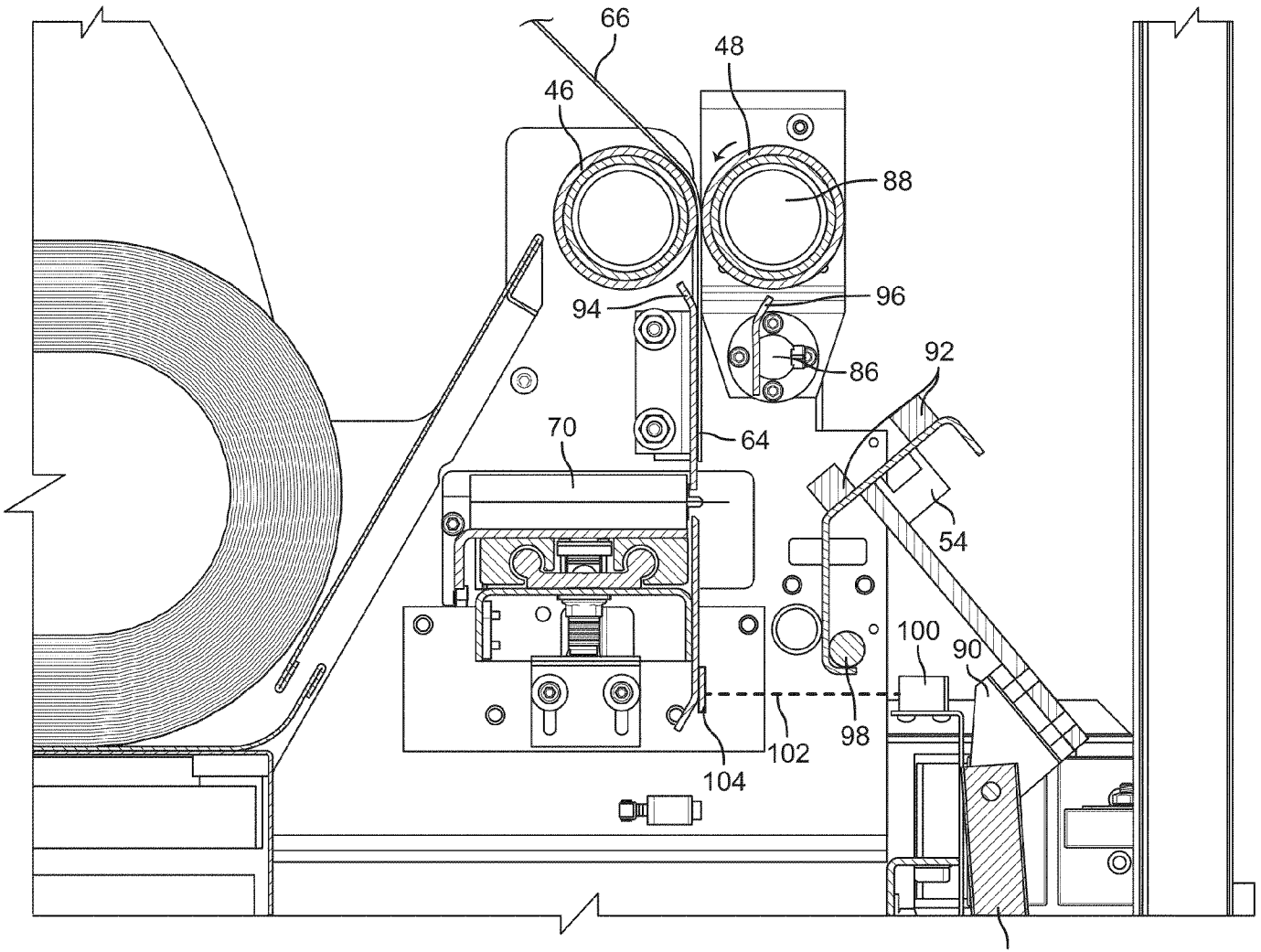
FIG. 8 is a cross-sectional elevation view of the soft good dispensing device of FIG. 1 with the dispensing zone door in the closed position, with the clamp roller of the dispensing mechanism in a clamped position, and with the clamp in an unclamped position, according to an exemplary embodiment.
Figure 9:
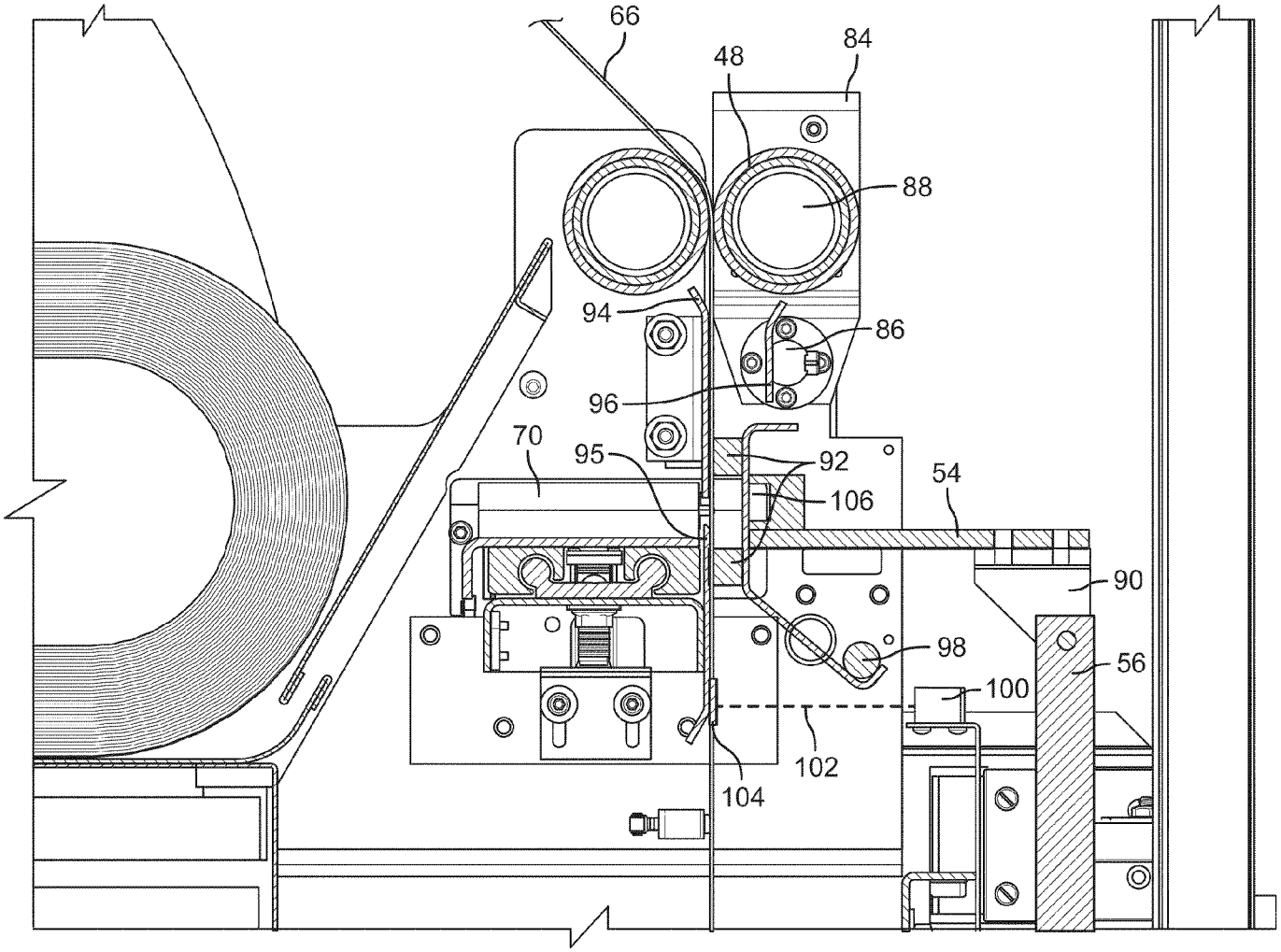
FIG. 9 is a cross-sectional elevation view of the soft good dispensing device of FIG. 1 with the dispensing zone door in the closed position and with the clamp roller of the dispensing mechanism and the clamp both in clamped positions, according to an exemplary embodiment.

Referring now to FIGS. 7-9, a cross-sectional elevation view of dispensing device 10 is shown, according to an exemplary embodiment. Referring specifically to FIG. 7, dispensing device 10 is shown in a loading position. In the loading position, loading zone door 20 in the open position, lift bar 42 is in the lowered position, and both roller 48 and clamp 54 are in the unclamped position. The state of dispensing device 10 in FIG. 7 corresponds to the state of dispensing device 10 in FIG. 4 (i.e., after bolt 62 has been placed in loading zone 14 but before dispensing has started).

As shown in FIG. 7, roller 43 may be positioned directly above roller 46 when loading zone door 20 is in the open position. In the loading position, soft good 66 is shown passing between rollers 43 and 46 with free end 64 of soft good 66 terminating at plate 96. When roller 48 is in the unclamped position, plate 96 may be oriented horizontally or substantially horizontally. Plate 96 may be fixed to bracket 84 such that plate 96 rotates (counterclockwise in FIG. 7) as roller 48 moves from the unclamped position into the clamped position. As roller 48 moves into the clamped position (shown in FIG. 8), plate 96 may rotate into an orientation that is parallel or substantially parallel to plate 94.

Referring specifically to FIG. 8, dispensing device 10 is shown in a dispensing position. In the dispensing position, loading zone door 20 is in the closed position, lift bar 42 is in the raised position, roller 48 is in the clamped position, and clamp 54 is in the unclamped position. The state of dispensing device 10 in FIG. 8 corresponds to the state of dispensing device 10 in FIG. 5 (i.e., after loading zone door 20 has been closed and soft good dispensing has begun).

As shown in FIG. 8, loading zone door 20 is in the closed position and roller 43 is no longer directly above roller 46. Controller 50 may detect when loading zone door 20 moves into the closed position via one or more door position sensors. Controller 50 may cause roller 48 to move into the clamped position in response to a determination that loading zone door 20 is moved into the closed position. In the clamped position, soft good 66 is gripped between rollers 46 and 48. In some embodiments, controller 50 causes lift bar 42 to move into the raised position in response to a determination that loading zone door 20 is moved into the closed position. Lift bar 42 may be raised before or after roller 48 moves into the clamped position. In an exemplary embodiment, controller 50 causes roller 48 to move into the clamped position prior to raising lift bar 42 to ensure that soft good 66 remains between rollers 46 and 48 as lift bar 42 is raised.

In the dispensing position shown in FIG. 8, soft good 66 is shown approaching rollers 46 and 48 from above as a result of the unwound portion of soft good 66 being lifted by lift bar 42. Soft good 66 passes between rollers 46 and 48. As rollers 46-48 rotate, soft good 66 is pulled downward between plates 94 and 96 until the desired quantity of soft good 66 has been dispensed. Controller 50 may be configured to track an amount of soft good 66 that has been dispensed by monitoring a rotational position of rollers 46-48 (e.g., as reported by motor 52).

In some embodiments, dispensing device 10 includes one or more optical devices 100. Optical devices 100 may include an optical emitter and may be positioned to emit light 102 (e.g., infrared light, visible light, ultraviolet light, etc.) toward plate 104. In some embodiments, plate 104 includes a reflector configured to reflect emitted light 102 back toward optical devices 100. Optical devices 100 may include an optical sensor configured to detect emitted light 102 reflected from plate 104. In other embodiments, plate 104 includes an optical sensor configured to detect emitted light 102. As soft good 66 is pulled downward by rollers 46 and 48, soft good 66 blocks emitted light 102 from reaching plate 104. Optical devices 100 may be in communication with controller 50 and configured to provide controller 50 with a signal indicating whether emitted light 102 is detected.

Controller 50 may use the signal from optical devices 100 to determine whether soft good 66 is being unwound from bolt 62. If emitted light 102 is detected, controller 50 may determine that soft good 66 is not blocking emitted light 102 and therefore no soft good is currently being unwound. The significance of the determination made by controller 50 with respect to whether soft good 66 is currently being unwound may vary throughout the dispensing process. For example, if controller 50 does not detect any unwinding of soft good 66 during the dispensing process (e.g., soft good 66 is not detected at all by optical devices 100), controller 50 may determine that soft good 66 has not been properly fed through rollers 46-48. In response to such a determination, controller 50 may cause user interface 18 to display a prompt to re-load or re-feed soft good 66.

If controller 50 initially detects the unwinding of soft good 66 but such unwinding terminates prematurely (e.g., if soft good 66 is detected by optical devices 100 but the detection is lost before the desired quantity of soft good 66 has been dispensed), controller 50 may determine that the dispensing process has ended prematurely. The dispensing process may end prematurely if bolt 62 contains more than one single continuous strip of soft good 66. Multiple strips of soft good 66 on a single bolt 62 may cause soft good 66 to stop unwinding after the first strip has been unwound from bolt 62. In response to a determination that the dispensing process has ended prematurely, controller 50 may cause user interface 18 to display a message that the soft good exists in multiple pieces. User interface 18 may present a user with an option for purchasing the desired quantity of soft good 66 in multiple pieces or restarting the dispensing process to dispense the desired quantity in a single continuous strip.

Referring specifically to FIG. 9, dispensing device 10 is shown in a cutting position. In the cutting position, loading zone door 20 is in the closed position, lift bar 42 is in the raised position, and both roller 48 and clamp 54 are in the clamped position. The state of dispensing device 10 in FIG. 8 may occur after the desired quantity of soft good 66 has been unwound from bolt 62 and is ready to be separated from bolt 62.

As shown in FIG. 9, clamp 54 may be pivotally attached to an actuator 56 via a pivot bracket 90. In other embodiments, clamp 54 may be directly attached to actuator 56. Actuator 56 may be controlled by controller 50 to cause clamp 54 to move from the unclamped position (shown in FIG. 7) to the clamped position (shown in FIG. 8). For example, controller 50 may cause actuator 56 to extend which causes an end 110 of clamp 54 to move in the direction of actuator extension. Another end of clamp 54 may be wrapped around an axle 98. As end 110 is moved by actuator 56, clamp 54 may rotate about axle 98 into the clamped position.

In some embodiments, clamp 54 includes pinch strips 92. Pinch strips 92 may press soft good 66 against plates 94 and 95 as clamp 54 is rotated into the clamped position. Soft good 66 may be held in a fixed position between pinch strips 92 and plates 94-95. In some embodiments, clamp 54 includes a cutting surface 106. Cutting surface 106 may be a strip of polymeric material (e.g., polyethylene) or any other suitable material against which cutting mechanism 70 can provide sufficient cutting force for separating the desired quantity of soft good 66 from bolt 62. In some embodiments, cutting surface 106 is made from a relatively soft material to facilitate improved cutting performance. Cutting surface 106 may be removable from clamp 54 to allow cutting surface 106 to be replaced (e.g., due to degradation caused by performing multiple cuts) without requiring replacement of clamp 54.

Figure 10:
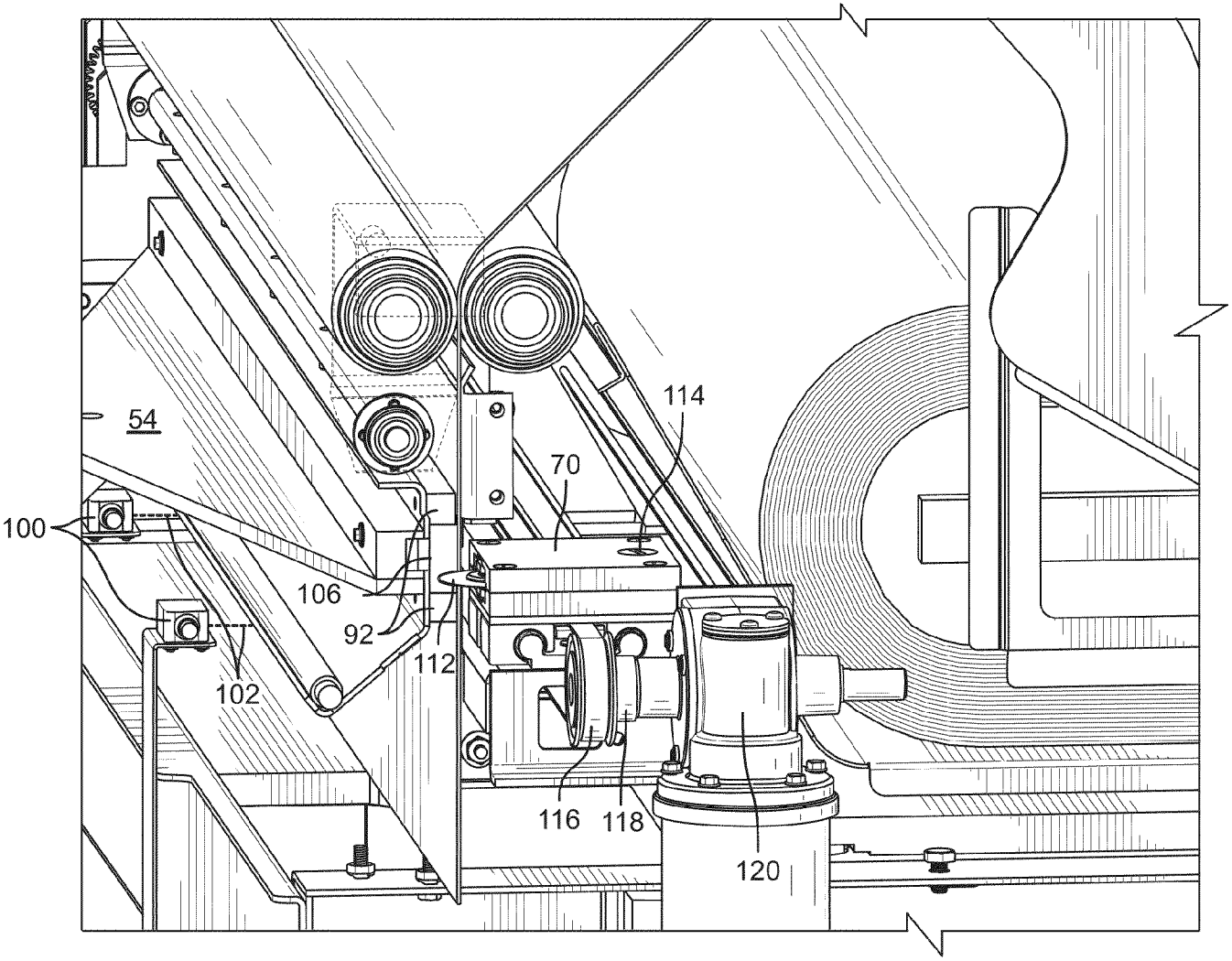
FIG. 10 is rear perspective view of the soft good dispensing device of FIG. 1 with a portion of the housing removed and showing the clamp in the clamped position, according to an exemplary embodiment.
Figure 11:
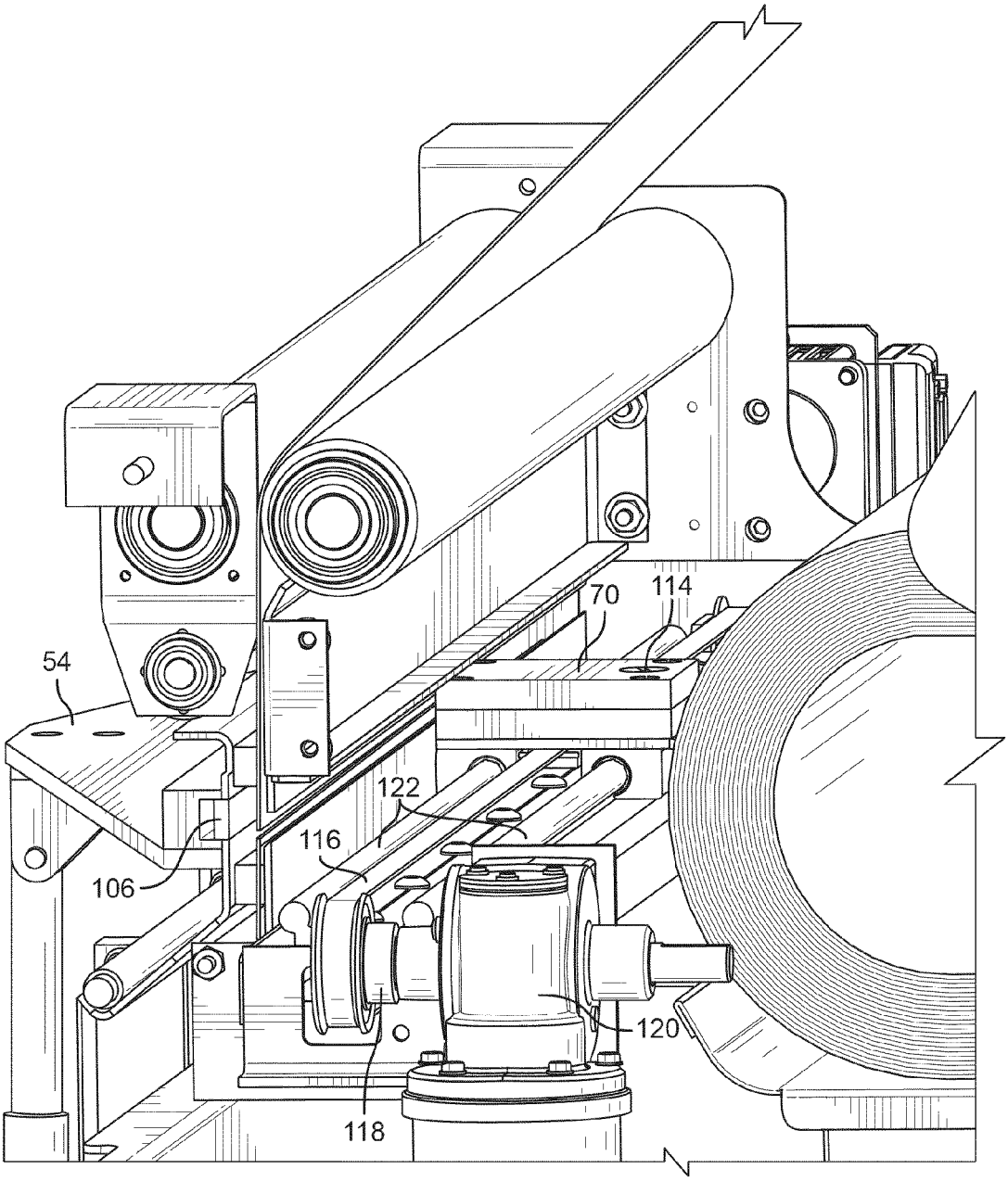
FIG. 11 is a side perspective view of the soft good dispensing device of FIG. 1 with a portion of the housing removed to illustrate a cutting mechanism for separating an unwound portion of the soft good from the soft good supply, according to an exemplary embodiment.

Referring now to FIGS. 10-11, a side perspective view of dispensing device 10 is shown, according to an exemplary embodiment. FIGS. 10-11 illustrate cutting mechanism 70 and the operation thereof in greater detail. Cutting mechanism 70 may be configured to slide along guide rails 122 between a leftmost position and a rightmost position. The position of cutting mechanism 70 may be controlled (e.g., by controller 50) by operating motor 120. For example, controller 50 may operate motor 120 to cause a rotation of rotor 118. In some embodiments, a belt 116 is wrapped around rotor 118 and attached to cutting mechanism 70. Belt 116 may carry cutting mechanism 70 between the leftmost position and rightmost position.

Cutting mechanism 70 is shown to include a rotary cutting blade 112. As cutting mechanism 70 moves along guide rails 122, cutting blade 112 cuts soft good 66 from bolt 62. Cutting blade 112 may be a sharp instrument or other suitable device configured to sever (e.g., separate, detach, remove, cut, etc.) a portion of soft good 66 from bolt 62. In some embodiments, cutting blade 112 is retractable by rotating key 114. Key 114 may be rotated manually (e.g., by a user) or automatically (e.g., by an actuator controlled by controller 50) to retract or extend cutting blade 112 from cutting mechanism 70.

In some embodiments, controller 50 automatically adapts the cutting process based on the identity of the soft good being cut. For example, if the soft good is a relatively thick soft good, controller 50 may cause the cutting operation to be performed more slowly or may penetrate the soft good more deeply when performing the cut (e.g., by extending cutting blade 112). In some embodiments, cutting mechanism 70 is controlled by a control signal received from controller 50. Controller 50 may cause cutting mechanism 70 to perform a cutting operation in response to a determination that the desired quantity of the soft good has been dispensed (e.g., based on the signals received from motor 52).

Cutting mechanism 70 may be configured to cut soft good 66 in either direction (i.e., from right to left or from left to right) as cutting mechanism 70 travels along guide rails 122. Advantageously, the use of a rotary cutting blade 112 facilitates cutting in both directions. In some embodiments, cutting mechanism 70 is configured to automatically stop at each end of guide rails 122 once the cut has been completed. Controller 50 may keep track of the number of cuts that have been performed and provide replacement recommendations for cutting blade 112 and/or cutting surface 106.

Figure 12:
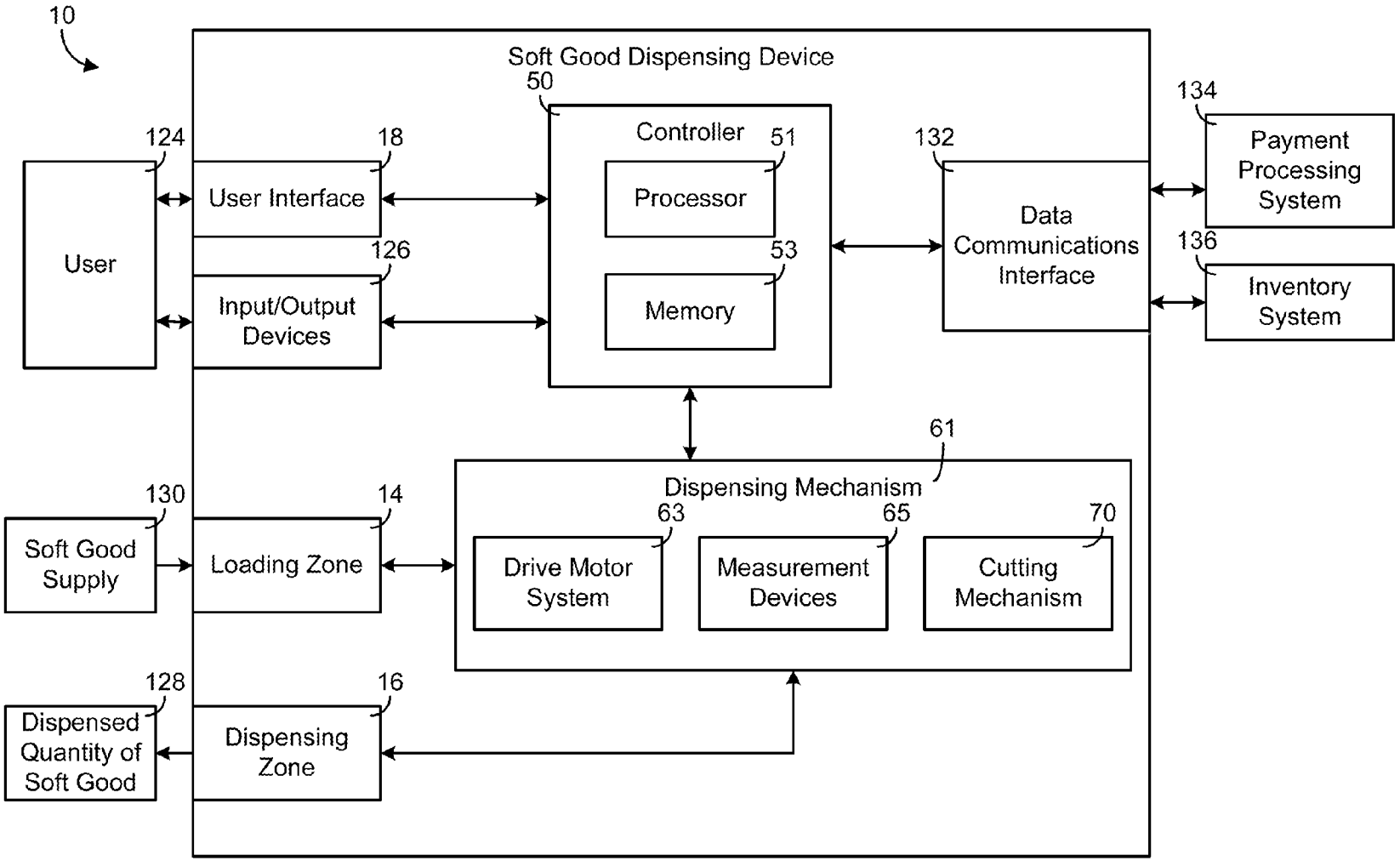
FIG. 12 is a block diagram of the soft good dispensing device of FIG. 1, according to an exemplary embodiment.

Referring now to FIG. 12, a block diagram of dispensing device 10 is shown, according to an exemplary embodiment. Dispensing device 10 is shown to include a user interface 18 and input/output devices 126. User interface 18 may include an electronic display and/or other user interface devices (e.g., a keyboard, a button panel, a speaker, etc.) for presenting information to a user 124, receiving inputs from user 124, or otherwise interfacing with user 124 for operating dispensing device 10. User interface 18 is described in greater detail with reference to FIG. 1.

Input/output devices 126 may include one or more systems or devices configured to facilitate user interaction with dispensing device 10. For example, input/output devices 126 may include a scanner (e.g., scanners 28), camera, or other input device configured to read or store an item code (e.g., a bar code, a UPC, company symbol, alphanumeric character, a QR code, etc.) or another identifier related to the item to be purchased. In some embodiments, input/output devices 126 include a card reader (e.g., card reader 32). Card reader 32 may be configured to read and interpret data from a credit card, debit card, gift card, customer card, RFID card, memory card, or other portable data storage devices. User 124 may use input/output devices 126 to quickly and easily input information without having to manually enter the information via user interface 18.

In some embodiments, input/output devices 126 include a printer (e.g., printer 26) for providing information in a portable format to user 124. Printer 26 may be used to print a label (e.g., a sticker, a bar code, etc.) or other indicia of the type and quantity of soft good dispensed by dispensing device 10 (i.e., dispensed quantity 128). For embodiments in which direct purchase of the dispensed quantity 128 is not performed directly by dispensing device 10, the output of printer 26 may be attached to dispensed quantity 128 (e.g., by a user, by dispensing device 10, etc.) for subsequent check-out and purchase at a different location or time.

Still referring to FIG. 12, dispensing device 10 is shown to include a data communications interface 132. Communications interface 132 may include wired or wireless interfaces (e.g., jacks, antennas, transmitters, receivers, transceivers, wire terminals, etc.) for conducting electronic data communications with external systems, devices, or data sources. In some embodiments, data communications interface 132 may be used to communicate with a payment processing system 134 (e.g., a credit card processing system, a bank, an ATM network, a local store network, etc.) to allow a user to pay for the dispensed quantity 128 of the soft good directly at dispensing device 10.

In some embodiments, data communications interface 132 may be used to communicate with an inventory control system 136 to track and/or update the remaining quantity of soft good supply 130 in an inventory database. For example, dispensing device 10 may subtract the dispensed quantity 128 from a previously-recorded quantity in the inventory database upon completion of the dispensing process. In some embodiments, dispensing device 10 automatically initiates a reordering process or provides a notification to store personnel when a predetermined minimum quantity of soft good supply 130 is reached.

Data communications interface 132 may conduct electronic data communications via a direct connection (e.g., a wired connection, an ad-hoc wireless connection, etc.) or a network connection (e.g., an Internet connection, a LAN, WAN, or WLAN connection, etc.). For example, data communications interface 132 can include an Ethernet card and port for sending and receiving data via an Ethernet-based communications link or network. In various embodiments, data communications interface 132 may include a WiFi transceiver, a cellular transceiver, or a mobile phone transceiver for communicating via a wireless communications network. In some embodiments, dispensing device 10 may be one of a plurality of networked dispensing devices.

Data communications interface 132 may be used to monitor the performance of dispensing device 10. For example, dispensing device 10 may collect usage data such as the number of dispensing operations (i.e., cuts) performed, the quantity and type of soft good dispensed, user identifiers associated with each dispensing process, or other data relating to the operation of dispensing device 10. Data communications interface 132 may be used to report the usage data and other types of performance data (e.g., diagnostic data, fault detection data, performance metrics, etc.) to one or more remote systems or devices. In some embodiments, a user (e.g., a retailer) can interact with dispensing device 10 remotely via data communications interface 132 to collect usage data and/or otherwise monitor the performance of dispensing device 10 and other networked dispensing devices. In some embodiments, system updates (e.g., firmware updates, operating software updates, soft good attributes, user interface enhancements, etc.) can be downloaded remotely via data communications interface 132.

Still referring to FIG. 2, dispensing device 10 is shown to include a controller 50 having a processor 51 and memory 53. Processor 51 can be implemented as one or more microprocessors (e.g., CPUs, GPUs, etc.), an application specific integrated circuit (ASIC), one or more field programmable gate arrays (FPGAs), a circuit containing one or more processing components, a group of distributed processing components (e.g., processing components in communication via a data network or bus), circuitry for supporting a microprocessor, or other hardware configured for processing data. Processor 51 may be configured to execute computer code stored in memory 53 to complete and facilitate the activities described herein.

Memory 53 may include one or more devices (e.g., RAM, ROM, solid state memory, hard disk storage, etc.) for storing data and/or computer code. Memory 53 may include volatile memory or non-volatile memory. Memory 53 may include database components, object code components, script components, or any other type of information structure for supporting the various activities and information structures of the present disclosure. According to an exemplary embodiment, memory 53 is communicably connected to processor 51 via a processing circuit and includes computer code for executing (e.g., by processor 51) one or more processes performed by dispensing device 10 or a component thereof.

Controller 50 may communicate with user interface 18, input/output devices 126, data communications interface 132, and dispensing mechanism 61. For example, controller 50 may receive data signals from user interface 18 indicating a desired quantity of a soft good to be dispensed and/or a preferred form of payment. Controller 50 may provide data signals to user interface 18 to provide feedback to user 124 and to present various graphical user interfaces to guide user 124 through an automated dispensing process. Several exemplary user interfaces that can be presented via user interface 18 are described with reference to FIGS. 13-30 and 32-39.

Controller 50 may receive data signals from input/output devices 126 indicating the identity of a soft good loaded in loading zone 14 (e.g., via scanners 28) and/or payment information such as a credit card number or customer account number (e.g., via card reader 32). Controller 50 may provide data signals to input/output devices 126, for example, to print a label or bar code via printer 26. Controller 50 may send and receive data signals via data communications interface 132 to process customer payments (e.g., using payment processing system 134) and/or to check or update product inventory (e.g., using inventory system 136).

Controller 50 may receive data signals from various measurement devices 65 of dispensing mechanism 61. Measurement devices 65 may include, for example, scale 40 for weighing the soft good supply 130 in loading zone 14 and scanners 28 for identifying the soft good supply 130 in loading zone 14. Measurement devices 65 may include position sensors configured to detect the positions of loading zone door 20 and dispensing zone door 22 (e.g., open or closed), lift bar 42 (e.g., raised or lowered), clamp 54 (e.g., clamped or unclamped), and roller 48 (e.g., clamped or unclamped). Measurement devices 65 may include optical sensors 100 configured to detect whether the soft good is currently being fed through rollers 46 and 48, and rotation sensors configured to detect the rotational position of motor 52 and/or rollers 46-48. Measurement devices 65 may include cutting mechanism sensors configured to detect the position of cutting mechanism 70.

Controller 50 may use the data signals from measurement devices 65 to determine a quantity of the soft good that has been unwound from soft good supply 130. By comparing the quantity indicated by measurement devices 65 with the desired quantity received via user interface 18, controller 50 may determine an appropriate control action for drive motor system 63. Drive motor system 63 may include motor 52 gears 72-78, rollers 46-48, and other mechanical or electromechanical components configured to unwind the desired quantity of the soft good from soft good supply 130 and to transport the unwound portion of the soft good through dispensing mechanism 61.

Controller 50 may send data signals to drive motor system 63 and cutting mechanism 70. Data signals sent to drive motor system 63 may include control signals provided to motor 52 to control the amount of soft good dispensed from soft good supply 130. For example, controller 50 may instruct drive motor system 63 to continue dispensing soft good supply 130 until the desired quantity has been dispensed. Data signals sent to cutting mechanism 70 may include a command to perform a cutting operation in response to controller 50 determining that the desired quantity of the soft good has been fed through rollers 46-48.

Figure 13:
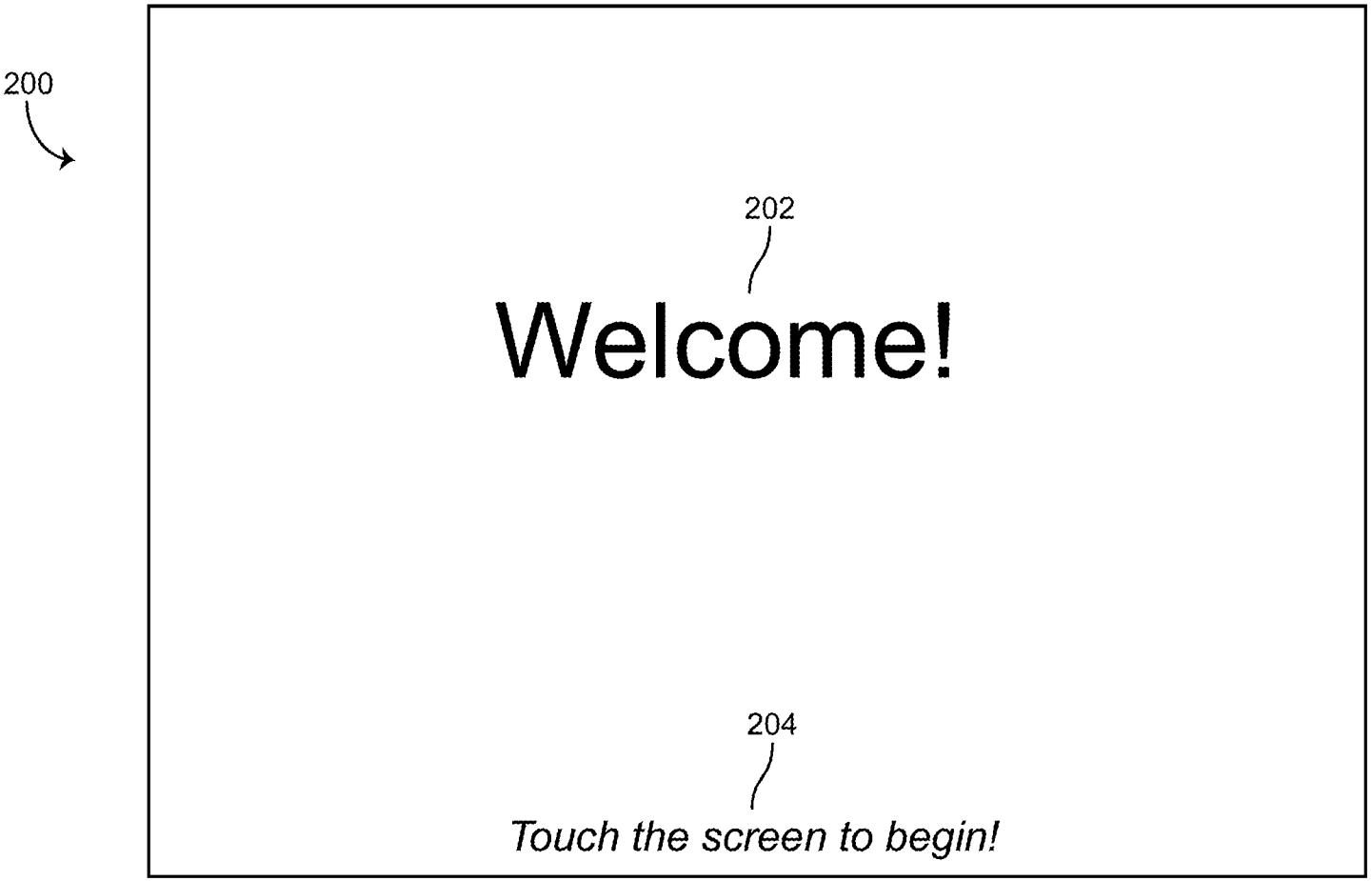
FIG. 13 is a drawing of an "attract loop" user interface that may be displayed via the user interface of the soft good dispensing device of FIG. 1, according to an exemplary embodiment.

Referring now to FIGS. 13-30, several graphical user interfaces 200-370 that may be presented via user interface 18 are shown, according to an exemplary embodiment. Referring specifically to FIG. 13, user interface 200 is a welcome screen. User interface 200 may include an attract loop which displays video files, images, or other media designed to attract and/or engage potential customers. In some embodiments, user interface 200 includes advertisements, marketing, or other promotional media. User interface 200 is shown displaying a welcome message 202 and a prompt 204 to touch the screen to begin.

Figure 14:
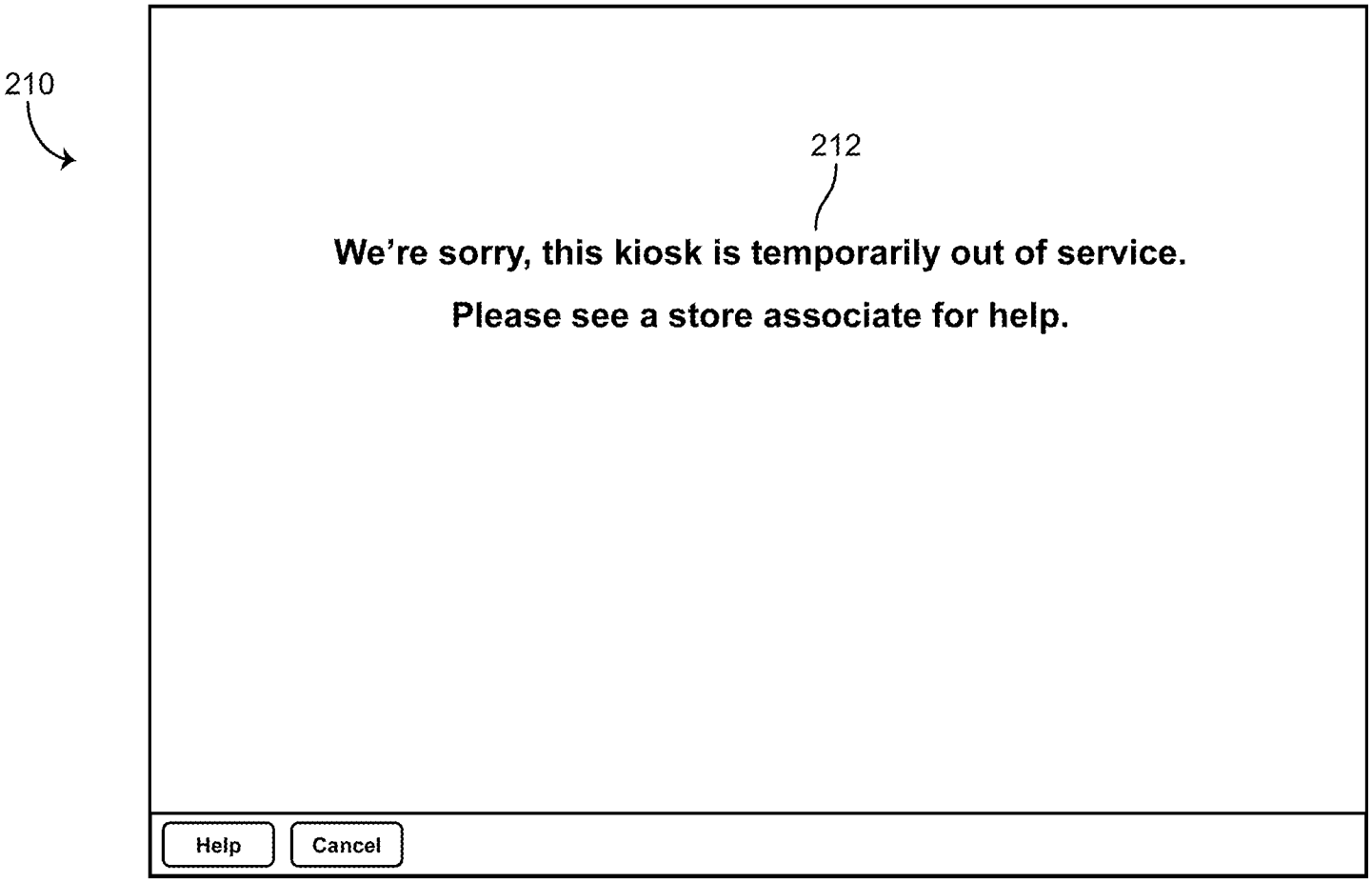
FIG. 14 is a drawing of an "out of service" user interface that may be displayed via the user interface of the soft good dispensing device of FIG. 1, according to an exemplary embodiment.

Referring specifically to FIG. 14, an "out of service" user interface 210 is shown, according to an exemplary embodiment. Upon receiving a touch input via user interface 200, controller 50 may determine whether any critical errors are detected. A critical error may be detected, for example, if any required peripheral not functioning, if printer 26 is out of paper, if printer 26 is not functioning, if scanner 28 not functioning, or if dispensing mechanism 61 is not functioning. If a critical error is detected, user interface 210 may be displayed. User interface 210 is shown to include a message 212 indicating that dispensing device 10 is out of service.

Figure 15:
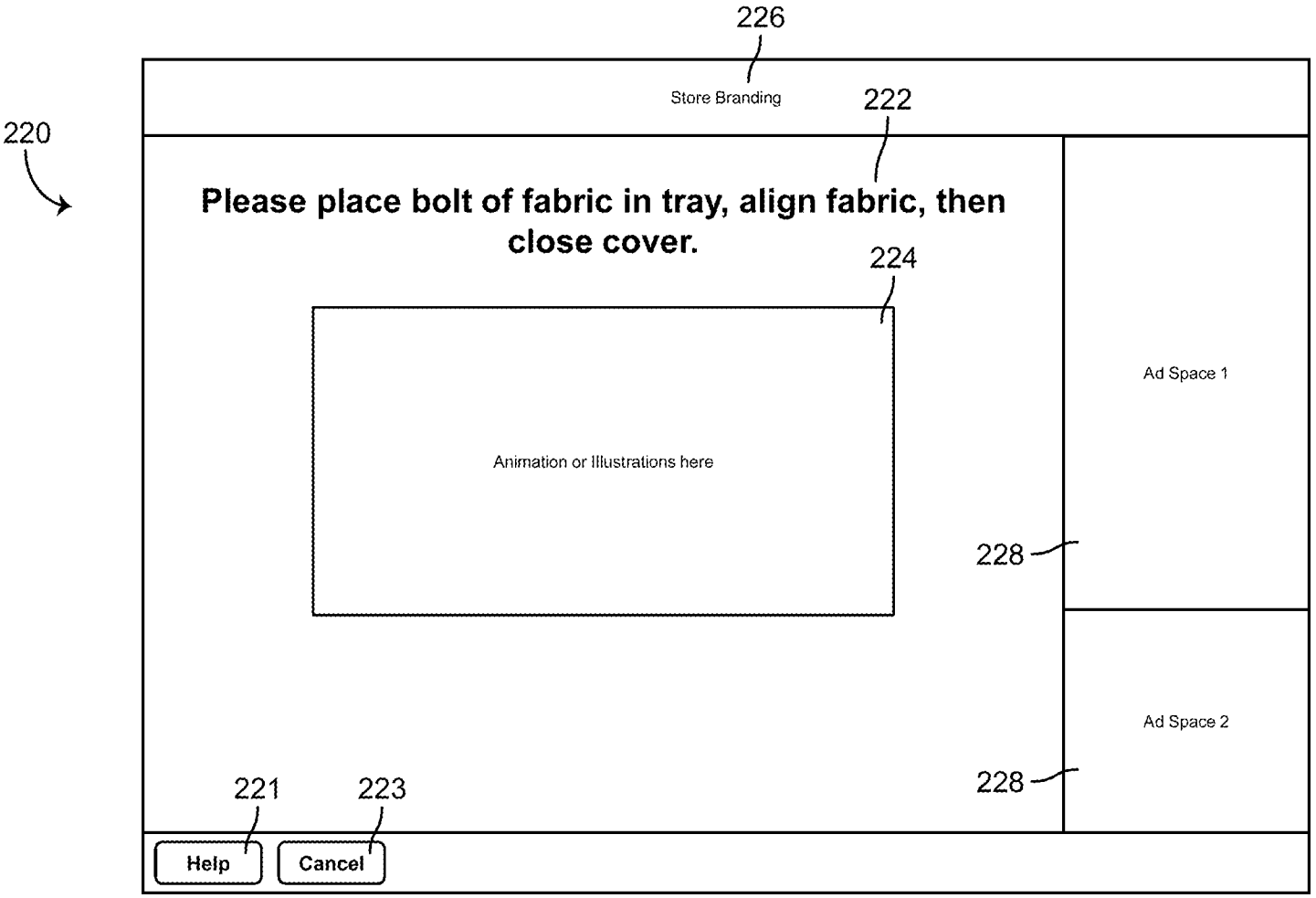
FIG. 15 is a drawing of a "bolt loading" user interface that may be displayed via the user interface of the soft good dispensing device of FIG. 1, according to an exemplary embodiment.

Referring specifically to FIG. 15, a "bolt loading" user interface 220 is shown, according to an exemplary embodiment. User interface 220 may be displayed in response to a determination that no critical errors are detected upon a user touching user interface 200. User interface 220 is shown to include an instruction message 222 prompting a user to place bolt 62 in loading zone 14, to align free end 64, and to close loading zone door 20. In some embodiments, user interface 220 includes an animation or illustration 224 depicting bolt 62 being placed in loading zone 14, the proper alignment of free end 64 (e.g., between rollers 43 and 46), and/or loading zone door 20 being moved into the closed position.

While user interface 220 is displayed, controller 50 may monitor inputs from door position sensors and scanners 28. Inputs from the door position sensors may indicate whether loading zone door 20 is open or closed. Inputs from scanners 28 may include product data (e.g., bar code data, product ID, etc.) obtained from a machine-readable image affixed to bolt 62. If scanners 28 are unable to read the machine-readable image, controller 50 may cause an error message to be displayed (e.g., "scan error"). If scanners 28 successfully read the machine-readable image, controller 50 may compare the scanned product ID with product data stored in inventory system 136. If the scanned product ID is not found in inventory system 136, controller 50 may cause an error message to be displayed (e.g., "item scanned but not found"). If the scanned product ID is found in inventory system 136 and loading zone door 20 is closed, controller 50 may cause user interface 230 to be displayed.

In some embodiments, several of the graphical user interfaces displayed via user interface 18 include store branding information 226 (e.g., a store name, a store logo, etc.), advertisements 228 (e.g., display advertisements, video advertisements, text advertisements, etc.), a help icon 221, and a cancel icon 223. Selecting help icon 221 may cause a help screen to be displayed. Selecting cancel icon 223 may end the current user session and cause user interface 200 (i.e., the welcome screen) to be displayed.

Figure 16:
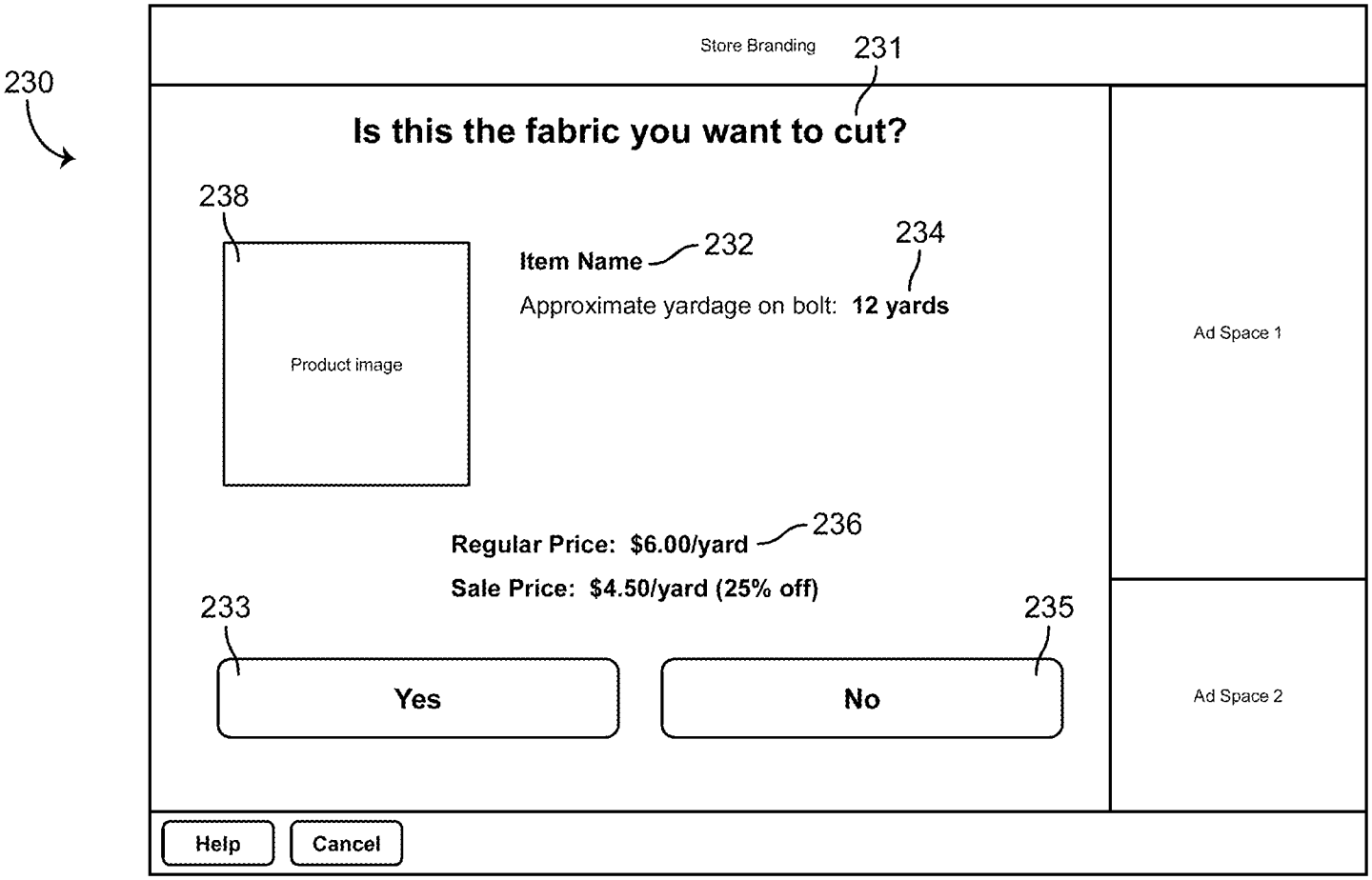
FIG. 16 is a drawing of a "product detail" user interface that may be displayed via the user interface of the soft good dispensing device of FIG. 1, according to an exemplary embodiment.

Referring specifically to FIG. 16, a "product detail" user interface 230 is shown, according to an exemplary embodiment. User interface 230 may be displayed in response to a determination by controller 50 that bolt 62 has been successfully loaded into loading zone 14, the scanned product ID matches an item in inventory system 136, and loading zone door 20 has been closed.

User interface 230 is shown to include an item name 232 indicating the identity of the soft good loaded into loading zone 14 and an estimate 234 of the amount of the soft good remaining on bolt 62. Estimate 234 may be generated by controller 50 using weight data measured by scale 40. For example, scale 40 may measure the weight of the soft good in loading zone 14. Controller 50 may subtract the weight of an empty bolt and divide by the density, thickness, and/or width of the soft good to calculate estimate 234. Product-specific information such as the density, thickness, width, or other properties of the soft good may be determined by accessing inventory system 136 or may be loaded from local memory 53.

User interface 230 is shown to include pricing information 236 and a product image 238. Pricing information 236 includes a price per unit (e.g., dollars per yard) of the soft good. In some embodiments, pricing information 236 includes a regular price and a sale price. Product image 238 may include a photograph or drawing of the soft good loaded into loading zone 14. Pricing information 236 and product image 238 may be retrieved from an external data source (e.g., inventory system 136) or loaded from local memory 53.

User interface 230 is shown to include a prompt 231 asking the user whether the displayed soft good is the soft good that the user wants to cut. The user can select the "yes" icon 233 to confirm the soft good selection or the "no" icon 235 to reject the soft good selection.

Figure 17:
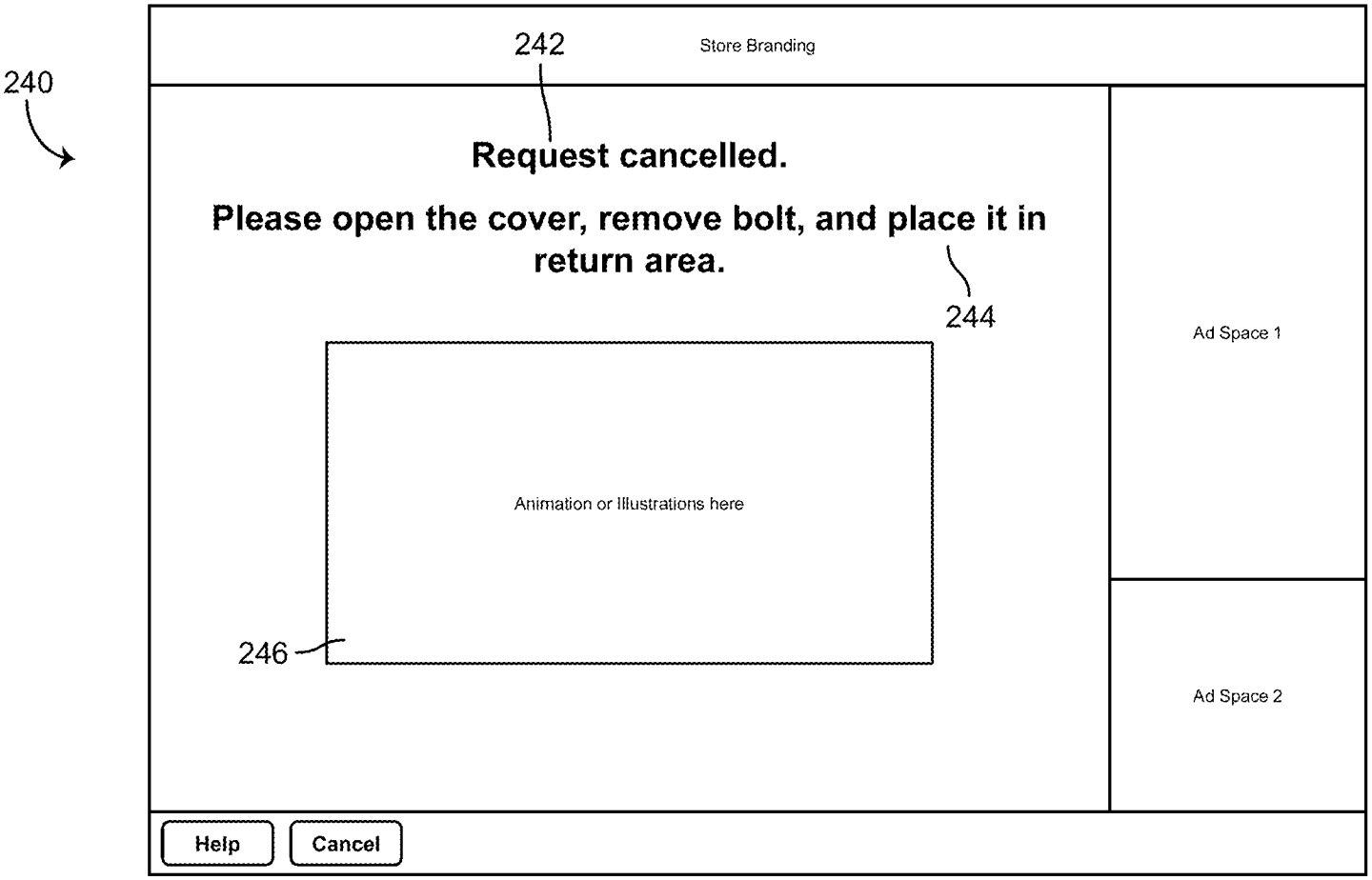
FIG. 17 is a drawing of a "request cancelled" user interface that may be displayed via the user interface of the soft good dispensing device of FIG. 1, according to an exemplary embodiment.

Referring specifically to FIG. 17, a "request cancelled" user interface 240 is shown, according to an exemplary embodiment. User interface 240 may be displayed in response to a user selecting the "no" icon 235 via user interface 230. User interface 240 is shown to include a message 242 indicating that the request has been cancelled and an instruction 244. Instruction 244 may prompt the user to open loading zone door 20, remove bolt 62, and place bolt 62 in a return area. In some embodiments, user interface 240 includes an animation or illustration 246 depicting loading zone door 20 being opened, bolt 62 being removed from loading zone 14, and/or bolt 62 being placed in the return area.

Figure 18:
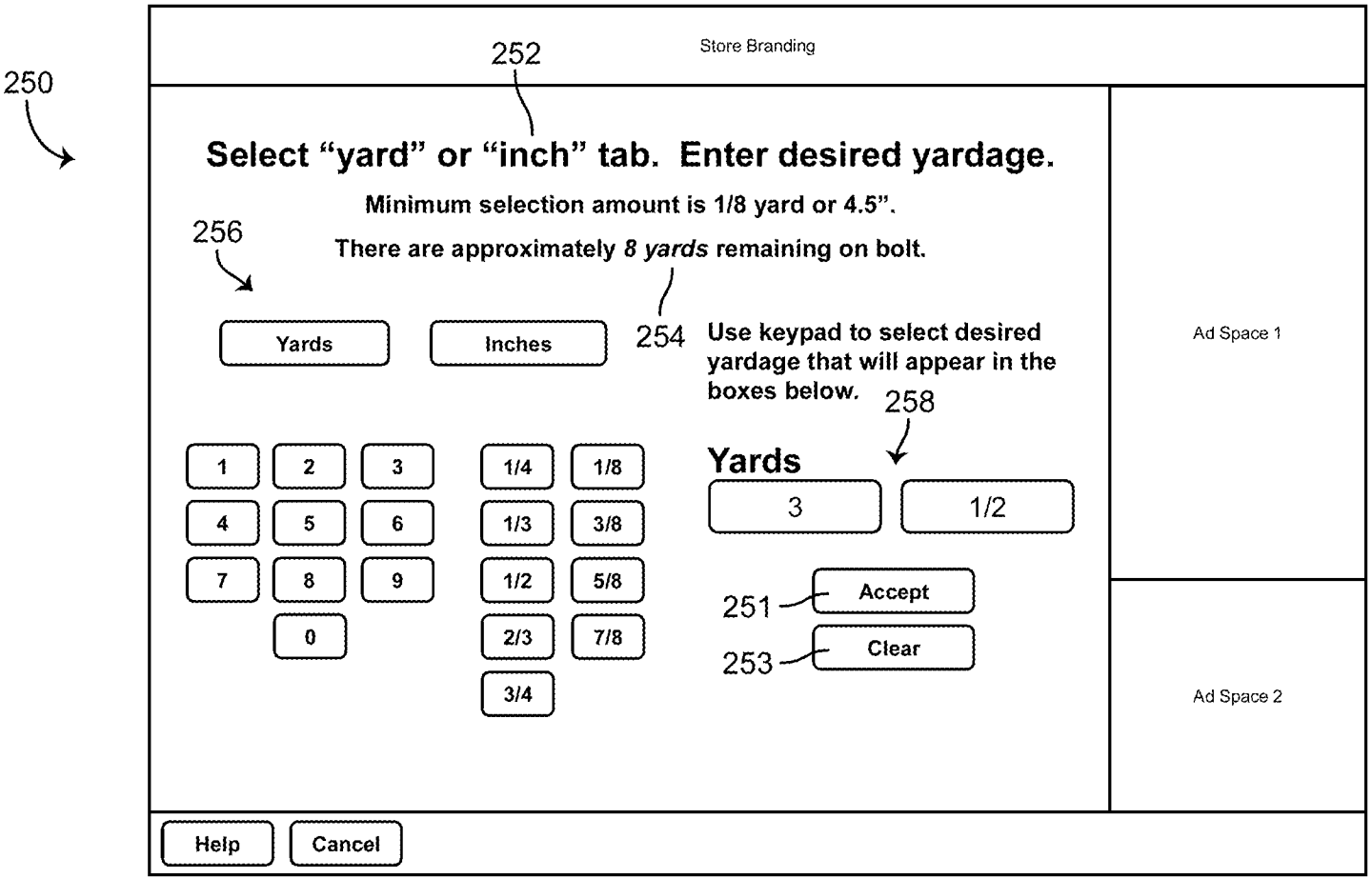
FIG. 18 is a drawing of a "length selection" user interface that may be displayed via the user interface of the soft good dispensing device of FIG. 1, according to an exemplary embodiment.

Referring specifically to FIG. 18, a "length selection" user interface 250 is shown, according to an exemplary embodiment. User interface 250 may be displayed in response to a user selecting the "yes" icon 233 via user interface 230. User interface 250 is shown to include a message 252 prompting the user to input the desired length of the soft good to be dispensed and an estimate 254 of the amount of the soft good remaining on bolt 62 (e.g., determined using weight data from scale 40).

User interface 250 is shown to include an input panel 256 allowing the user to select a unit of measurement (e.g., yards, feet, inches, meters, centimeters, etc.) and to input a numerical value for the desired length of the soft good. The input length may be displayed in boxes 258 along with the selected unit of measurement. Upon inputting the desired length of the soft good, the user can select the accept icon 251 to submit the currently-displayed values or the clear icon 253 to clear all fields. Upon selecting accept icon 251, controller 50 may compare the user-submitted length value shown in boxes 258 with the estimated amount 254 of the soft good remaining on bolt 62.

Figure 19:
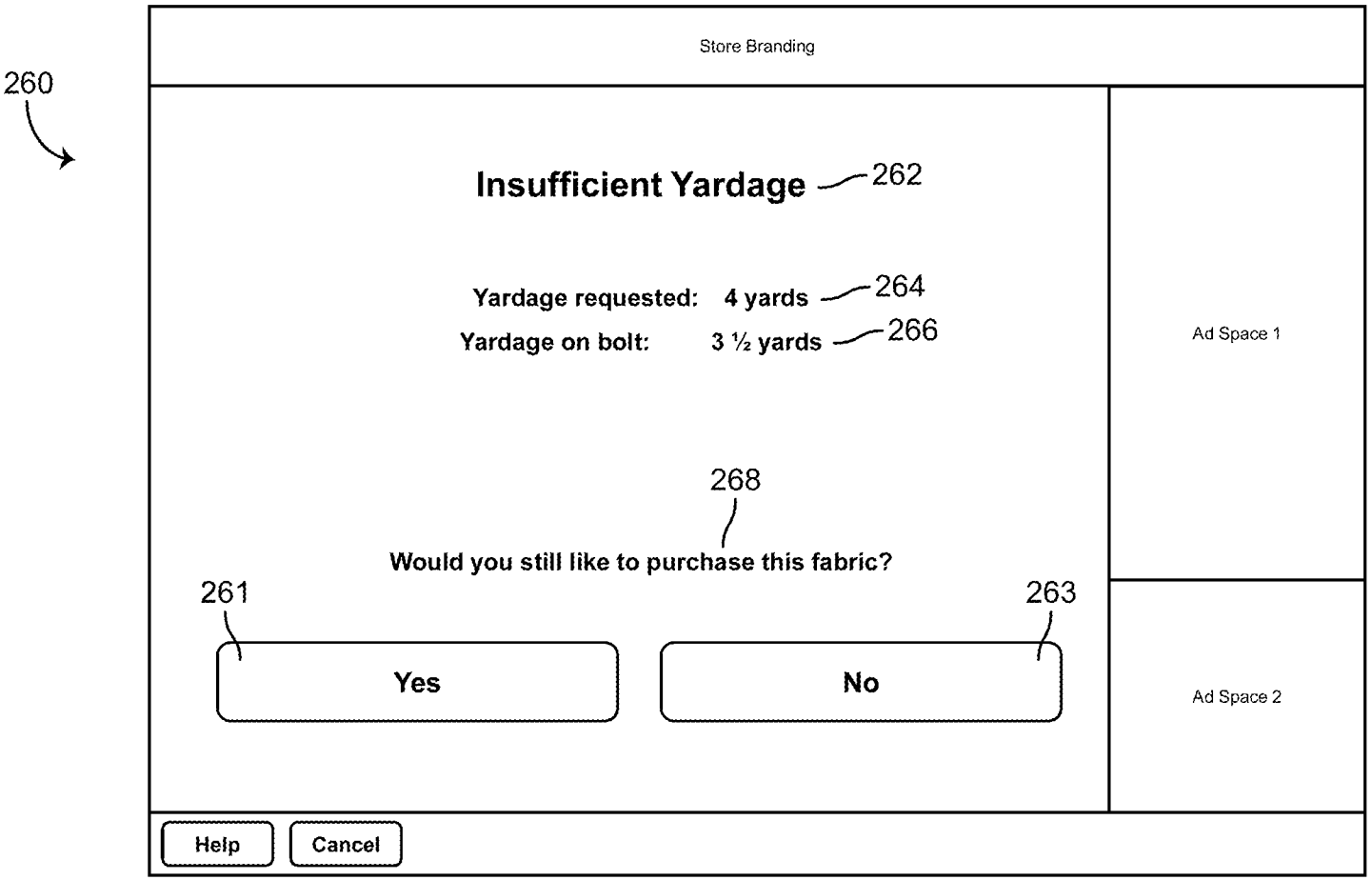
FIG. 19 is a drawing of an "insufficient length" user interface that may be displayed via the user interface of the soft good dispensing device of FIG. 1, according to an exemplary embodiment.

Referring specifically to FIG. 19, an "insufficient length" user interface 260 is shown, according to an exemplary embodiment. User interface 260 may be displayed in response to a determination by controller 50 that the user-submitted length value (i.e., the desired length of the soft good) exceeds the estimated amount 254 of the soft good remaining on bolt 62. User interface 260 is shown to include a message 262 indicating that the length of the soft good remaining on bolt 62 is insufficient to fulfill the user request. In some embodiments, user interface 260 includes a display of the requested length 264 and the estimated length 266 remaining on bolt 62.

User interface 260 is shown to include a prompt 268 for the user to select whether the user still wishes to purchase the soft good, given the insufficient length. The user can select "yes" icon 261 to purchase the remaining length of the soft good or "no" icon 263 to reject the purchase. If the "no" icon 263 is selected, controller 50 may cause user interface 240 (i.e., "request cancelled") to be displayed.

Figure 20:
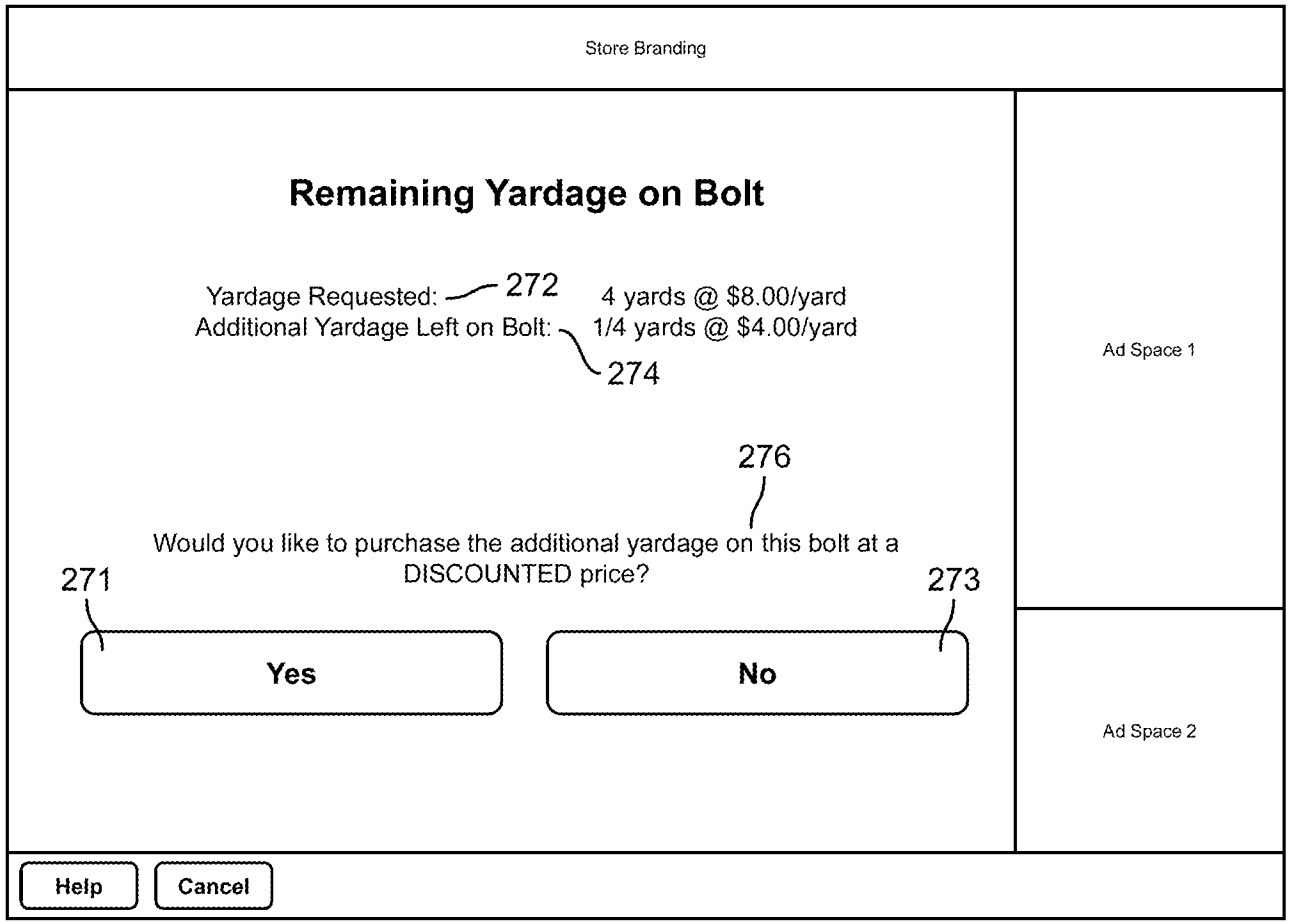
FIG. 20 is a drawing of a "remaining length" user interface that may be displayed via the user interface of the soft good dispensing device of FIG. 1, according to an exemplary embodiment.

Referring specifically to FIG. 20, a "remaining length" user interface 270 is shown, according to an exemplary embodiment. User interface 270 may be displayed in response to a determination by controller 50 that dispensing the requested length of the soft good would result in the remaining length of the soft good on bolt 62 dropping below a threshold value. Controller 50 may subtract the requested length of the soft good (e.g., entered via user interface 250) from the estimated pre-cut amount 254 of the soft good remaining on bolt 62. The result of this calculation estimates the amount of the soft good which will remain on bolt 62 after the current dispensing operation is completed (i.e., the remaining length). If the remaining length is less than a threshold value (e.g., a fixed length, a percentage of the original length of the soft good on bolt 62, etc.), controller 50 may cause user interface 270 to be displayed.

User interface 270 is shown to include the requested length 272 and an estimate of the remaining length 274 on bolt 62 in excess of the requested length 272. Remaining length 274 may be calculated by subtracting requested length 272 from the estimated length 254 of the soft good on bolt 62. In some embodiments, user interface 270 includes a prompt 276 for the user to select whether the user wishes to purchase remaining length 274. Remaining length 274 may be purchased at a discounted price to entice the purchase of a relatively small length of the soft good that may be undesirable for other customers. The user can select the "yes" icon 271 to add remaining length 274 to requested length 272 or the "no" icon 273 to reject purchasing remaining length 274.

Figure 21:
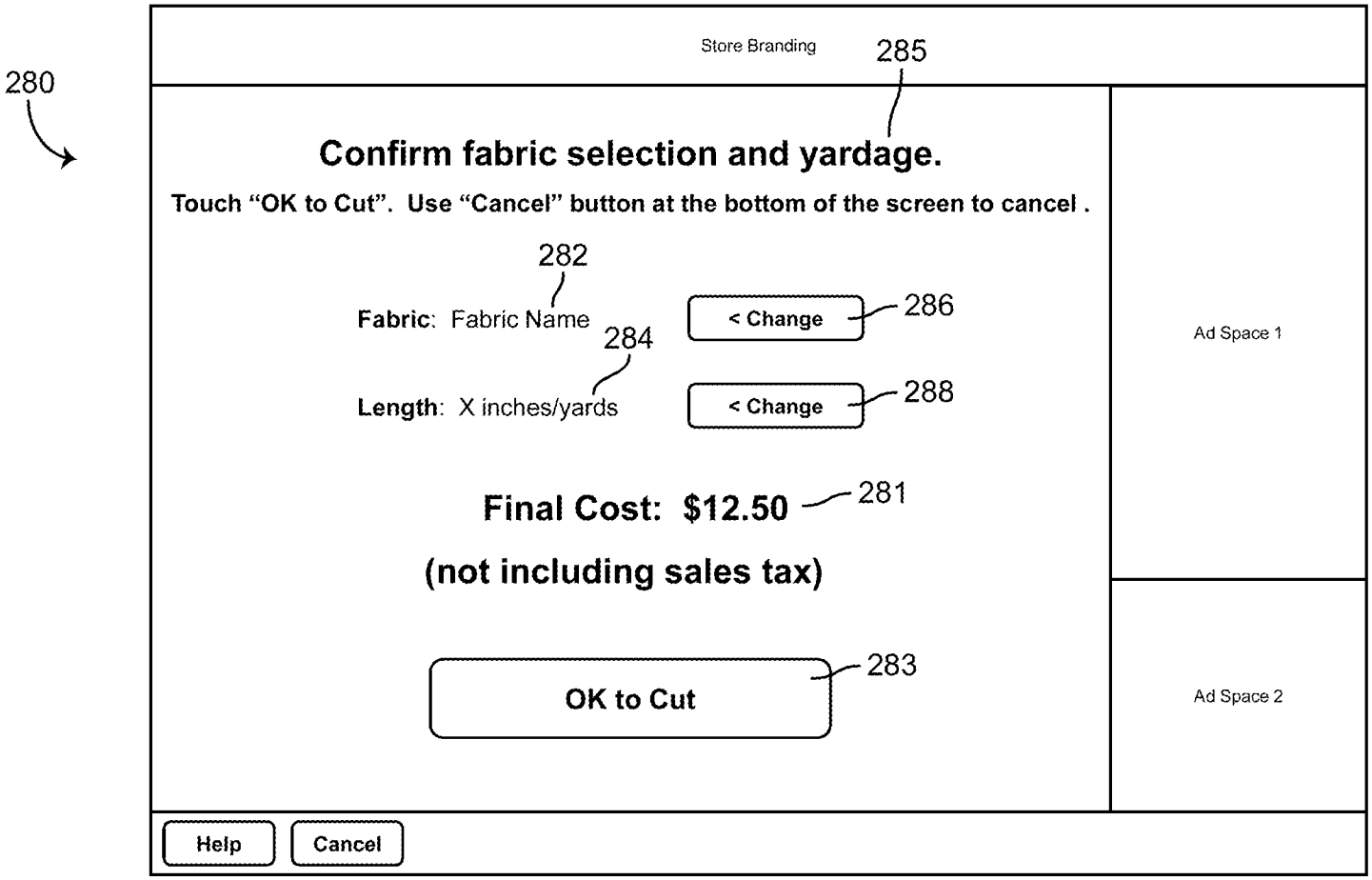
FIG. 21 is a drawing of a "confirm all" user interface that may be displayed via the user interface of the soft good dispensing device of FIG. 1, according to an exemplary embodiment.

Referring specifically to FIG. 21, a "confirm all" user interface 280 is shown, according to an exemplary embodiment. User interface 280 may be displayed in response to a user selecting either of icons 271 or 273 via user interface 270. User interface 280 is shown to include a display of the name 282 of the soft good to be dispensed, the requested length 284 of the soft good to be dispensed, and a final cost 281 of the soft good to be dispensed.

User interface 280 is shown to include change icons 286 and 288. The user can change the soft good to be dispensed by selecting change icon 286. Selecting change icon 286 may cause user interface 240 (i.e., "request cancelled") to be displayed. The user can then remove bolt 62 from loading zone 14 and restart the dispensing process with a different soft good. The user can change the desired length of the soft good to be dispensed by selecting change icon 288. Selecting change icon 288 may cause user interface 250 (i.e., "length selection") to be displayed.

User interface 280 is shown to include a confirmation icon 283 (e.g., "okay to cut"). Selecting confirmation icon 283 may confirm the name 282 of the soft good to be dispensed and the requested length 284 of the soft good to be dispensed. Selecting confirmation icon 283 may initiate an automated dispensing process during which requested length 284 is automatically unwound and separated (e.g., cut) from bolt 62.

Figure 22:
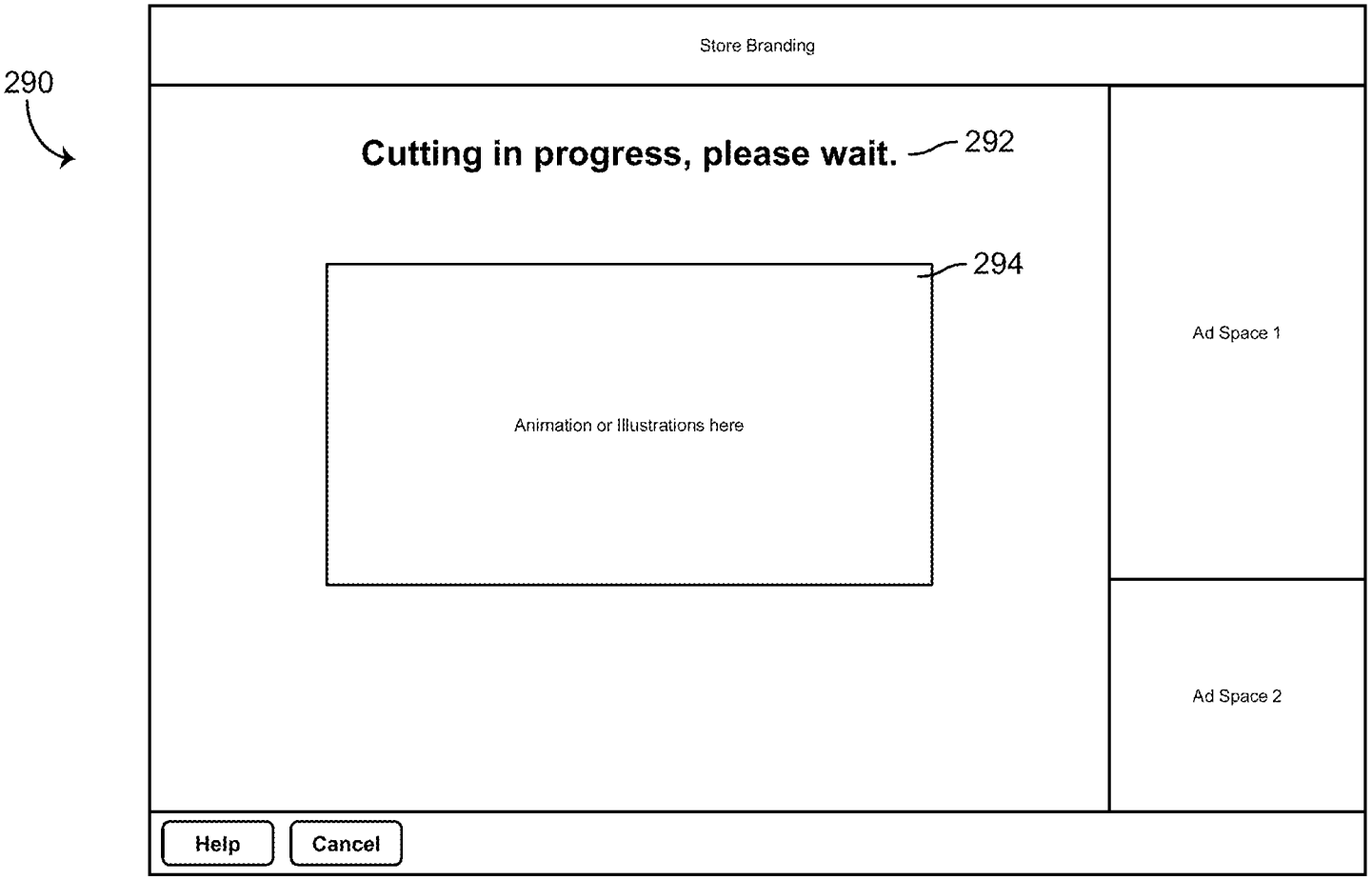
FIG. 22 is a drawing of a "cutting in progress" user interface that may be displayed via the user interface of the soft good dispensing device of FIG. 1, according to an exemplary embodiment.

Referring specifically to FIG. 22, a "cutting in progress" user interface 290 is shown, according to an exemplary embodiment. User interface 290 may be displayed in response to selecting confirmation icon 283 via user interface 280. While user interface 290 is displayed, controller 50 may operate motor 52 to automatically unwind requested length 284 from bolt 62. In some embodiments, user interface 290 includes a message 292 indicating that cutting is in progress and/or an animation or illustration 294 depicting the cutting operation.

During the dispensing operation, controller 50 may determine the amount of the soft good that has been unwound by monitoring the rotational position of motor 52. Controller 50 may monitor inputs from optical devices 100 to determine whether the soft good is being fed through rollers 46-48. If optical devices 100 do not detect the soft good at any time during the cutting operating, controller 50 may determine that the soft good has not been properly fed through rollers 46-48 and may prompt the user to reload bolt 62.

If optical devices 100 initially detect the soft good but such detection is lost before the requested length is dispensed, controller 50 may determine that the soft good on bolt 62 exists in more than one piece (i.e., more than one continuous strip). Optical devices 100 may fail to detect the soft good after the first piece of the soft good has been unwound. The second piece of the soft good may remain on bolt 62 and may need to be fed through rollers 46-48 to continue the dispensing operation.

Figure 23:
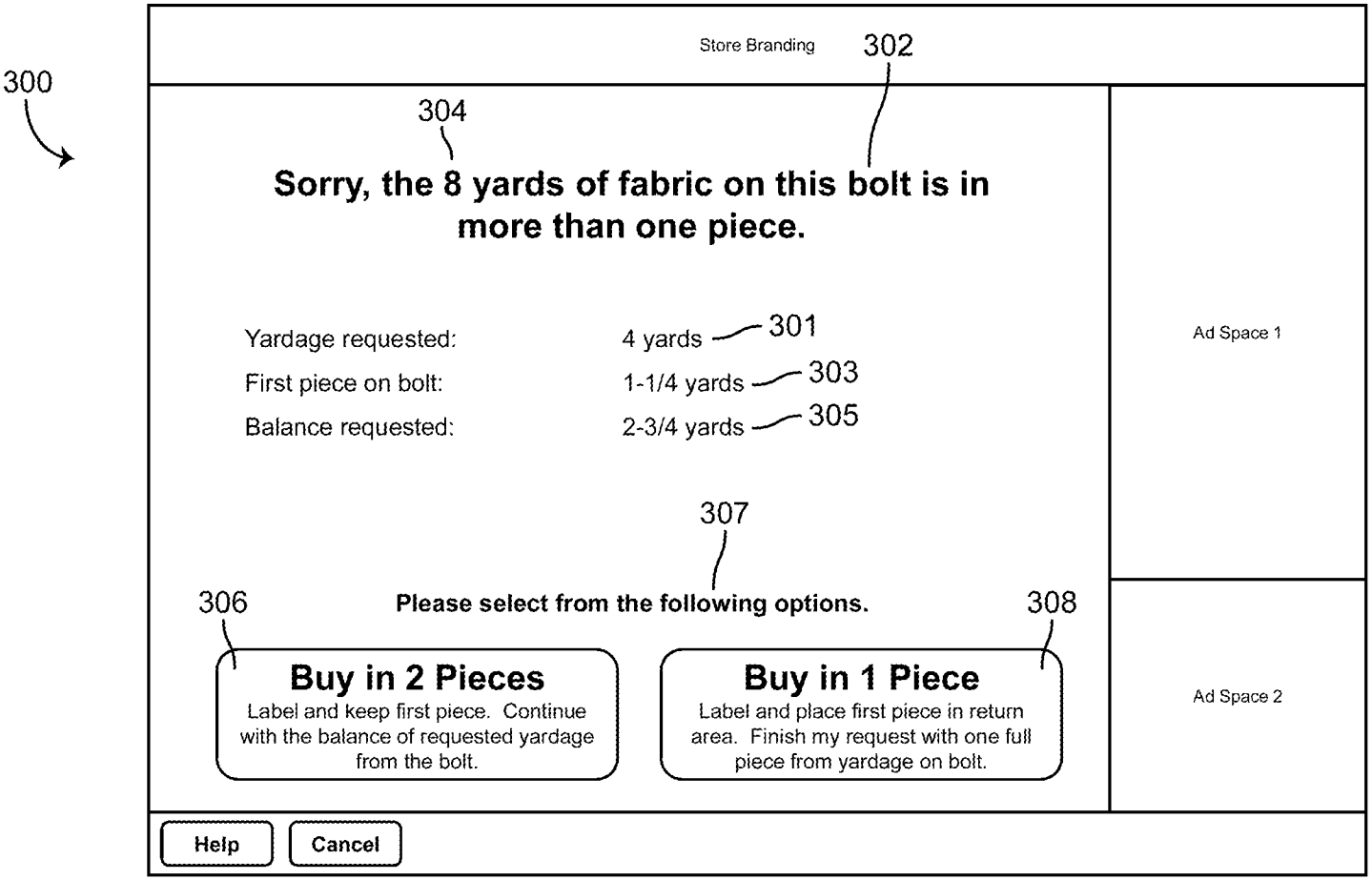
FIG. 23 is a drawing of a "multiple piece" user interface that may be displayed via the user interface of the soft good dispensing device of FIG. 1, according to an exemplary embodiment.

Referring specifically to FIG. 23, a "multiple piece" user interface 300 is shown, according to an exemplary embodiment. User interface 300 may be displayed in response to a determination by controller 50 that the soft good exists on bolt 62 in more than one piece. For example, user interface 300 may be displayed in response to optical devices 100 ceasing to detect the soft good before the requested length of the soft good has been unwound from bolt 62.

User interface 300 is shown to include a message 302 informing the user that the estimated amount 304 of the soft good on bolt 62 exists in more than one piece. In some embodiments, user interface 300 includes a display of the requested length 301, a dispensed length 303 of the first piece of the soft good (i.e., the length that has been unwound before detection is lost), and a balance 305 representing a difference between requested length 301 and dispensed length 303.

User interface 300 may display a prompt 307 for the user to select whether to purchase the soft good in multiple pieces or a single continuous piece. The user can select multiple pieces icon 306 to accept a purchase of the soft good in multiple pieces. If icon 306 is selected, the dispensed length 303 may be labeled and retained and balance 305 may be dispensed to fulfill requested length 301. The user can select single piece icon 308 to purchase the soft good in a single piece. If icon 308 is selected, the dispensed length 303 may be labeled and discarded (e.g., placed in a return area) and the dispensing operation may be restarted to dispense requested length 301 in a single continuous piece.

Figure 24:
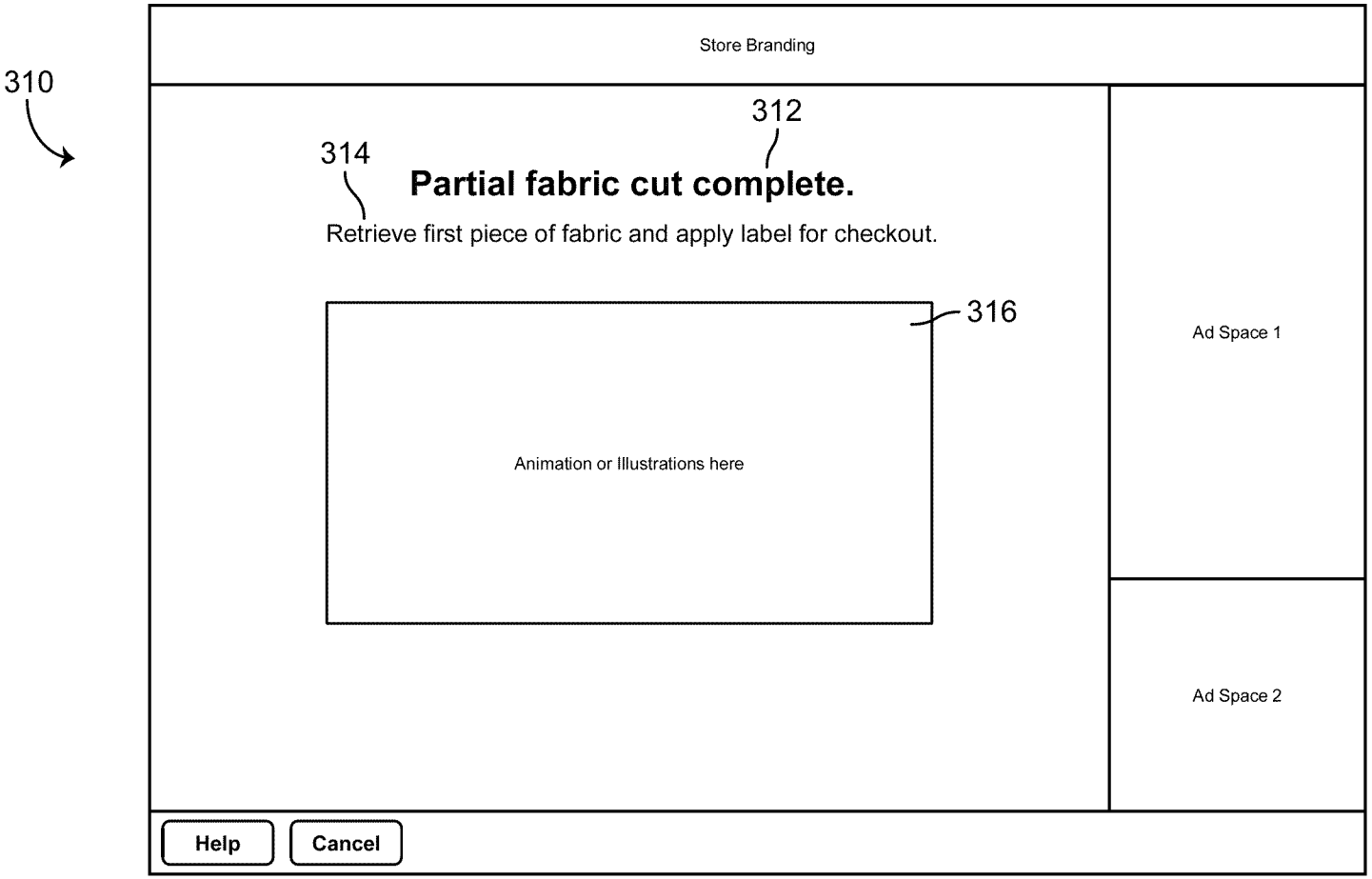
FIG. 24 is a drawing of a "partial fabric cut" user interface that may be displayed via the user interface of the soft good dispensing device of FIG. 1, according to an exemplary embodiment.

Referring specifically to FIG. 24, a "partial fabric cut" user interface 310 is shown, according to an exemplary embodiment. User interface 310 may be displayed in response to selecting multiple pieces icon 306 via user interface 300. User interface 310 is shown to include a message 312 indicating that the first piece of the soft good has been cut and an instruction 314 to retrieve the first piece of the soft good from dispensing zone 16 and to apply a label for checkout.

In some embodiments, printer 26 may print a label that can be applied to the first piece of the soft good while user interface 310 is displayed. User interface 310 may include an animation or illustration 316 depicting the first piece of the soft good being retrieved from dispensing zone 16 and/or the label being applied to the first piece of the soft good.

Figure 25:
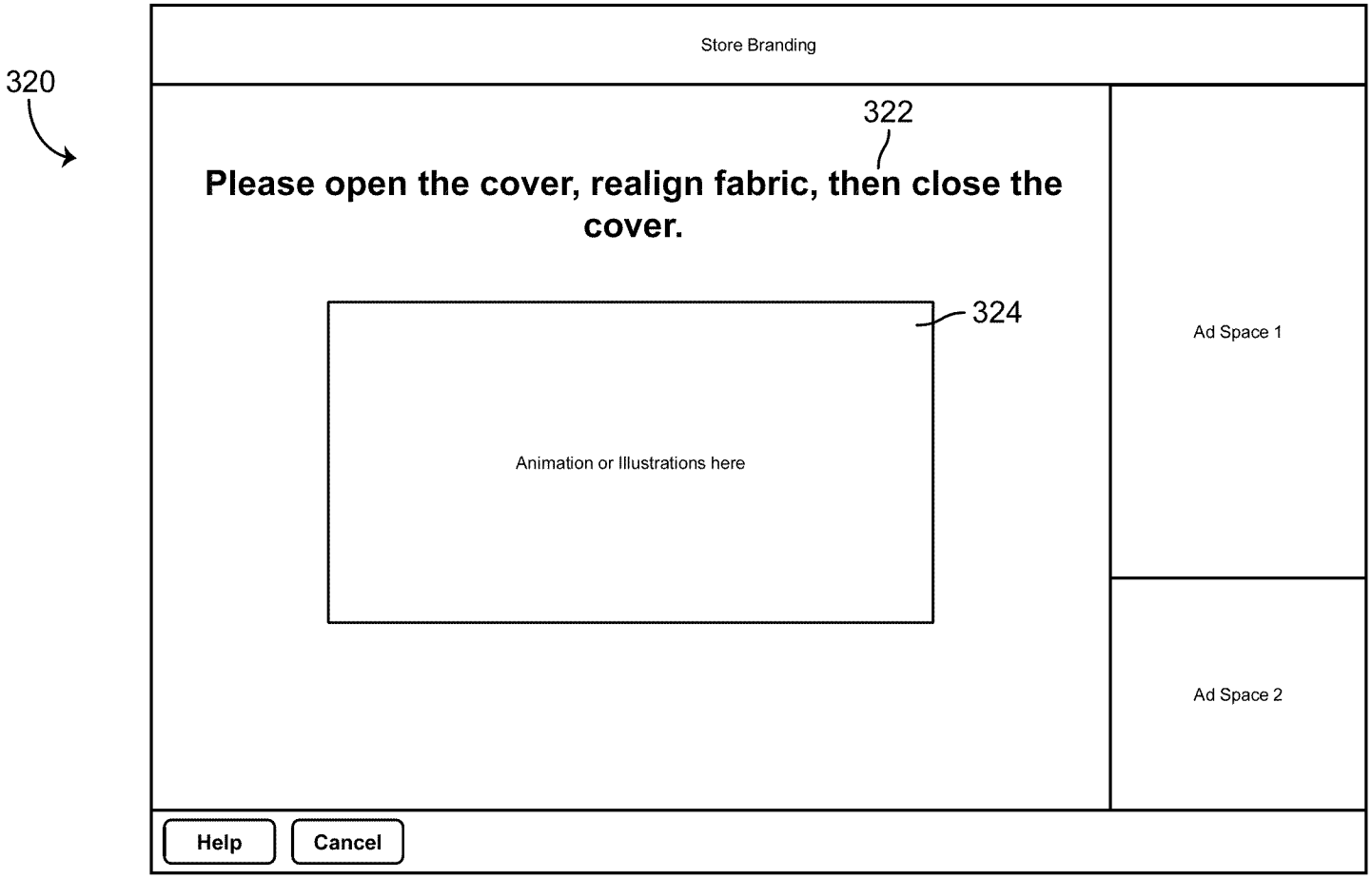
FIG. 25 is a drawing of a "reload" user interface that may be displayed via the user interface of the soft good dispensing device of FIG. 1, according to an exemplary embodiment.

Referring specifically to FIG. 25, a "reload" user interface 320 is shown, according to an exemplary embodiment. In various embodiments, user interface 320 may be displayed in response to detecting that the printed label has been removed from printer 26 or automatically after displaying user interface 310. User interface 320 is shown to include an instruction 322 to open loading zone door 20, realign bolt 62, and close loading zone door 20. In some embodiments, user interface 320 includes an animation or illustration 324 depicting loading zone door 20 being opened, bolt 62 being realigned, and/or loading zone door 20 being closed.

Figure 26:
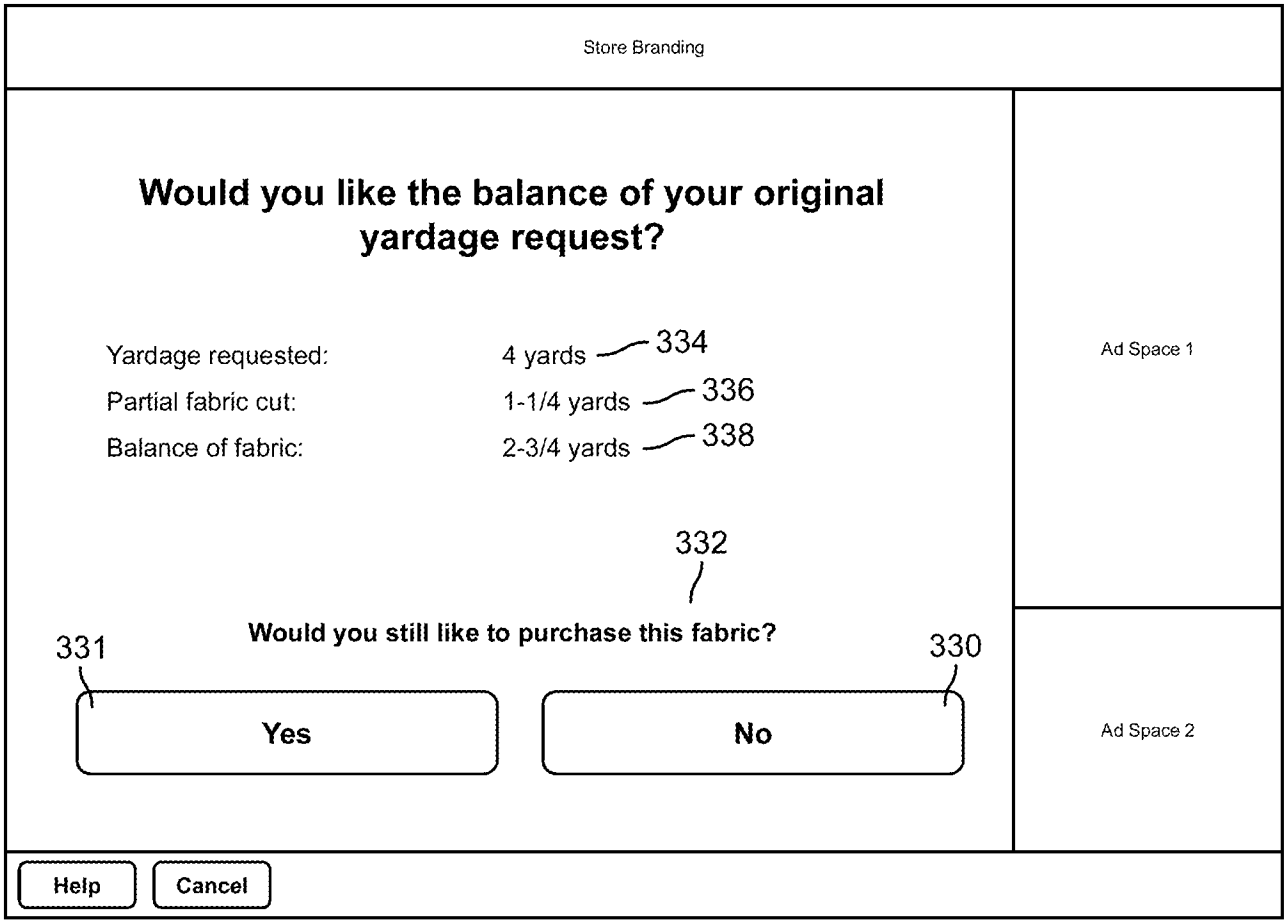
FIG. 26 is a drawing of a "remaining balance" user interface that may be displayed via the user interface of the soft good dispensing device of FIG. 1, according to an exemplary embodiment.

Referring specifically to FIG. 26, a "remaining balance" user interface 330 is shown, according to an exemplary embodiment. User interface 330 may be displayed in response to controller 50 detecting that bolt 62 has been realigned and/or loading zone door 20 has been reclosed. In some embodiments, user interface 300 includes a display of the requested length 334, the length 336 of the first piece of the soft good (i.e., the length that has already been dispensed), and a balance 338 representing a difference between requested length 334 and dispensed length 336.

User interface 330 is shown to include a prompt 332 for the user to select whether to dispense the remaining balance 338. The user can select "yes" icon 331 to purchase balance 338 or the "no" icon 333 to cancel the cutting operation. Selecting "no" icon 333 may cause user interface 240 (i.e., "request cancelled") to be displayed. Selecting "yes" icon 331 may cause user interface 280 (i.e., "confirm all") to be displayed. The second piece of the soft good may be dispensed in the same manner as the first piece.

Figure 27:
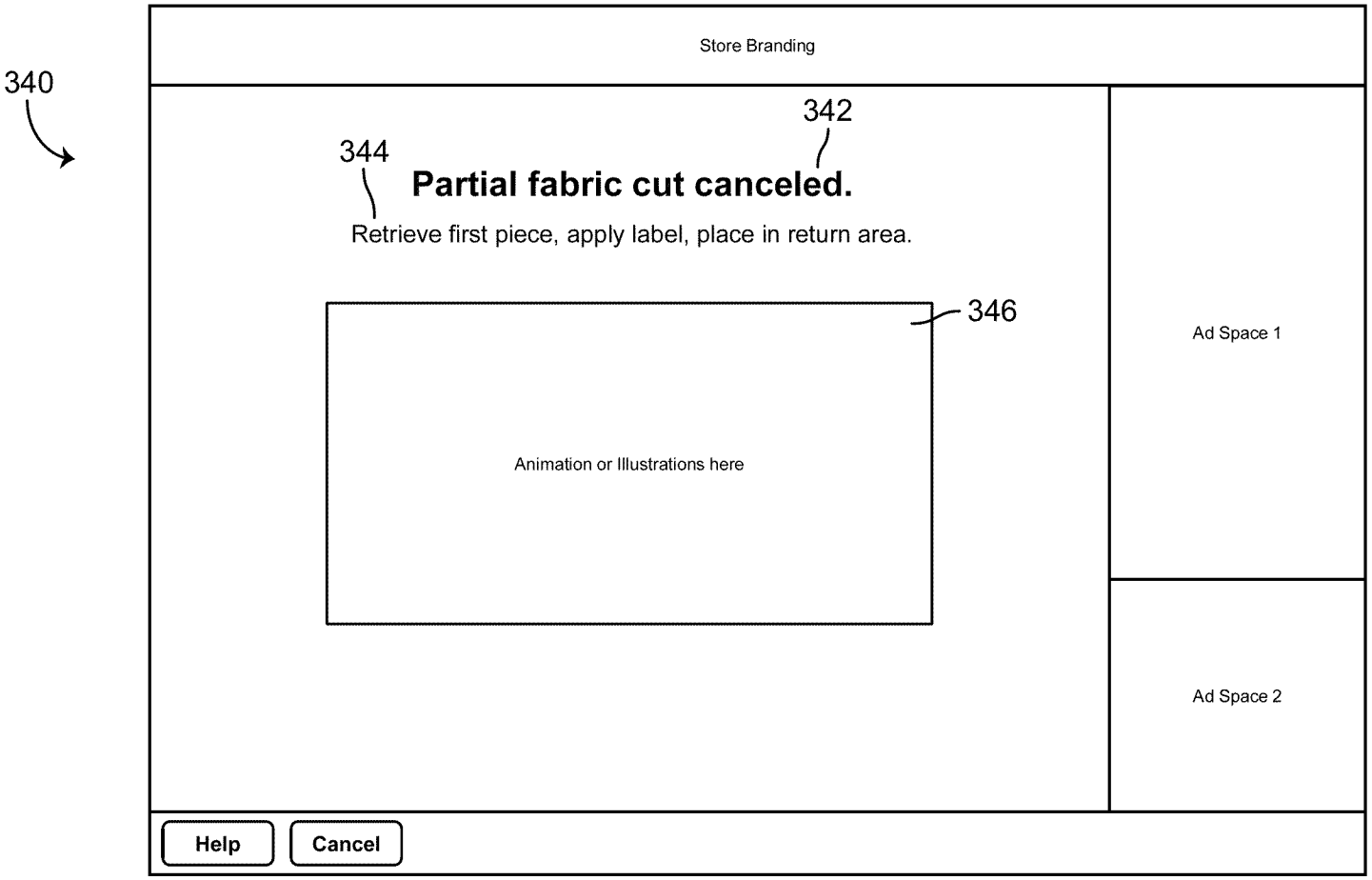
FIG. 27 is a drawing of a "partial cut cancelled" user interface that may be displayed via the user interface of the soft good dispensing device of FIG. 1, according to an exemplary embodiment.

Referring specifically to FIG. 27, a "partial cut cancelled" user interface 340 is shown, according to an exemplary embodiment. User interface 240 may be displayed in response to selecting single piece icon 308 via user interface 300. User interface 340 is shown to include a message 342 that the partial cut has been cancelled and an instruction 344 to retrieve the first piece, apply the label, and place the first piece in the return area. User interface 240 may include an animation or illustration 346 depicting the first piece of the soft good being retrieved from dispensing zone 16, the printed label being applied to the first piece of the soft good, and/or the labeled piece of the soft good being placed in the return area.

Figure 28:
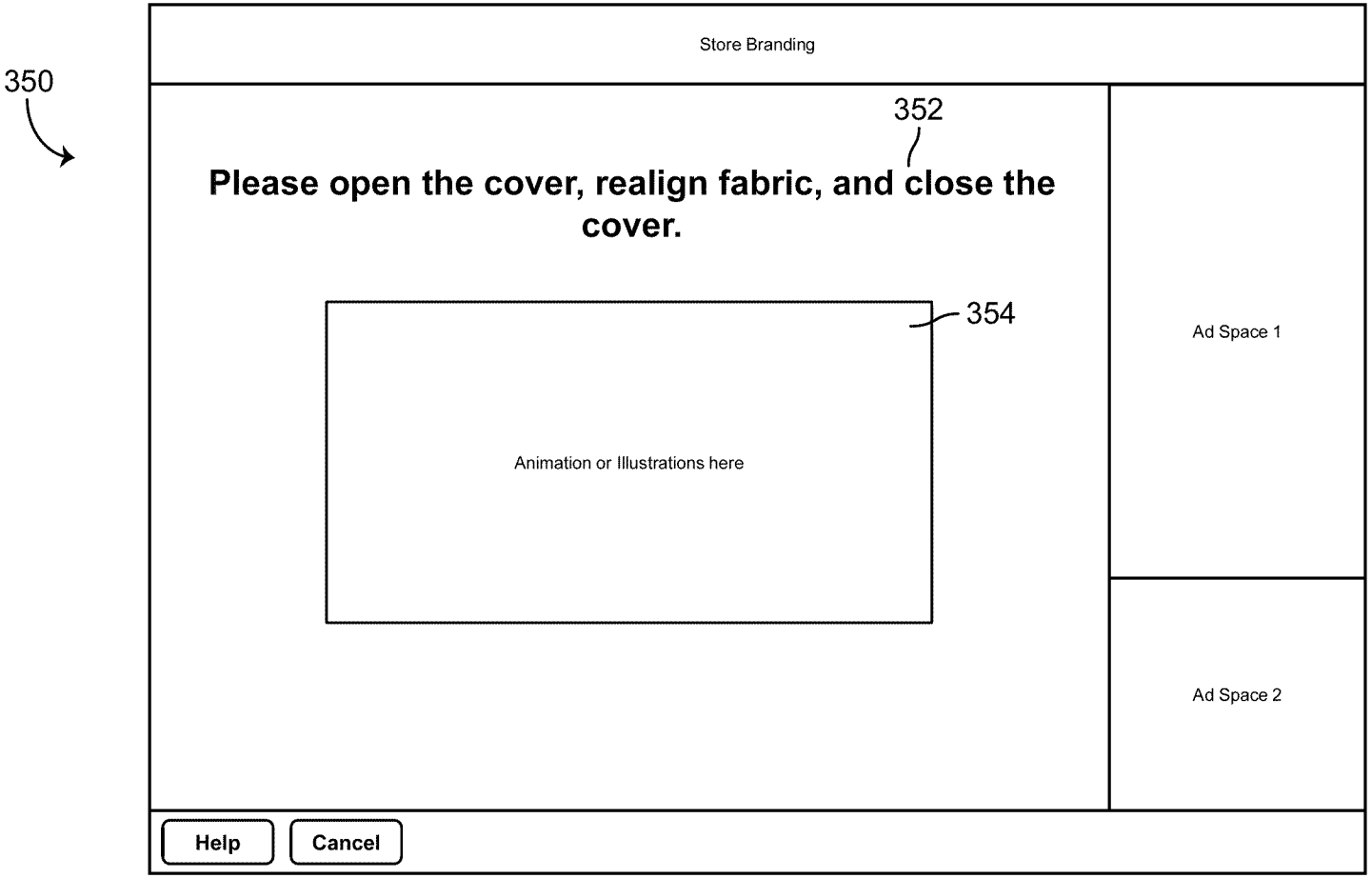
FIG. 28 is a drawing of a "reload" user interface that may be displayed via the user interface of the soft good dispensing device of FIG. 1, according to an exemplary embodiment.

Referring specifically to FIG. 28, a "reload" user interface 350 is shown, according to an exemplary embodiment. In various embodiments, user interface 350 may be displayed in response to detecting that the printed label has been removed from printer 26 or automatically after displaying user interface 340. User interface 350 is shown to include an instruction 352 to open loading zone door 20, realign bolt 62, and close loading zone door 20. In some embodiments, user interface 350 includes an animation or illustration 354 depicting loading zone door 20 being opened, bolt 62 being realigned, and/or loading zone door 20 being closed.

In some embodiments, controller 50 causes user interface 250 (i.e., "length selection") to be displayed after user interface 350. Through user interface 250, the user can confirm the original requested length and proceed to cut the requested length from bolt 62. In various embodiments, controller 50 causes user interface 280 (i.e., "confirm all") or user interface 290 (i.e., "cutting in progress") to be displayed after user interface 350. After displaying user interface 350, dispensing device 10 may perform another automated dispensing operation to cut the requested length from bolt 62.

Figure 29:
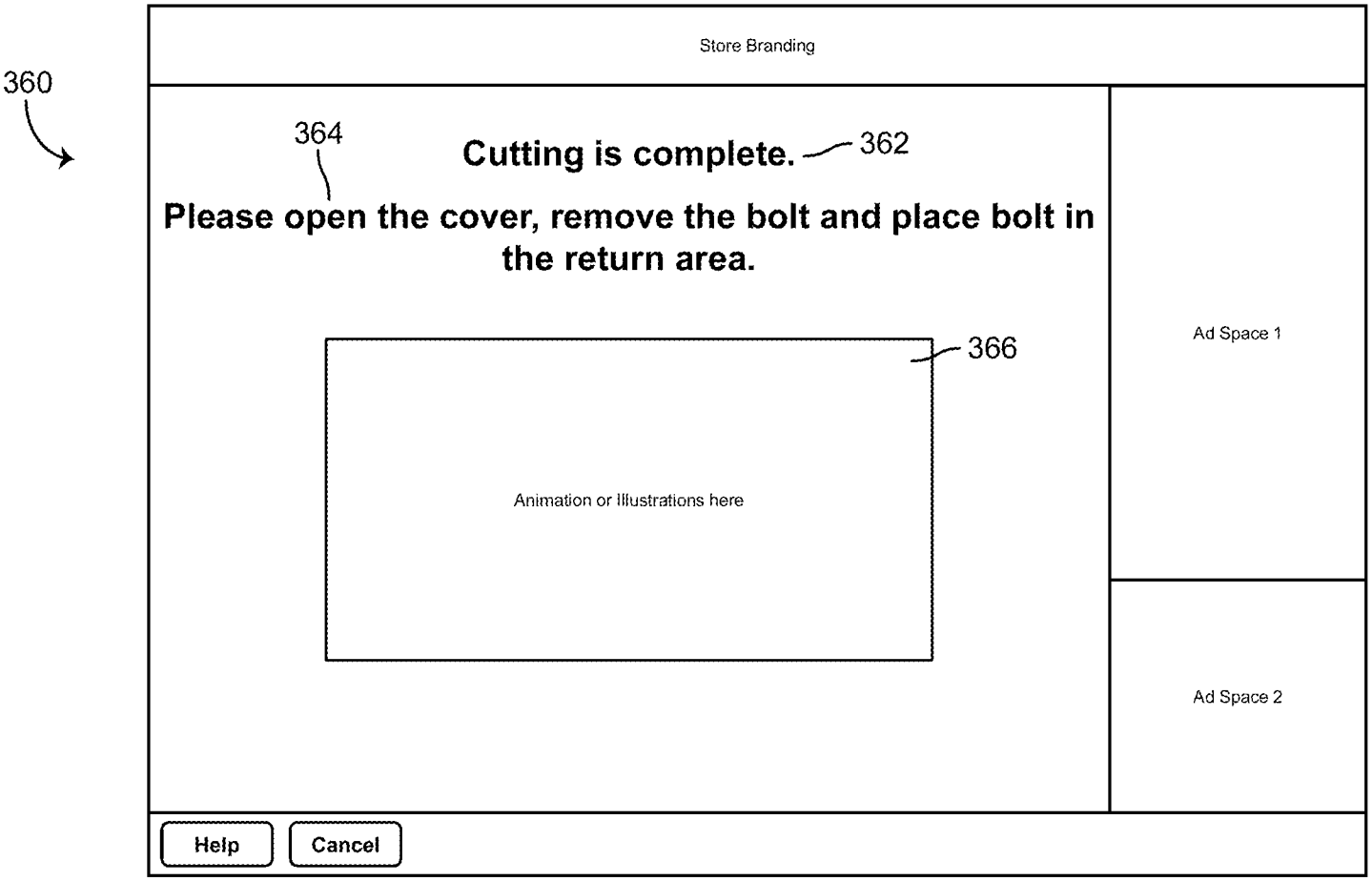
FIG. 29 is a drawing of a "cutting completed" user interface that may be displayed via the user interface of the soft good dispensing device of FIG. 1, according to an exemplary embodiment.

Referring specifically to FIG. 29, a "cutting completed" user interface 360 is shown, according to an exemplary embodiment. User interface 360 may be displayed in response to a determination that the requested length of the soft good has been dispensed from bolt 62 (e.g., in a single piece or in multiple pieces). User interface 360 is shown to include a message 362 that cutting is completed and an instruction 364 to open loading zone door 20, remove bolt 62, and place bolt 62 in the return area. In some embodiments, user interface 360 includes an animation or illustration 366 depicting loading zone door 20 being opened, bolt 62 being removed from loading zone 14, and/or bolt 62 being placed in the return area.

Figure 30:
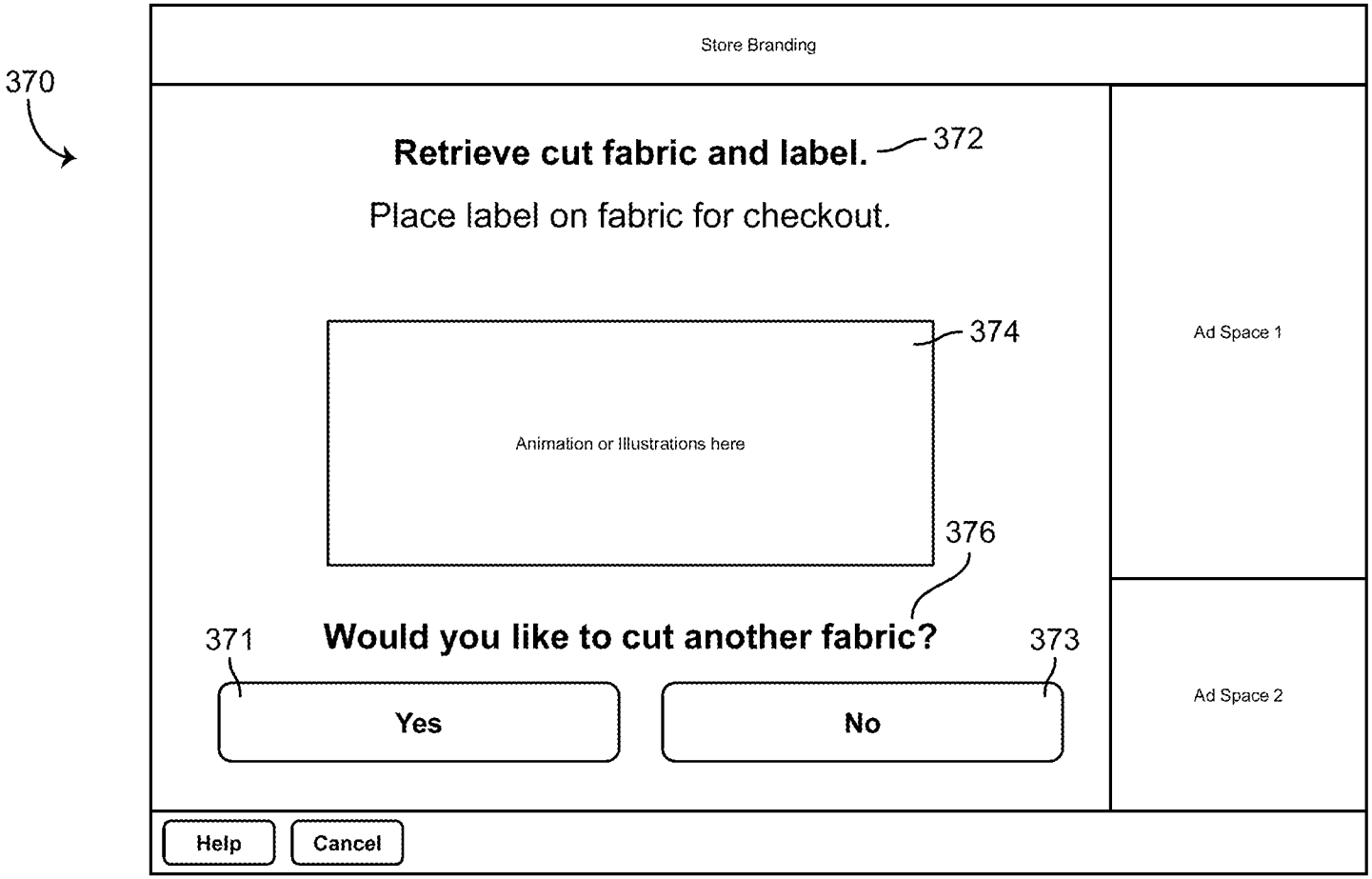
FIG. 30 is a drawing of an "apply label" user interface that may be displayed via the user interface of the soft good dispensing device of FIG. 1, according to an exemplary embodiment.

Referring specifically to FIG. 30, an "apply label" user interface 370 is shown, according to an exemplary embodiment. User interface 370 may be displayed in response to a determination by controller 50 that bolt 62 has been removed from loading zone 14 (e.g., using input from scale 40). User interface 370 is shown to include an instruction 372 to retrieve the dispensed quantity of the soft good from dispensing zone 16 and to place the printed label on the dispensed quantity of the soft good. In some embodiments, user interface 370 includes an animation or illustration 374 depicting the dispensed quantity of the soft good being removed from dispensing zone 16 and/or the printed label being applied to the dispensed quantity of the soft good.

User interface 370 is shown to include a prompt 376 for a user to select whether to cut another soft good. The user can select "yes" icon 371 to cut another soft good or "no" icon 373 to end the current user session. Selecting yes icon 371 may cause controller 50 to check for critical errors and to display user interface 210 or 220 based on a result of the error check. Selecting no icon 373 may cause controller 50 to display user interface 300.

Referring now to FIG. 31, a flowchart of a process 400 for dispensing a soft good is shown, according to an exemplary embodiment. Process 400 may be performed by soft good dispensing device 10 as described with reference to FIGS. 1-30. Process 400 is shown to include displaying an attract loop (step 402). Step 402 may include displaying user interface 200, as described with reference to FIG. 13. For example, step 402 may include displaying video files, images, or other media designed to attract and/or engage potential customers. In some embodiments, step 402 includes displaying advertisements, marketing, or other promotional media. Step 402 may include displaying a welcome message and/or a prompt to initiate a user session (e.g., "touch the screen to begin").

Process 400 is shown to include determining whether an error is detected (step 404). Step 404 may include determining whether any required peripheral not functioning, if printer 26 is out of paper, if printer 26 is not functioning, if scanner 28 not functioning, or if dispensing mechanism 61 is not functioning. If an error is detected in step 404, a system down message may be displayed (step 406). The system down message may indicate that dispensing device 10 is out of service. In some embodiments, step 406 includes displaying user interface 210 as described with reference to FIG. 14.

Still referring to FIG. 31, process 400 is shown to include displaying loading instructions (step 408). Step 408 may be performed in response to a determination in step 404 that no errors are detected. Step 408 may include displaying user interface 220 as described with reference to FIG. 15. For example, step 408 may include displaying an instruction message prompting a user to place bolt 62 in loading zone 14, to align free end 64, and to close loading zone door 20. In some embodiments, step 408 includes displaying an animation or illustration depicting bolt 62 being placed in loading zone 14, the proper alignment of free end 64 (e.g., between rollers 43 and 46), and/or loading zone door 20 being moved into the closed position.

In some embodiments, step 408 includes monitoring inputs from door position sensors. Step 408 may include using inputs from door position sensors to determine whether loading zone door 20 is open or closed.

Still referring to FIG. 31, process 400 is shown to include scanning and weighting the soft good in the loading zone (step 410). In some embodiments, step 410 is performed in response to a determination that loading zone door 20 is closed. Step 410 may include using scanners 28 to read a machine-readable image (e.g., a bar code, a QR code, a product ID, etc.) affixed to bolt 62. If scanners 28 are unable to read the machine-readable image, step 410 may include displaying an error message (e.g., "scan error"). If scanners 28 successfully read the machine-readable image, step 410 may include comparing the scanned product ID with product data stored in inventory system 136. If the scanned product ID is not found in inventory system 136, step 410 may include displaying an error message (e.g., "item scanned but not found"). If the scanned product ID is found in inventory system 136 and loading zone door 20 is closed, step 410 may include displaying user interface 230. Step 410 may include using data from scale 40 to determine the weight of the soft good in loading zone 14.

Process 400 is shown to include estimating the remaining length (E) of the soft good in the loading zone (step 412). The remaining length of the soft good may be estimated using weight data measured by scale 40. For example, scale 40 may measure the weight of the soft good in loading zone 14. Controller 50 may subtract the weight of an empty bolt and divide by the density, thickness, and/or width of the soft good to estimate the remaining length (E).

Still referring to FIG. 31, process 400 is shown to include displaying information relating to the soft good (step 414). In some embodiments, step 414 includes displaying user interface 230, as described with reference to FIG. 16. Information relating to the soft good may include, for example, an item name indicating the identity of the soft good loaded into loading zone 14, the estimated remaining length (E) of the soft good, pricing information, a product image, or other item-specific information relating to the particular soft good in loading zone 14. Pricing information may include a price per unit (e.g., dollars per yard) of the soft good. In some embodiments, pricing information includes a regular price and a sale price. Pricing information and other product information may be retrieved from an external data source (e.g., inventory system 136) or loaded from local memory 53.

Still referring to FIG. 31, process 400 is shown to include prompting the user to confirm the soft good (step 416). Step 416 may include displaying a prompt asking the user whether the soft good displayed in step 414 is the soft good that the user wishes to dispense.

If the soft good is not confirmed in step 416 (i.e., the result of step 416 is "no"), unloading instructions may be displayed (step 418). Step 418 may include displaying user interface 240 as described with reference to FIG. 17. For example, step 418 may include displaying a message indicating that the request has been cancelled. Step 418 may include displaying an instruction to open loading zone door 20, remove bolt 62, and place bolt 62 in a return area. In some embodiments, step 418 includes displaying an animation or illustration depicting loading zone door 20 being opened, bolt 62 being removed from loading zone 14, and/or bolt 62 being placed in the return area.

If the soft good is confirmed in step 416 (i.e., the result of step 416 is "yes"), process 400 may proceed to receive the requested length (R) of the soft good (step 420). Step 420 may include displaying user interface 250 as described with reference to FIG. 18. For example, step 420 may include prompting the user to input the desired length of the soft good to be dispensed. User input may be received via user interface 18. In step 420, the user may select a unit of measurement (e.g., yards, feet, inches, meters, centimeters, etc.) and may input a numerical value for the desired length of the soft good.

Still referring to FIG. 31, process 400 is shown to include determining whether the requested length (R) exceeds the estimated remaining length (E) of the soft good (step 422). If the requested length (R) exceeds the estimated remaining length (E) (i.e., the result of step 422 is "yes"), process 400 may include displaying a notification that the remaining length of the soft good is insufficient to fulfill the user request (step 426) and prompting the user to select whether to purchase the soft good notwithstanding the insufficient length (step 426). Steps 424 and 426 may include displaying user interface 260 as described with reference to FIG. 19. If the user selects to purchase the soft good notwithstanding the insufficient length (i.e., the result of step 426 is "yes"), process 400 may proceed to step 432. If the user selects to not purchase the soft good (i.e., the result of step 426 is "no"), process 400 may include displaying the unloading instructions (step 418).

If the requested length (R) does not exceed the estimated remaining length (E) (i.e., the result of step 422 is "no"), process 400 is shown to include determining whether the difference between the requested length (R) and the estimated remaining length (E) (i.e., E−R) is less than a threshold value (step 428). In some embodiments, step 428 includes displaying user interface 270 as described with reference to FIG. 20. Step 428 may include displaying the requested length (R), the estimated remaining length (E), and the difference between the requested length (R) and the estimated remaining length (E) (i.e., the excess length).

In some embodiments, step 428 includes displaying a prompt for the user to select whether to purchase the excess length (step 430). The excess length may be purchased at a discounted price to entice the purchase of a relatively small length of the soft good that may be undesirable for other customers. Step 430 may include displaying a discounted price for the excess length and a selection option for choosing to purchase the excess length or to not purchase the excess length.

Still referring to FIG. 31, process 400 is shown to include confirming the soft good and the requested length (R') (step 432). The requested length (R') may be the same as the user-input length in step 420 (i.e., R'=R) or may include the user-input length plus the excess length (i.e., R'=R+E−R=E). In some embodiments, the requested length R' is the same as the estimated remaining length E. In some embodiments, step 432 includes displaying user interface 280 as described with reference to FIG. 21.

Step 432 may include displaying selectable options to change the soft good and/or the requested length. If the user selects the option to change the soft good, process 400 may proceed to displaying the unloading instructions (step 418). If the user selects the option to change the length, process 400 may proceed to step 420.

Still referring to FIG. 31, process 400 is shown to include beginning to unwind the soft good (step 434). Step 434 may include activating motor 52 and feeding the soft good through rollers 46 and 48. In some embodiments, step 434 includes displaying user interface 290 as described with reference to FIG. 22. Step 434 may include displaying a message indicating that cutting is in progress and/or an animation or illustration depicting the cutting operation.

In some embodiments, step 434 includes determining the amount of the soft good that has been unwound by monitoring the rotational position of motor 52. Controller 50 may monitor inputs from optical devices 100 to determine whether the soft good is being fed through rollers 46-48. If optical devices 100 do not detect the soft good at any time during the cutting operating, controller 50 may determine that the soft good has not been properly fed through rollers 46-48 and may prompt the user to reload bolt 62.

Still referring to FIG. 31, process 400 is shown to include determining whether the soft good exists in multiple pieces (step 436). Step 436 may include monitoring and using inputs from optical devices 100 to determine whether the soft good is unwound in a single continuous strip or multiple separate strips. For example, if optical devices 100 initially detect the soft good but such detection is lost before the requested length is dispensed, controller 50 may determine that the soft good on bolt 62 exists in more than one piece (i.e., more than one continuous strip). Optical devices 100 may fail to detect the soft good after the first piece of the soft good has been unwound from bolt 62. The second piece of the soft good may remain on bolt 62 and may need to be fed through rollers 46-48 to continue the dispensing operation.

If the soft good exists in multiple pieces (i.e., the result of step 436 is "yes"), process 400 may include printing a label for the first piece (step 438) and displaying reloading instructions (step 440). The first piece of the soft good has a length $L_1$, where $L_1$<R'. Step 440 may include displaying user interface 320 as described with reference to FIG. 25. For example, step 440 may include displaying an instruction to open loading zone door 20, realign bolt 62, and close loading zone door 20. In some embodiments, step 440 includes displaying an animation or illustration depicting loading zone door 20 being opened, bolt 62 being realigned, and/or loading zone door 20 being closed. If the soft good does not exist in multiple pieces (i.e., the result of step 436 is "no"), process 400 may proceed to unwind and cut the requested length (R') (step 448).

Still referring to FIG. 31, process 400 is shown to include displaying a prompt for specifying whether to purchase the soft good in multiple pieces or in a single continuous piece (step 442). If the user selects to purchase as a single piece (i.e., the result of step 442 is "no"), process 400 may proceed to step 448. If the user selects to purchase as multiple pieces (i.e., the result of step 442 is "yes"), process 400 may proceed to unwind and cut the remaining length $L_2$ (step 444). The remaining length $L_2$ may be the difference between the requested length R' and the length of the first piece $L_1$ that has already been dispensed (i.e., $L_2$=R'−$L_1$). After the remaining length $L_2$ has been dispensed, a label may be printed for the remaining length (step 446).

If the soft good exists in a single piece (i.e., step 436=no) or the user selects to purchase as a single piece (i.e., step 442=no), process 400 may proceed to step 448. In step 448, the requested length R' is unwound and cut from bolt 62 as a single continuous piece. Process 400 may include printing a label for the requested length R' (step 450).

Still referring to FIG. 31, process 400 is shown to include displaying unloading instructions (step 452). Step 452 may be performed after all pieces (e.g., one or more) of the soft good are cut from bolt 62. In some embodiments, step 452 includes displaying user interface 360 as described with reference to FIG. 29. Step 452 may include displaying a message that cutting is completed and an instruction to open loading zone door 20, remove bolt 62, and place bolt 62 in the return area. In some embodiments, step 452 includes displaying an animation or illustration depicting loading zone door 20 being opened, bolt 62 being removed from loading zone 14, and/or bolt 62 being placed in the return area.

In some embodiments, process 400 includes displaying a prompt for specifying whether to dispense another soft good (step 454). If the user selects to dispense another soft good (i.e. the result of step 454 is "yes"), process 400 may return to step 408. If the user selects to not dispense another soft good (i.e., the result of step 454 is "no"), process 400 may return to step 402.

Referring now to FIGS. 32-39, several graphical user interfaces 500-570 that may be displayed to store personnel and/or service technicians are shown, according to an exemplary embodiment. Graphical user interfaces 500-570 may be displayed on user interface 18 of dispensing device 10. User interfaces 500-570 may provide store personnel and/or service technicians with options for manually entering product information, printing labels, resetting dispensing device 10, performing maintenance functions (e.g., replacing cutting blade 112, vacuuming dispensing device 10, etc.), and/or testing various components of dispensing device 10 (e.g., cutting mechanism 70, scale 40, scanners 28, printer 26, etc.)

Figure 32:
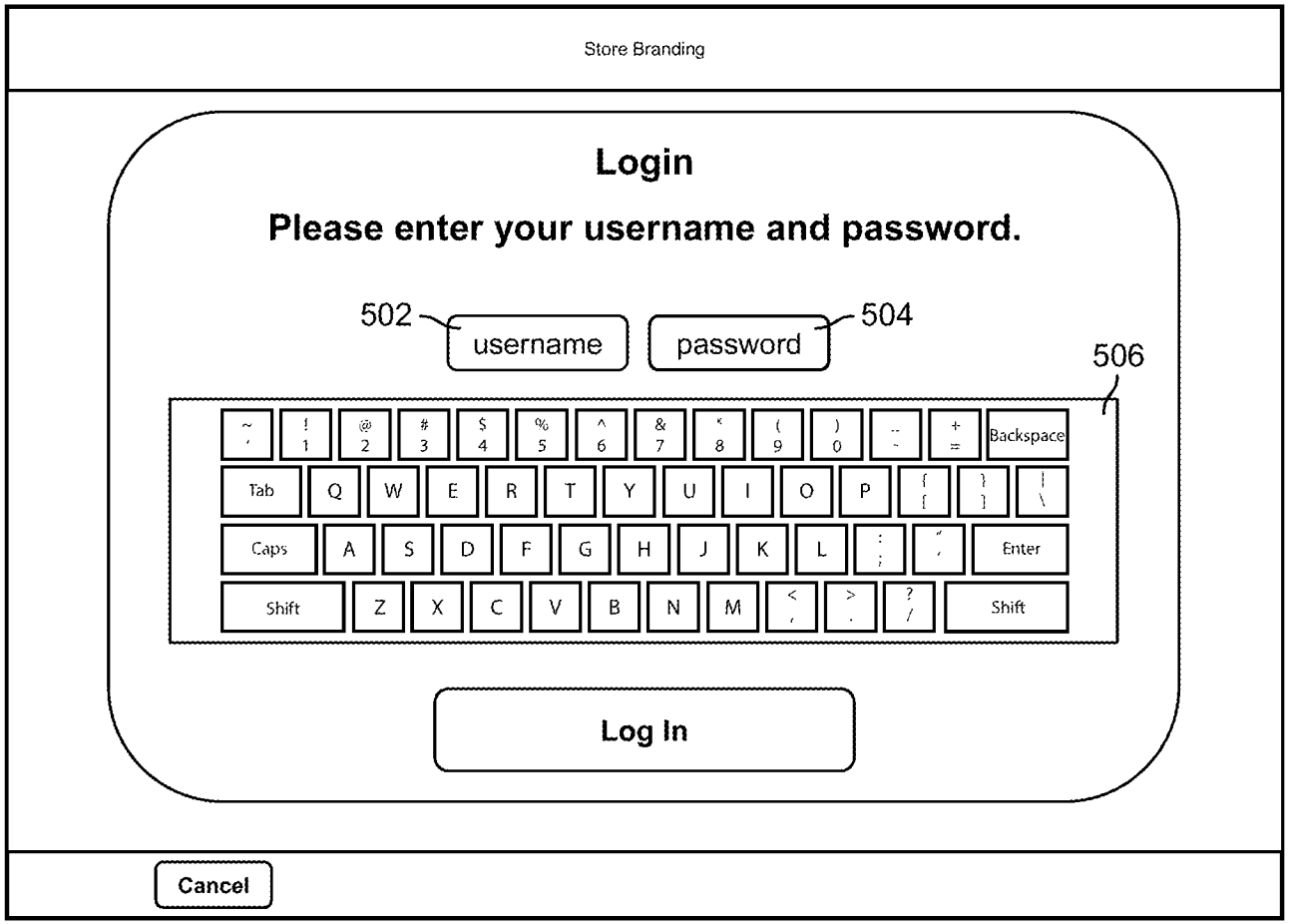
FIG. 32 is a drawing of a login interface that may be displayed via the user interface of the soft good dispensing device of FIG. 1, according to an exemplary embodiment.

Referring specifically to FIG. 32, a login user interface 500 is shown, according to an exemplary embodiment. Login user interface 500 is shown to include a username field 502, a password field 504, and a keyboard 506. Store personnel and/or service technicians can enter login credentials via user interface 500 to access functions of dispensing device 10 that are not available to consumers.

Figure 33:
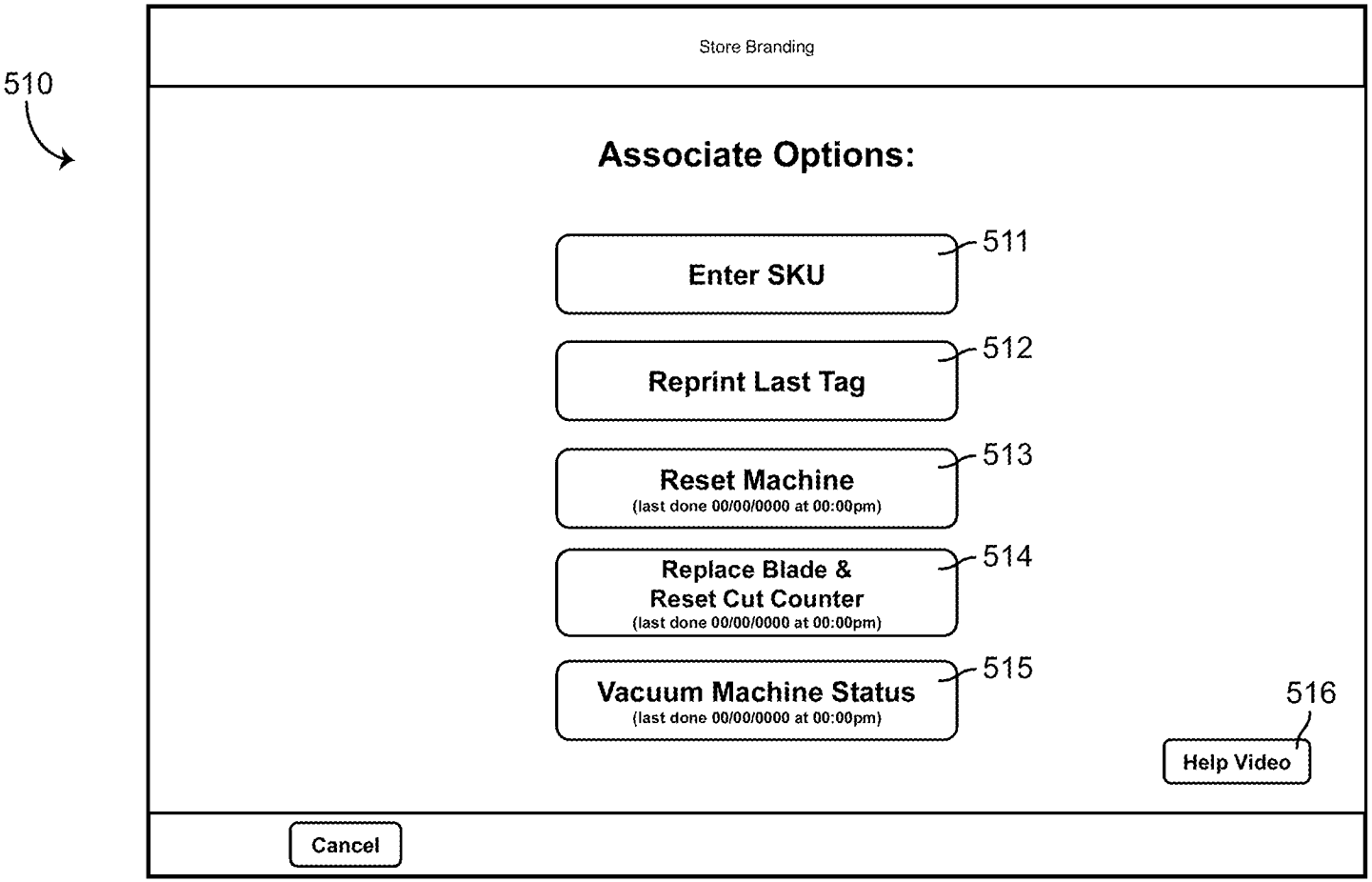
FIG. 33 is a drawing of an associate menu that may be displayed via the user interface of the soft good dispensing device of FIG. 1, according to an exemplary embodiment.
Figure 34:
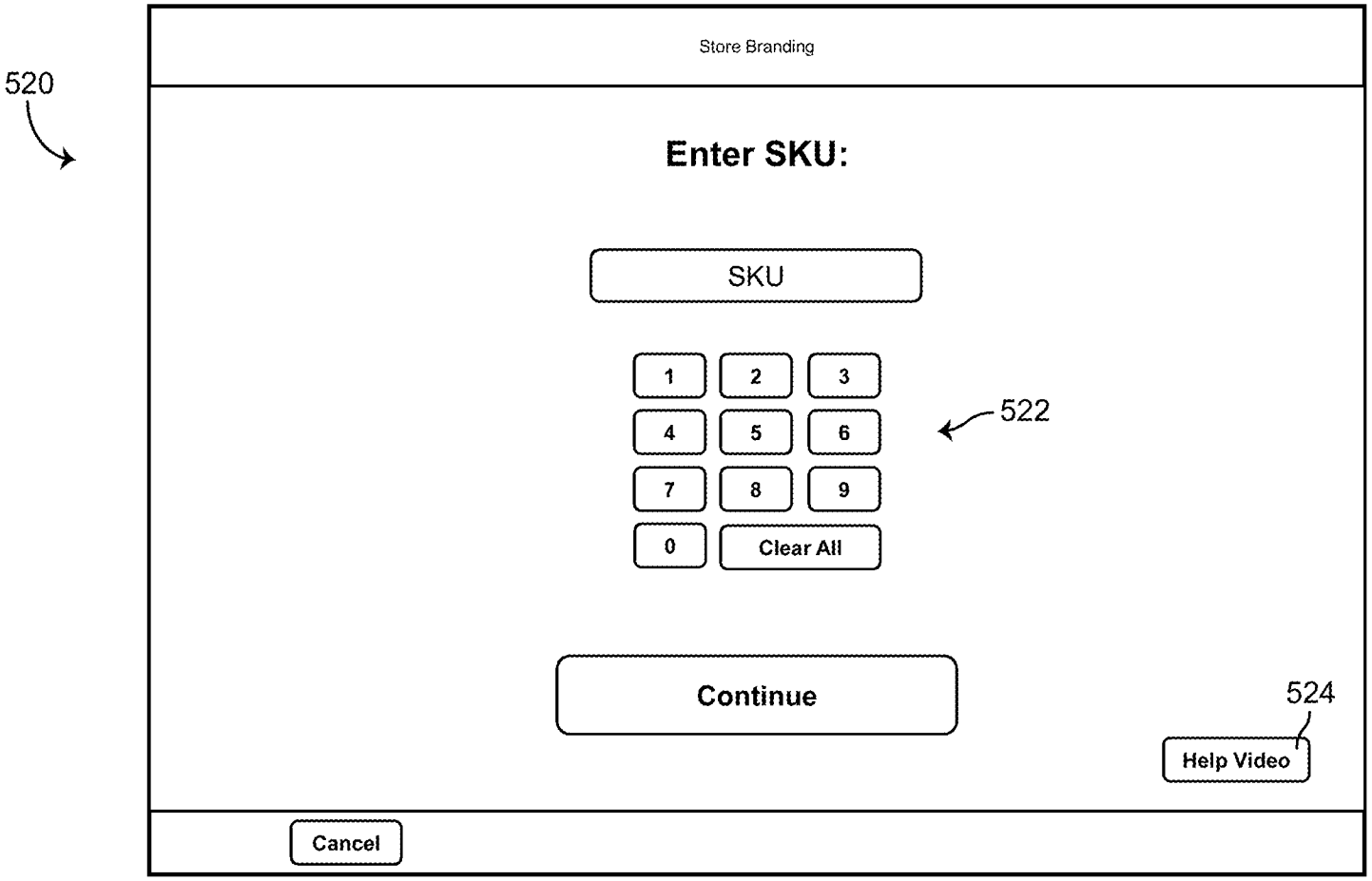
FIGS. 34-37 are drawings of instructional interfaces that may be displayed upon selecting various menu options in the associate menu of FIG. 33, according to an exemplary embodiment.
Figure 35:
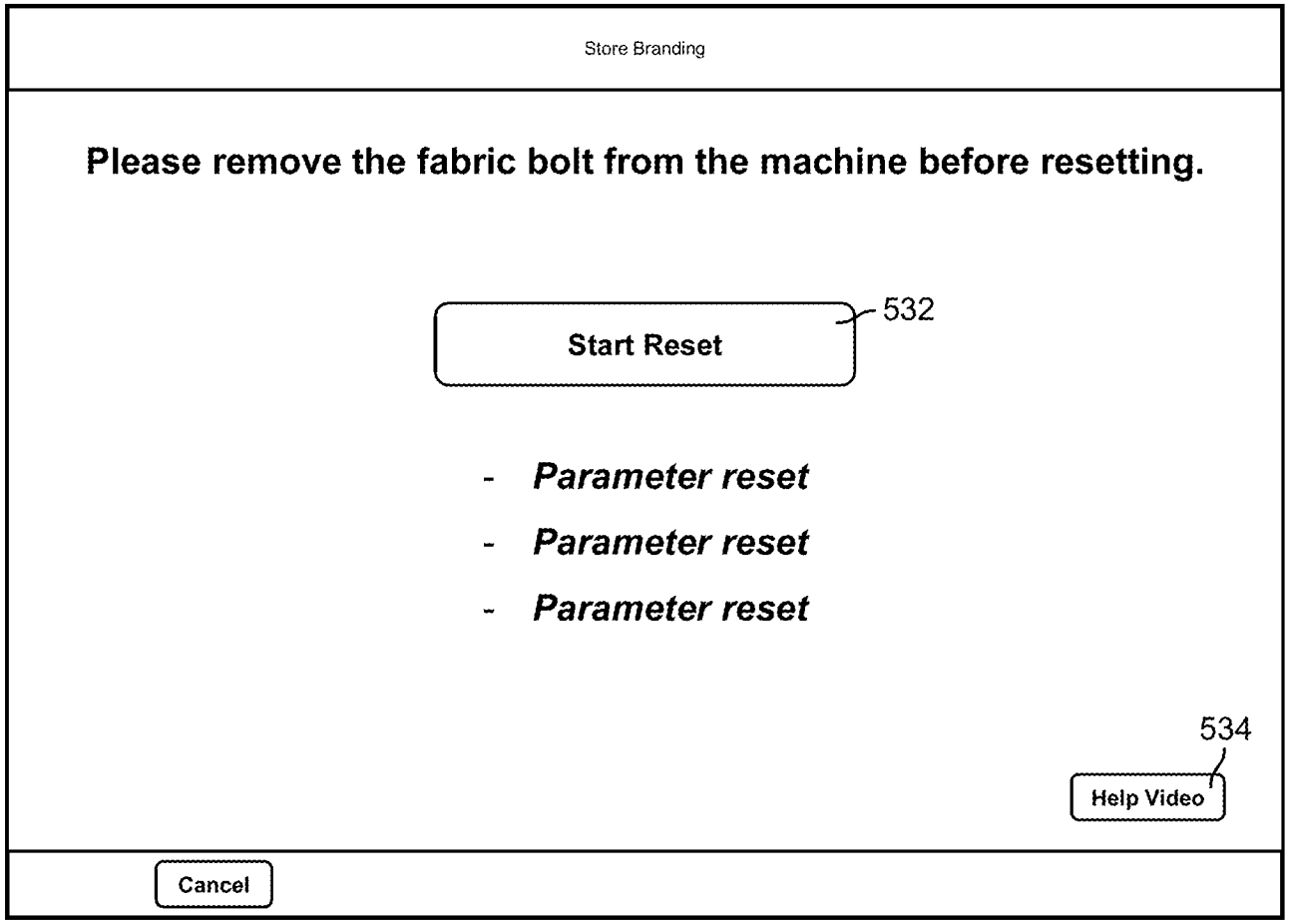
Figure 36:
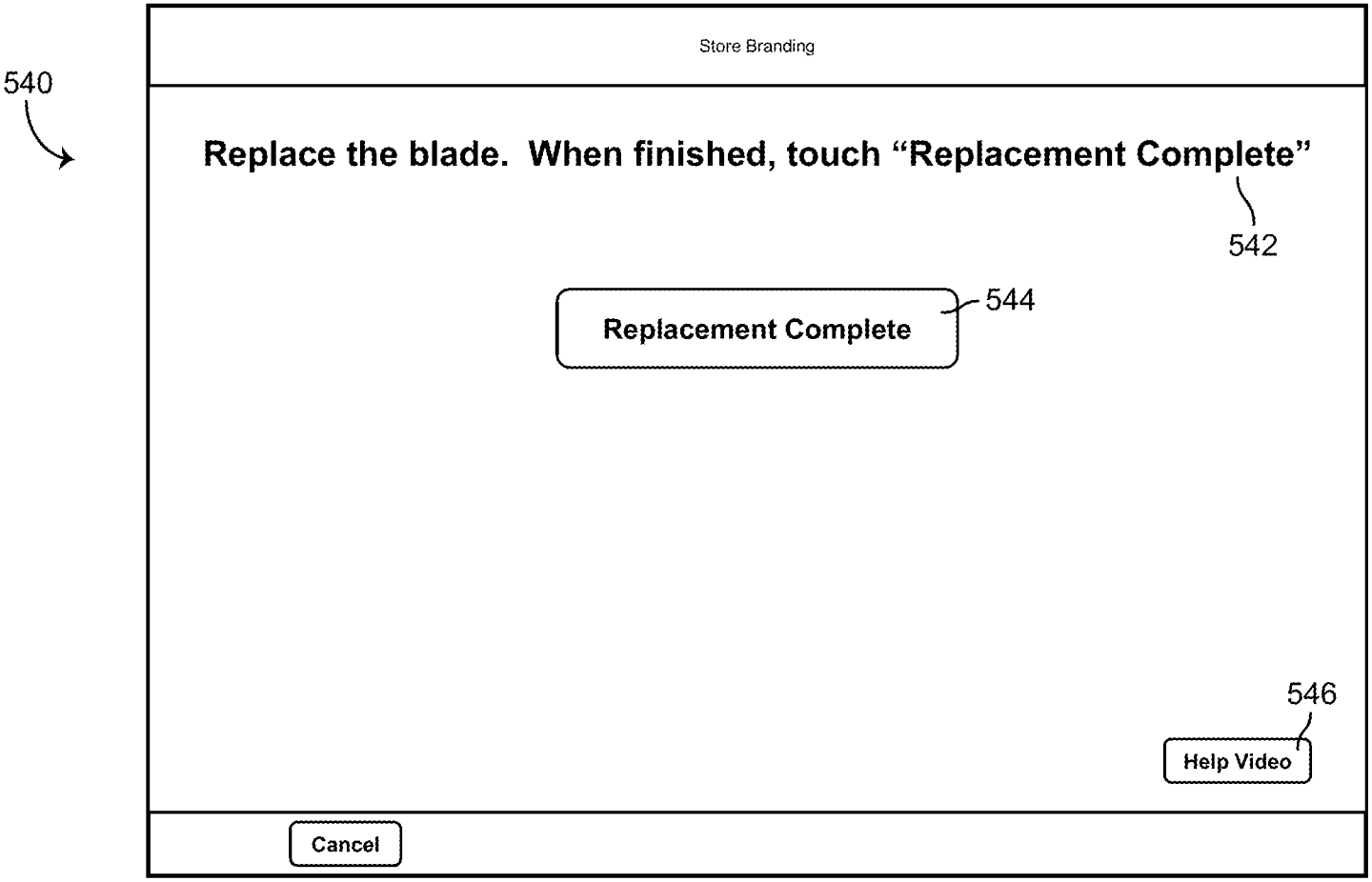
Figure 37:
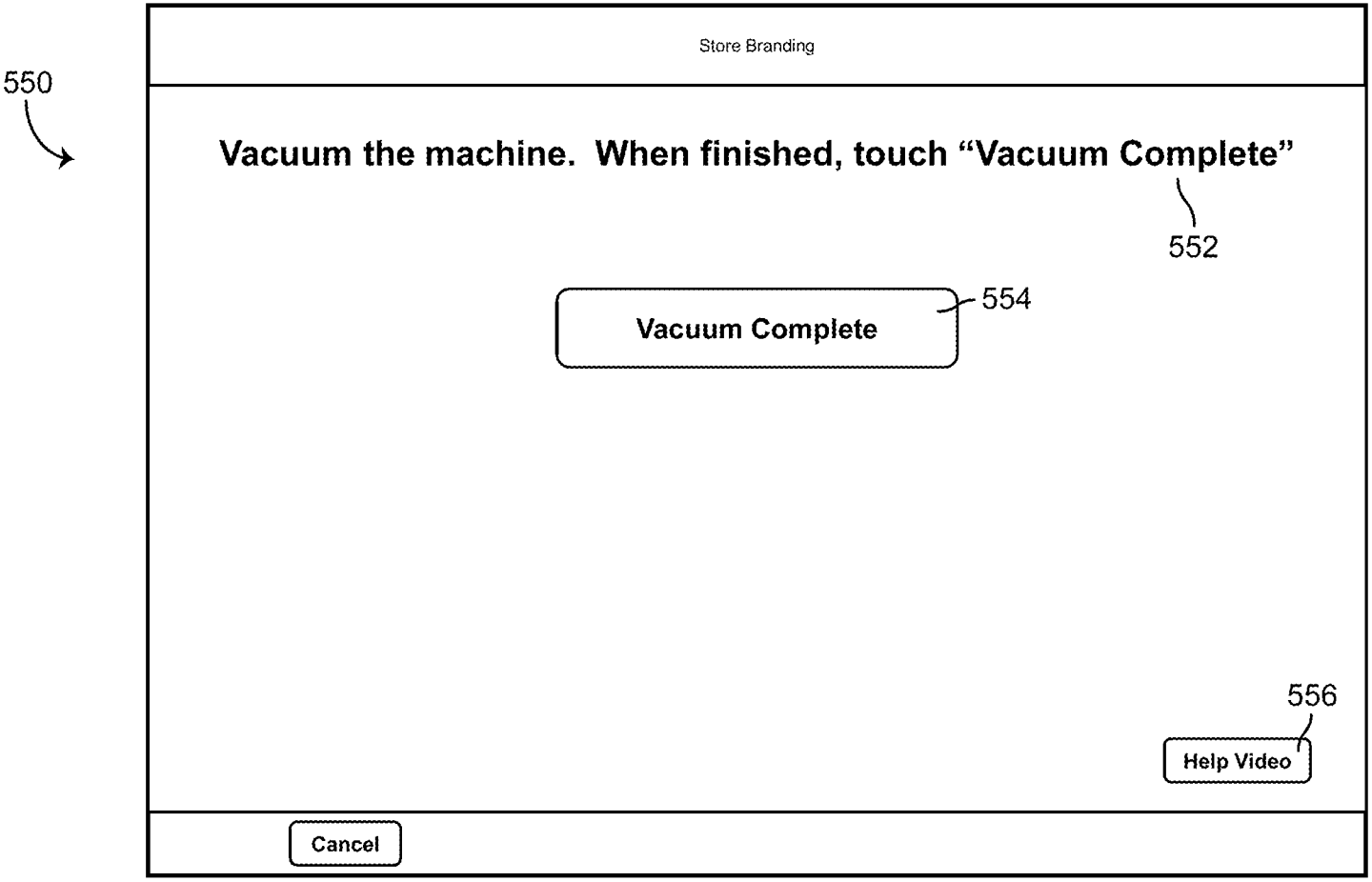

Referring specifically to FIG. 33, an associate menu 510 is shown, according to an exemplary embodiment. Associate menu 510 may be displayed in response to a store employee entering his or her login credentials via user interface 500. Associate menu 510 is shown to include selectable icons 511-515. Each of icons 511-515 may initiate a different function available to store personnel. In some embodiments, associate menu 510 includes a help video icon 516. Help video icon 516 may allow store personnel to view an instructional video or other instructions for performing the various functions associated with icons 511-515.

Referring specifically to FIGS. 33-37, selecting icon 511 may cause user interface 520 to be displayed. User interface 520 is shown to include a number panel 522 through which store personnel can manually enter product information (e.g., a product SKU, a product ID, etc.). In some embodiments, user interface 520 includes a help video icon 524. Icon 524 can be selected to view an instructional video or other instructions for manually entering product information via user interface 520. Selecting icon 512 may cause the last label printed by printer 26 to be reprinted.

Selecting icon 513 may cause user interface 530 to be displayed. User interface 530 is shown to include a start reset icon 532. Selecting icon 532 may reset one or more components of dispensing device 10 (e.g., scale 40, scanners 28, printer 26, cutting mechanism 70, motor 52, etc.). In some embodiments, user interface 530 includes a help video icon 534. Icon 534 can be selected to view an instructional video or other instructions for resetting dispensing device 10 via user interface 530.

Selecting icon 514 may cause user interface 540 to be displayed. User interface 540 is shown to include a blade replacement instruction 542 and a replacement complete icon 544. Selecting icon 544 may reset a counter tracking the number of cuts performed by cutting mechanism 70. In some embodiments, user interface 540 includes a help video icon 546. Icon 546 can be selected to view an instructional video or other instructions for replacing blade 112 of cutting mechanism 70.

Selecting icon 515 may cause user interface 550 to be displayed. User interface 550 is shown to include a vacuuming instruction 552 and a vacuum complete icon 554. Selecting icon 554 may reset a timer or date attribute indicating the most recent time that dispensing device 10 was vacuumed. In some embodiments, user interface 550 includes a help video icon 556. Icon 556 can be selected to view an instructional video or other instructions for vacuuming dispensing device 10.

Figure 38:
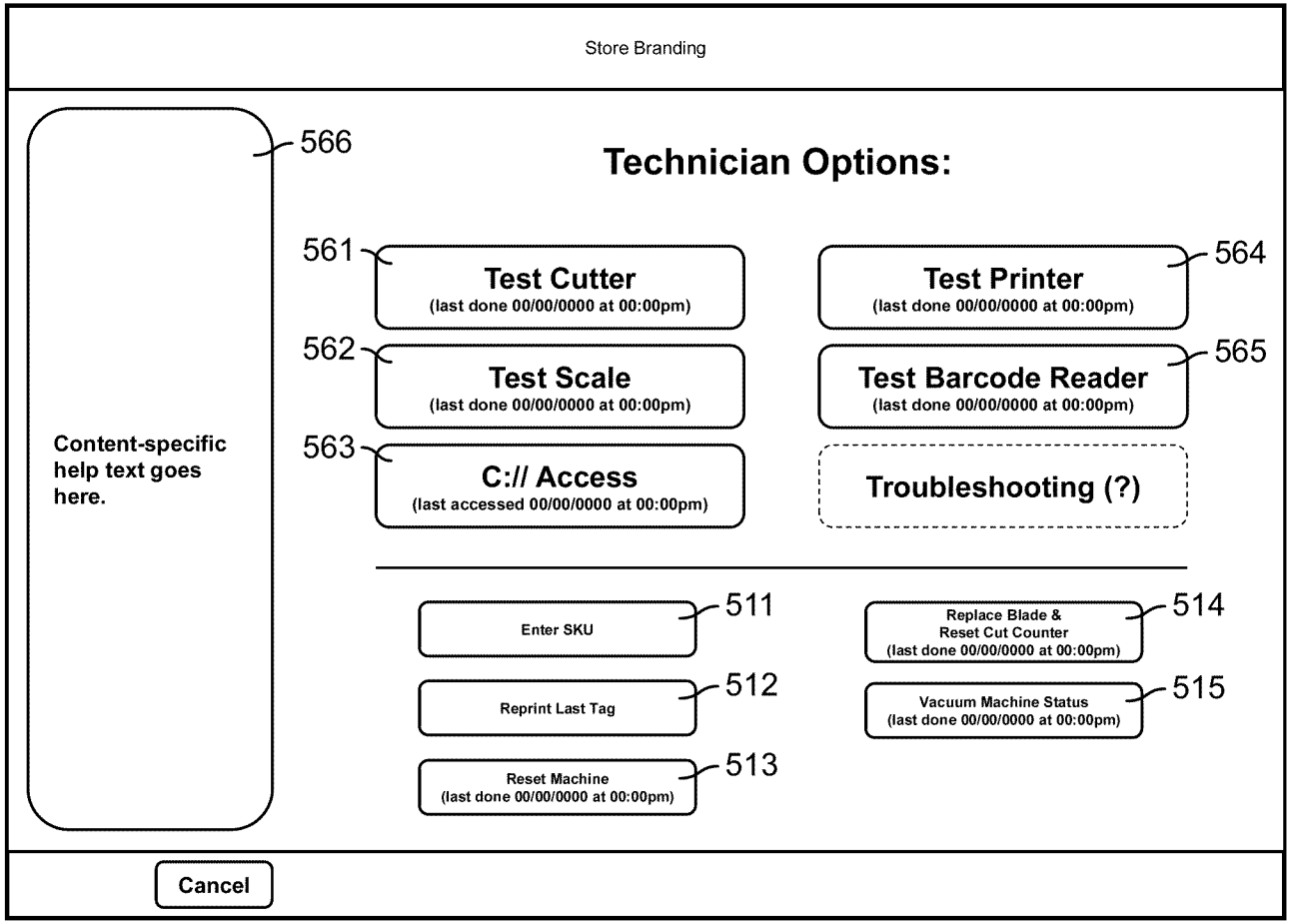
FIG. 38 is a drawing of a technician interface that may be displayed via the user interface of the soft good dispensing device of FIG. 1, according to an exemplary embodiment.

Referring specifically to FIG. 38, a technician interface 560 is shown, according to an exemplary embodiment. Technician interface 560 may be displayed in response to a service technician entering his or her login credentials via user interface 500. Technician interface 560 is shown to include selectable icons 561-565. Each of icons 561-565 may initiate a different testing, service, and/or diagnostic function available to a service technician. For example, selecting icon 561 may initiate a test of cutting mechanism 70, selecting icon 562 may initiate a test of scale 40, selecting icon 563 may cause a command prompt to be displayed, selecting icon 563 may initiate a test of printer 26, and selecting icon 565 may initiate a test of scanners 28.

Technician interface 560 is also shown to include icons 511-515. Icons 511-515 provide the service technician to perform all of the functions available to store personnel via associate menu 510.

Figure 39:
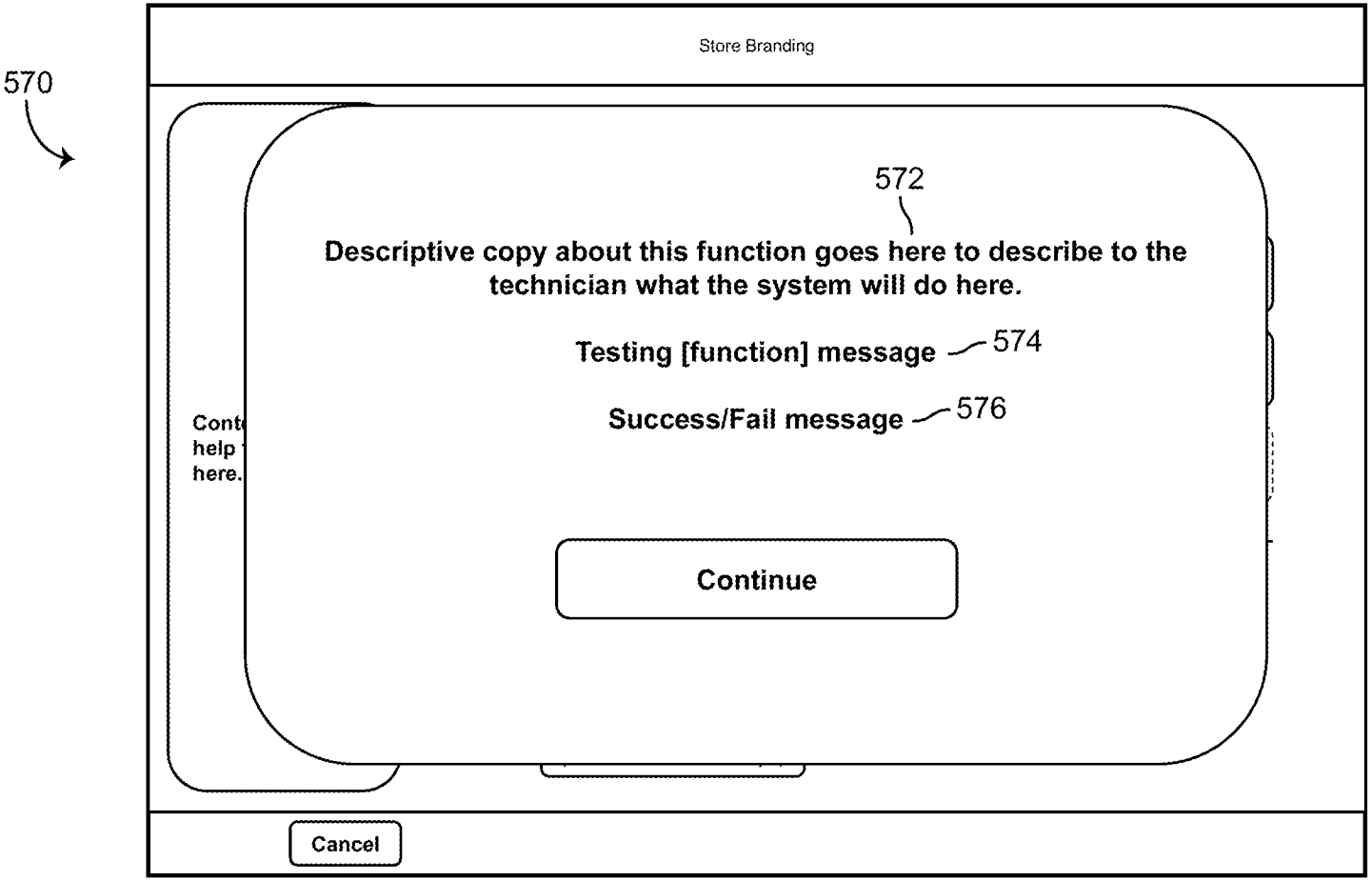
FIG. 39 is a drawing of a testing status interface that may be displayed via the user interface of the soft good dispensing device of FIG. 1, according to an exemplary embodiment.

Referring specifically to FIG. 39, a testing status interface 570 is shown, according to an exemplary embodiment. Testing status interface 570 may be displayed in response to selecting one or more of icons 561-565 via technician interface 560. Testing status interface is shown to include descriptive text 572 describing the a test currently being performed, a testing message 574 indicating the status of the current test, and a result indicator 576 displaying the result of the current test (e.g., pass, fail, etc.).

What is claimed is:

1. A method for dispensing a soft good, the method comprising:

receiving a soft good supply at a loading zone of a soft good dispensing device;

reading a machine-readable image affixed to the soft good supply using a scanner of the soft good dispensing device and determining an identity of the soft good supply in the loading zone using data from the scanner;

measuring a weight of the soft good supply using a scale of the soft good dispensing device and estimating an amount of the soft good remaining on the soft good supply using the measured weight;

displaying a graphical user interface via a user interface of the soft good dispensing device, the graphical user interface comprising an indication of the identity of the soft good supply and the estimated amount of the soft good remaining;

receiving a desired quantity of the soft good at a controller of the soft good dispensing device;

determining whether the desired quantity of the soft good exists in more than one piece on the soft good supply;

displaying a prompt via the user interface for a user to indicate whether to purchase the desired quantity of the soft good in a single piece or in multiple pieces; and operating, by the controller, a dispensing mechanism of the soft good dispensing device to automatically dispense the desired quantity of the soft good from the soft good supply.

2. The method of claim 1, wherein the soft good comprises at least one of: fabric, lace, trim, ribbon, cording, elastic, foam, batting, stitching cloth, interfacing, plastic, vinyl, fur, felt, fleece, and fusible web.

3. The method of claim 1, further comprising:

determining whether the desired quantity of the soft good exceeds the estimated amount of the soft good remaining on the soft good supply; and displaying a message via the user interface indicating that an insufficient amount of the soft good is available in response to a determination that the desired quantity of the soft good exceeds the estimated amount of the soft good remaining on the soft good supply.

4. The method of claim 1, further comprising:

in response to a determination that the estimated amount of the soft good remaining on the soft good supply exceeds the desired quantity of the soft good, calculating a difference between the estimated amount of the soft good remaining on the soft good supply and the desired quantity of the soft good;

comparing the calculated difference with a threshold value; and displaying a prompt via the user interface for a user to indicate whether to increase the desired quantity in response to a determination that the calculated difference is less than the threshold value.

5. The method of claim 1, further comprising displaying instructions via the user interface for at least one of:

loading the soft good supply into the loading zone;

unloading the soft good supply from the loading zone; and reloading the soft good supply in the loading zone.

6. The method of claim 1, further comprising moving a clamp roller of the soft good dispensing device between:

an unclamped position in which the soft good supply is loaded into the loading zone; and a clamped position in which a free end of the soft good is clamped between the clamp roller and another roller of the soft good dispensing device.

7. The method of claim 6, further comprising:

moving the clamp roller from the unclamped position into the clamped position in response to a determination, by the controller, that a loading zone door of the soft good dispensing device is closed;

wherein the controller operates an actuator configured to move the clamp roller between the clamped position and the unclamped position.

8. The method of claim 1, wherein operating the dispensing mechanism of the soft good dispensing device comprises:

operating a motor of the dispensing mechanism to control a rotational position of one or more rollers rotatably coupled to the motor;

unwinding the soft good from the soft good supply by rotating the rollers until the desired quantity of the soft good is unwound from the soft good supply; and operating a cutting mechanism to separate the desired quantity of the soft good from the soft good supply.

9. The method of claim 1, further comprising moving a lift element of the soft good dispensing device between:

a lowered position in which the soft good supply is loaded into the loading zone; and a raised position in which an unwound portion of the soft good is directed at least partially upward from the soft good supply, over the lift element, and at least partially downward from the lift element toward the dispensing mechanism.

10. The method of claim 1, further comprising:

operating a lift element of the soft good dispensing device, wherein the lift element is configured to direct an unwound portion of the soft good toward the dispensing mechanism from a uniform position for multiple different loading orientations of the soft good supply.

11. A method for dispensing a soft good, the method comprising:

receiving a soft good supply at a loading zone of a soft good dispensing device;

reading a machine-readable image affixed to the soft good supply using a scanner of the soft good dispensing device and determining an identity of the soft good supply in the loading zone using data from the scanner;

measuring a weight of the soft good supply using a scale of the soft good dispensing device and estimating an amount of the soft good remaining on the soft good supply using the measured weight;

displaying a graphical user interface via a user interface of the soft good dispensing device, the graphical user interface comprising an indication of the identity of the soft good supply and the estimated amount of the soft good remaining;

receiving a desired quantity of the soft good at a controller of the soft good dispensing device;

operating, by the controller, a dispensing mechanism of the soft good dispensing device to automatically dispense the desired quantity of the soft good from the soft good supply;

using an optical sensor of the soft good dispensing device to detect whether operation of the dispensing mechanism results in an unwinding of the soft good from the soft good supply; and determining that the desired quantity of the soft good exists in more than one piece in response to a detection, by the optical sensor, that the unwinding of the soft good has stopped prior to unwinding the desired quantity of the soft good.

12. A soft good dispensing device comprising:

a loading zone configured to receive a soft good supply in multiple different orientations;

a scale configured to measure a weight of the soft good supply in the loading zone;

a controller configured to estimate an amount of a soft good remaining on the soft good supply using the measured weight;

a user interface configured to display the estimated amount of the soft good remaining and to receive a user selection of a desired quantity of the soft good;

a dispensing mechanism configured to automatically dispense the desired quantity of the soft good from the soft good supply; and an optical sensor configured to detect whether operation of the dispensing mechanism results in an unwinding of the soft good from the soft good supply;

wherein the controller is configured to determine whether the desired quantity of the soft good exists in more than one piece in response to a detection, by the optical sensor, that the unwinding of the soft good has stopped prior to unwinding the desired quantity of the soft good.

13. The soft good dispensing device of claim 12, wherein the soft good comprises at least one of: fabric, lace, trim, ribbon, cording, elastic, foam, batting, stitching cloth, interfacing, plastic, vinyl, fur, felt, fleece, and fusible web.

14. The soft good dispensing device of claim 12, further comprising:

a scanner configured to read a machine-readable image affixed to the soft good supply in the loading zone;

wherein the controller is configured to determine an identity of the soft good supply in the loading zone using data from the scanner; and wherein the user interface is configured to display an indication of the identity of the soft good supply.

15. The soft good dispensing device of claim 14, wherein the controller is configured to use the identity of the soft good to determine one or more attributes of the identified soft good; and wherein the controller is configured to use the one or more attributes of the identified soft good in conjunction with the measured weight to estimate the amount of the soft good remaining on the soft good supply.

16. The soft good dispensing device of claim 12, wherein the dispensing mechanism comprises:

a motor in communication with and operable by the controller;

one or more rollers rotatably coupled to the motor and configured to unwind the desired quantity of the soft good from the soft good supply; and a cutting mechanism in communication with and operable by the controller, the cutting mechanism configured to separate the desired quantity of the soft good from the soft good supply.

17. The soft good dispensing device of claim 12, further comprising:

a lift element is configured to direct an unwound portion of the soft good toward the dispensing mechanism from a uniform position for multiple different orientations of the soft good supply in the loading zone.

18. The soft good dispensing device of claim 12, further comprising:

a clamp movable between an unclamped position and a clamped position;

wherein the controller is configured to cause the clamp to move into the unclamped position in response to a determination by the controller that the desired quantity of the soft good has been unwound from the soft good supply;

wherein the clamp is configured to hold an unwound portion of the soft good in a stable position while a cutting mechanism separates the desired quantity of the soft good from the soft good supply.

* * * * *